US009533345B2

(12) United States Patent
Kato et al.

(10) Patent No.: US 9,533,345 B2
(45) Date of Patent: Jan. 3, 2017

(54) CORE-MOLDING DEVICE, AND CORE-MOLDING METHOD

(71) Applicant: SINTOKOGIO, LTD., Nagoya-shi, Aichi (JP)

(72) Inventors: Shigeyoshi Kato, Toyokawa (JP); Etsuya Ohashi, Toyokawa (JP); Hisashi Harada, Toyokawa (JP)

(73) Assignee: SINTOKOGIO, LTD., Nagoya-shi, Aichi (JP)

( * ) Notice: Subject to any disclaimer, the term of this patent is extended or adjusted under 35 U.S.C. 154(b) by 25 days.

(21) Appl. No.: 14/381,683

(22) PCT Filed: Feb. 7, 2013

(86) PCT No.: PCT/JP2013/052930

§ 371 (c)(1),
(2) Date: Aug. 28, 2014

(87) PCT Pub. No.: WO2013/175813

PCT Pub. Date: Nov. 28, 2013

(65) Prior Publication Data

US 2015/0144283 A1 May 28, 2015

(30) Foreign Application Priority Data

May 23, 2012 (JP) ..... 2012-117196

(51) Int. Cl.
*B22C 15/14* (2006.01)
*B22C 9/10* (2006.01)
(Continued)

(52) U.S. Cl.
CPC ..... *B22C 15/24* (2013.01); *B22C 9/02* (2013.01); *B22C 9/10* (2013.01); *B22C 13/16* (2013.01); *B22C 19/00* (2013.01); *B22C 23/00* (2013.01)

(58) Field of Classification Search
CPC ..... B22C 9/10; B22C 9/02; B22C 13/16; B22C 19/00; B22C 23/00; B22C 15/24
See application file for complete search history.

(56) References Cited

U.S. PATENT DOCUMENTS

2002/0157800 A1* 10/2002 Kaneto ..... B22C 15/08 164/20

FOREIGN PATENT DOCUMENTS

CN 2506375 Y 8/2002
CN 2701552 Y 5/2005
(Continued)

OTHER PUBLICATIONS

U.S. Appl. No. 14/123,329, Sintokogio Ltd.
U.S. Appl. No. 14/402,753, Sintokogio Ltd.

*Primary Examiner* — Kevin P Kerns
*Assistant Examiner* — Steven Ha
(74) *Attorney, Agent, or Firm* — Drinker Biddle & Reath LLP

(57) ABSTRACT

A core molding machine which can be made smaller while having a favorable core sand filling property is provided. The machine comprises a core box having a pair of laterally separable dies and a sand filling device, having a blow head disposed under the core box, for filling the core box with core sand directed upward from the blow head; the blow head having a sand blow chamber for guiding the core sand to the core box while being connected to the core box and a sand storage chamber communicating with the sand blow chamber; the sand filling device having a compressed air supply unit for supplying a compressed air for blowing the core sand into the core box and an aeration air supply unit for supplying an aeration air for floating and fluidizing the core sand within the sand blow chamber.

16 Claims, 36 Drawing Sheets

(51) Int. Cl.

| | |
|---|---|
| ***B22C 15/24*** | (2006.01) |
| ***B22C 13/16*** | (2006.01) |
| ***B22C 23/00*** | (2006.01) |
| ***B22C 9/02*** | (2006.01) |
| ***B22C 19/00*** | (2006.01) |

(56) References Cited

FOREIGN PATENT DOCUMENTS

| | | | |
|---|---|---|---|
| CN | 1968771 | A | 5/2007 |
| CN | 201249253 | Y | 6/2009 |
| CN | 101862816 | | 10/2010 |
| CN | 101954459 | | 1/2011 |
| CN | 103492104 | | 1/2014 |
| JP | S31-004119 | | 3/1956 |
| JP | S31-6413 | | 7/1956 |
| JP | S47-13179 | | 4/1972 |
| JP | S47-41368 | Y1 | 12/1972 |
| JP | S56-84155 | A | 7/1981 |
| JP | S59-041821 | | 10/1984 |
| JP | S60-113146 | U | 7/1985 |
| JP | S61-202747 | A | 9/1986 |
| JP | S63-202747 | A | 8/1988 |
| JP | H05-305386 | A | 11/1993 |
| JP | H10-166106 | A | 6/1998 |
| JP | H10-216902 | | 8/1998 |
| JP | 2001-198653 | | 7/2001 |
| JP | 2008-213036 | A | 9/2008 |
| JP | 2008-264867 | A | 11/2008 |
| JP | 2009-183984 | A | 8/2009 |
| WO | WO 2008/120559 | | 10/2008 |
| WO | WO-2012/165056 | A2 | 12/2012 |
| WO | WO-2012/165181 | A1 | 12/2012 |

* cited by examiner (a)

(b)

(a)

(b)

(a)

(b)

(a)

(b)

(a)

(b)

CORE-MOLDING DEVICE, AND CORE-MOLDING METHOD

TECHNICAL FIELD

The present invention relates to a core molding machine and core molding method for molding a core by filling a core box with core sand.

BACKGROUND ART

A so-called top-blow type core molding machine in which a blow head is arranged above a core box so as to blow core sand down into the core box from thereabove has conventionally been used (e.g., Patent Literature 1).

In the case of the top-blow type core molding machine, however, the blow head is arranged above the core box, and a sand tank is further arranged above the blow head. This increases the size of the machine in its height direction, which may make the machine bulky. For reducing the size of the machine in its height direction and making it smaller in size, a so-called under-blow type in which a blow head is arranged under a core box so as to blow core sand up into the core box from thereunder may be employed. However, the under-blow type blows the core sand into the core box against gravity and thus may affect the filling property of the core sand for the core box.

CITATION LIST

Patent Literature

Patent Literature 1: Japanese Patent Publication No. S47-013179

SUMMARY OF INVENTION

Technical Problem

It is an object of the present invention to provide a core molding machine and core molding method which, even when employing the under-blow type for blowing core sand into a core box located on the upper side, can favorably fill the core box with the core sand.

Solution to Problem

The core molding machine in accordance with one aspect of the present invention comprises a core box having a pair of laterally separable dies and a sand filling device, having a blow head disposed under the core box, for filling the core box with core sand directed upward from the blow head, the blow head having a sand blow chamber for guiding the core sand to the core box while being connected to the core box and a sand storage chamber communicating with the sand blow chamber, the sand filling device having a compressed air supply unit for supplying the sand storage chamber with a compressed air for blowing the core sand into the core box and an aeration air supply unit for supplying an aeration air for floating and fluidizing the core sand within the sand blow chamber.

In the core molding machine in accordance with this aspect of the present invention, in a state where the core sand within the sand blow chamber is floated and fluidized by the aeration air supply unit, the compressed air supply unit blows the compressed air into the sand blow chamber through the sand storage chamber, thereby feeding the core sand from within the sand blow chamber to the core box. Therefore, even when employing the under-blow type for blowing the core sand to the core box located on the upper side, the core box can favorably be filled with the core sand.

The core molding machine in accordance with this aspect of the present invention may further comprise a frame member for holding a fixed die as one of the pair of dies, a first actuator for driving a movable die as the other of the pair of dies to move closer to or away from the fixed die, a second actuator for vertically driving the blow head to move closer to or away from the core box, and a rotary drive unit for rotating the movable die moved away from the fixed die by the first actuator. In this case, as the movable die moved away from the fixed die is rotated by the rotary drive unit, the core held by the movable die is easier to release and remove from the movable die.

The rotary drive unit may have a rotary axis member provided in a movable die holding member for holding the movable die, an abutment member provided in the rotary axis member so as to be rotatable with the rotary axis member, and an orientation change member for changing an orientation of the movable die through the rotary axis member when abutting against the abutment member; the orientation change member being located at a position, different from a height position of the rotary axis member, on a movement locus of the abutment member accompanying a movement of the movable die caused by the first actuator; when the movable die having the abutment member in contact with the orientation change member is moved away from the fixed die by the first actuator, the abutment member, while changing an orientation thereof along a surface of the orientation change member, may rotate the movable die with the aid of the rotary axis member and the movable die holding member. In this case, simply moving the movable die away from the fixed die by the first actuator can rotate the movable die separated from the fixed die. This makes it unnecessary to provide a separate actuator for rotating the movable die. Therefore, the machine can be made further simpler and smaller.

The core molding machine in accordance with this aspect of the present invention may further comprise a first release unit for releasing a core from the movable die after the movable die holding the core is rotated by the rotary drive unit such that the core is on the upper side. In this case, the first release unit releases the core from the movable die having been rotated such that the core is on the upper side. Therefore, the core released from the movable die by the first release unit can be kept held by the movable die. This can prevent the released core from dropping out of the movable die and make the released core easier to be handled by users.

The first release unit may comprise a slide member provided in the movable die and a guide member, provided on the frame member side, having a slide surface for changing a height position of the slide member when abutting against the slide member, the slide surface being located on a movement locus of the slide member accompanying a movement of the movable die caused by the first actuator after the movable die is rotated by the rotary drive unit; when the movable die having been rotated by the rotary drive unit is moved away from, the fixed die by the first actuator, the slide member slides along the slide surface so as to push the core held by the movable die away from the movable die. In this case, simply moving the movable die away from the fixed die by the first actuator can release the core from the movable die having been rotated. This makes it unnecessary to provide a separate actuator for releasing the core from the movable die. Therefore, the machine can be made further simpler and smaller.

The core molding machine in accordance with this aspect of the present invention may comprise a first cleaning unit adapted to abut against a blow head nozzle in the blow head when coming closer to the blow head and a second cleaning unit adapted to abut against a fixed die nozzle in the fixed die when coming closer to the fixed die; the first and second cleaning units being moved closer to or away from the fixed die together with the movable die by the first actuator; when moved closer to the blow head together with the movable die by the first actuator, the first cleaning unit may slide while abutting against the blow head nozzle, so as to clean the blow head nozzle; and when moved closer to the fixed die together with the movable die by the first actuator, the second cleaning unit may slide while abutting against the fixed nozzle, so as to clean the fixed die nozzle. In this case, simply moving the first and second cleaning units closer to or away from the fixed die by the first actuator can clean the blow head nozzle and fixed die nozzle. This makes it unnecessary to provide separate actuators for moving the first and second cleaning units, respectively. Therefore, the machine can be made further simpler and smaller.

The core molding machine in accordance with this aspect of the present invention may further comprise a third cleaning unit provided in the frame member and adapted to abut against a movable die nozzle in the movable die when coming closer to the movable die; when the movable die moved by the first actuator comes closer, the third cleaning unit may slide while abutting against the movable die nozzle, so as to clean the movable die nozzle. In this case, simply moving the movable die closer to or away from the fixed die by the first actuator can clean the movable die nozzle when the movable die comes closer to the third cleaning unit. This makes it unnecessary to provide a separate actuator for cleaning the movable die nozzle. Therefore, the machine can be made further simpler and smaller.

The core molding machine in accordance with this aspect of the present invention may further comprise a sand tank for supplying the sand storage chamber with the core sand through a supply port of the sand storage chamber and an on/off gate, disposed between the sand tank and the supply port, for opening and closing the supply port, the on/off gate being driven by the first actuator, so as to close the supply port when the movable die forms a cavity for forming the core together with the fixed die. In this case, simply driving the on/off gate by the first actuator can control the opening and closing of the supply port. This makes it unnecessary to provide a separate actuator for driving the on/off gate. Therefore, the machine can be made further simpler and smaller.

The core molding machine in accordance with this aspect of the present invention may further comprise a flexible hose disposed between the sand tank and the supply port of the sand storage chamber. Since the flexible hose is deformable in this case, when the blow head is moved up and down by the second actuator while in a state where the sand tank is fixed, the flexible hose deforms so as to follow the movement of the blow head. This makes it unnecessary to move the sand tank up and down together with the blow head. Therefore, the machine can be made further simpler and smaller.

The core molding machine in accordance with this aspect of the present invention may further comprise a second release unit for releasing a core from the fixed die such that the core is held by the movable die when the core is molded within a cavity, formed by the movable die and the fixed die, for forming the core and the movable die is separated from the fixed die by the first actuator. In this case, the core can be held by the movable die while being released from the fixed die by the second release unit. Therefore, the core can be taken out from the core box more easily.

The second release unit may have a push member, provided in the fixed die and movable between a projected position protruding from the fixed die toward the movable die and a retracted position receding more from the movable die than is the projected position, for separating the core from the fixed die, an operating member connected to the push member and located outside of the cavity, and a biasing member for biasing the push member and the operating member toward the movable die; when the movable die moved by the first actuator is assembled with the fixed die, so as to form the cavity, the operating member may be pushed by the movable die against a biasing force from the biasing member, so as to move the push member from the projected position to the retracted position. In this case, the push member can be moved between the projected position and the retracted position depending on whether the movable die moved by the first actuator pushes the operating member or not. This makes it possible to release the core from the fixed die without providing a separate actuator for driving the push member. Therefore, the machine can be made further simpler and smaller.

The core molding machine in accordance with this aspect of the present invention may further comprise a sand collection device for collecting the sand having dropped from the core box to an upper face of the blow head. In this case, the sand having dropped on the upper face of the blow head is collected by the sand collection device without directly returning into the blow head. Therefore, sand masses in which sand is assembled and solidified and the like contained in the sand having dropped on the upper face of the blow head, if any, are also collected by the sand collection device. This can prevent the sand masses from affecting the molding of the next core.

The sand collection device may have a conduit member for guiding the sand from the upper face of the blow head to the sand storage chamber and a fourth cleaning unit for removing and discharging the sand having dropped on the upper face of the blow head away from the upper face of the blow head to the conduit member. In this case, the sand having dropped on the upper face of the blow head is returned to the sand storage chamber when discharged to the conduit member by the fourth cleaning unit. Hence, the sand can be reused.

The conduit member may slope down from the upper face of the blow head to the sand storage chamber. This allows the sand to slide down the conduit member under gravity when returning from the upper face of the blow head to the sand storage chamber, thereby making it unnecessary to provide a separate transport device such as a conveyor. Therefore, the machine can be made simpler.

The conduit member may be provided with a filter member adapted to pass therethrough sand having a predetermined particle size or smaller. In this case, even when the sand returned from the blow head to the sand storage chamber contains a sand mass or the like greater than the predetermined particle size, the filter member can remove the sand mass.

The core molding method in accordance with another aspect of the present invention comprises a cavity formation step of assembling a pair of laterally separable dies with each other, so as to yield a core box having a cavity therewithin; a communication step of connecting a blow head to the core box, so as to communicate the cavity and the blow head to each other; a fluidization step of blowing an aeration air into a sand blow chamber in the blow head by an aeration air supply unit, so as to float and fluidize core sand within the sand blow chamber; and a filling step of blowing a compressed air into a sand storage chamber, communicating with the sand blow chamber, in the blow head by a compressed air supply unit, so as to blow the floated and fluidized core sand within the sand blow chamber upward from the blow head, thereby filling the cavity communicating with the blow head with the core sand.

In the core molding method in accordance with this aspect of the present invention, in a state where the core sand within the sand blow chamber is floated and fluidized by the aeration air supply unit, the compressed air supply unit blows the compressed air into the sand blow chamber, thereby feeding the core sand from within the sand blow chamber to the core box. Therefore, even when employing the under-blow type for blowing the core sand to the core box located on the upper side, the core box can favorably be filled with the core sand.

The core molding method in accordance with this aspect of the present invention may further comprise a separation step of driving a movable die as one of the pair of dies by a first actuator after the filling step, so as to separate the movable die from a fixed die as the other of the pair of dies, and a die rotation step of rotating the movable die after the separation step; the die rotation step including moving the movable die held by a movable die holding member away from the fixed die by the first actuator, so as to bring an abutment member attached to the movable die holding member through a rotary axis member into contact with an orientation change member located on an advancing path of the abutment member and the rotating the movable die with the aid of the rotary axis member and movable die holding member by changing an orientation of the abutment member along a surface of the orientation change member while further moving the movable die away from the fixed die by the first actuator in a state where the abutment member is in contact with the orientation change member. In this case, simply moving the movable die away from the fixed die by the first actuator can rotate the movable die separated from the fixed die. This makes it unnecessary to provide a separate actuator for rotating the movable die. Therefore, the machine can be made further simpler and smaller.

The core molding method in accordance with this aspect of the present invention may further comprise a release step of releasing a core from the movable die after the movable die holding the core is rotated such that the core is on the upper side after the die rotation step. In this case, the core released from the movable die can be kept held by the movable die. This can prevent the released core from dropping out of the movable die and make the released core easier to be handled by users.

The core molding method in accordance with this aspect of the present invention may further comprise a first cleaning step of driving a first cleaning unit together with the movable die by the first actuator such that the first cleaning unit slides while abutting against a blow head nozzle in the blow head, so as to clean the blow head nozzle, and a second cleaning step of driving a second cleaning unit together with the movable die by the first actuator such that the second cleaning unit slides while abutting against a fixed die nozzle in the fixed die, so as to clean the fixed die nozzle. In this case, simply moving the first and second cleaning units by the first actuator can clean the blow head nozzle and fixed die nozzle. This makes it unnecessary to provide separate actuators for moving the first and second cleaning units, respectively. Therefore, the machine can be made further simpler and smaller.

The core molding method in accordance with this aspect of the present invention may further comprise a third cleaning step of driving the movable die by the first actuator such that a third cleaning unit slides while abutting against a movable die nozzle in the movable die, so as to clean the movable die nozzle. In this case, simply moving the movable die by the first actuator can clean the movable die nozzle when the movable die comes closer to the third cleaning unit. This makes it unnecessary to provide a separate actuator for moving the third cleaning unit. Therefore, the machine can be made further simpler and smaller.

The core molding method in accordance with this aspect of the present invention may further comprise an opening and closing step of driving by the first actuator an on/off gate located between a supply port of the sand storage chamber and a sand tank for supplying the sand storage chamber with the core sand, so as to open and close the supply port; the opening and closing step may close the supply port when the movable die forms the cavity for forming the core together with the fixed die. In this case, simply driving the on/off gate by the first actuator can control the opening and closing of the supply port. This makes it unnecessary to provide a separate actuator for driving the on/off gate. Therefore, the machine can be made further simpler and smaller.

The core molding method in accordance with this aspect of the present invention may further comprise a die open step of releasing the core from the fixed die such that the core is held by the movable die when the core is molded within the cavity, formed by the movable and fixed dies, for forming the core and the movable die is moved away from the fixed die by the first actuator between the filling and die rotation steps. In this case, the core can be held by the movable die while being released from the fixed die. Therefore, the core can be taken out from the core box more easily.

The core molding method in accordance with this aspect of the present invention may further comprise a hollow part formation step of moving the core box and the blow head away from each other before all of the core sand filling the core box is solidified after the filling step, so as to discharge an unsolidified part of the core sand from the core box to an upper face of the blow head, thereby molding a hollow core having a hollow part formed in the core, and a sand collection step of removing from the upper face of the blow head the sand discharged thereto and collecting the removed sand by a sand collection device. In this case, the sand having dropped on the upper face of the blow head is collected by the sand collection device without directly returning into the blow head. Therefore, sand masses in which sand is assembled and solidified and the like contained in the sand having dropped on the upper face of the blow head, if any, are also collected by the sand collection device. This can prevent the sand masses from affecting the molding of the next core.

The sand collection step may supply the collected sand to the sand storage chamber. In this case, the sand having dropped on the upper face of the blow head can be reused.

Advantageous Effects of Invention

Even when employing the under-blow type for blowing core sand into a core box located on the upper side in a core molding machine and core molding method, the present invention can favorably fill the core box with the core sand.

Figure 1:
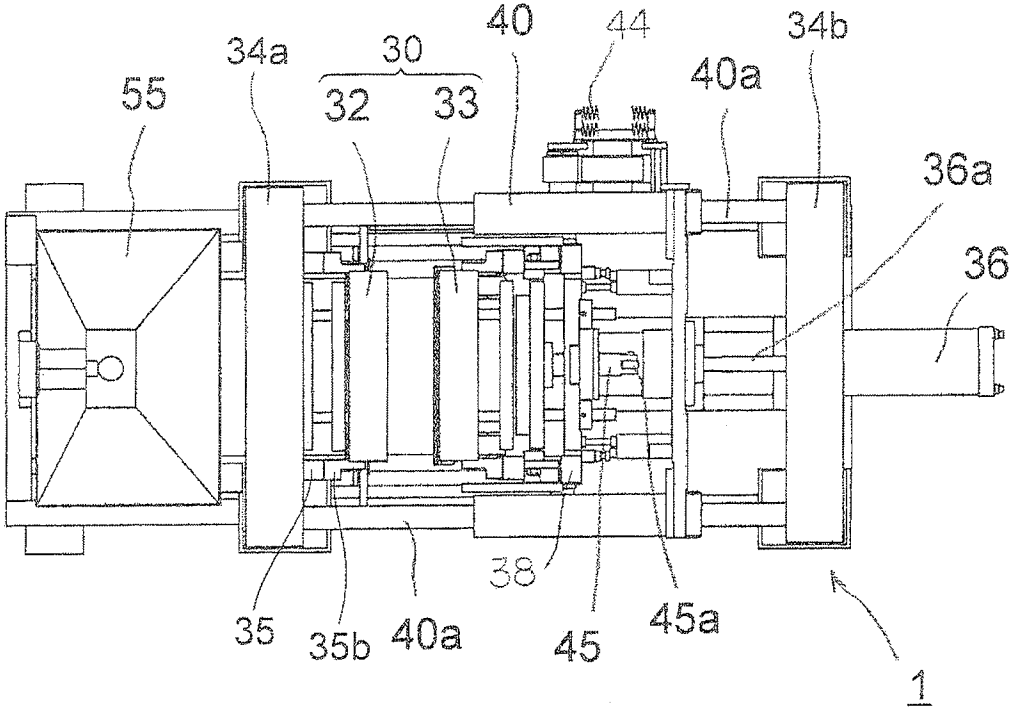
FIG. 1 is a plan view of the core molding machine in accordance with a first embodiment.
Figure 2:
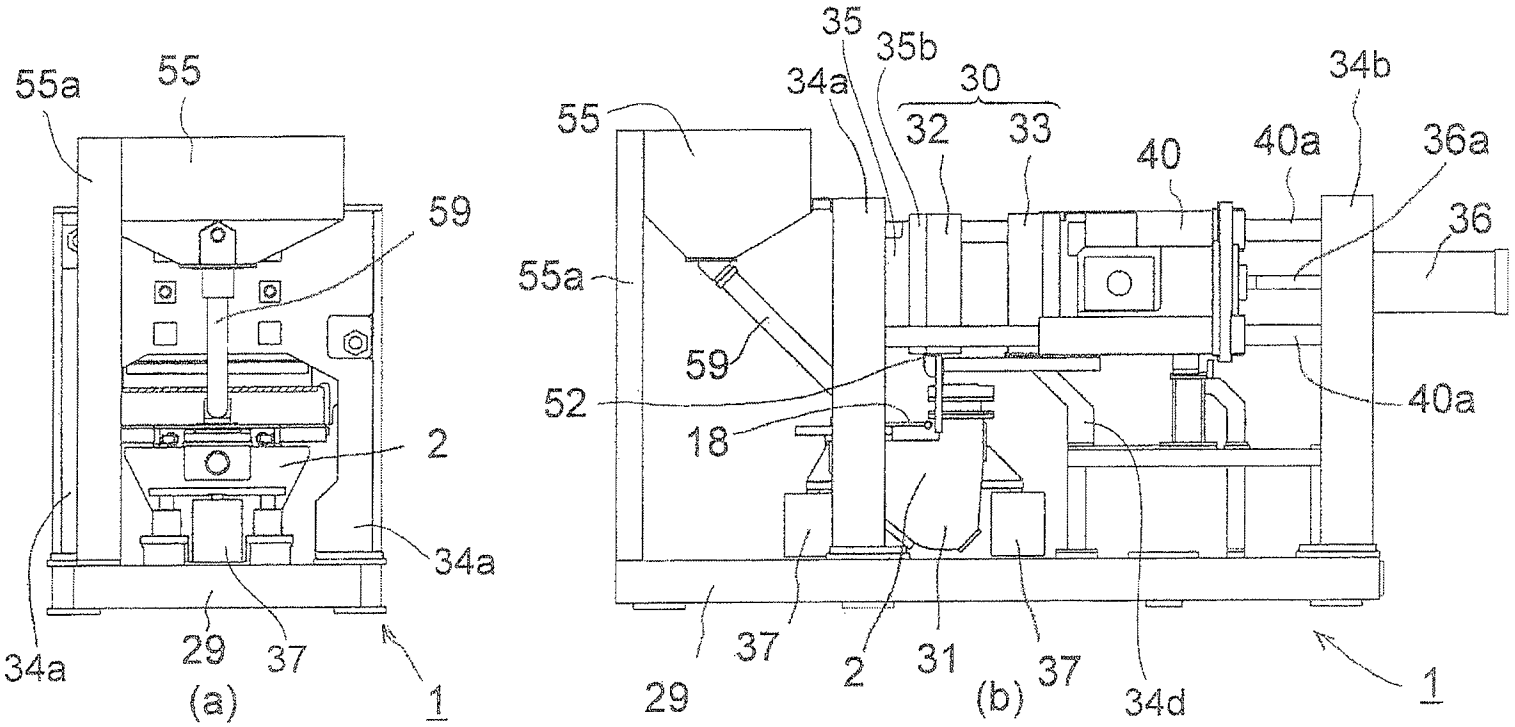
Figure 3:
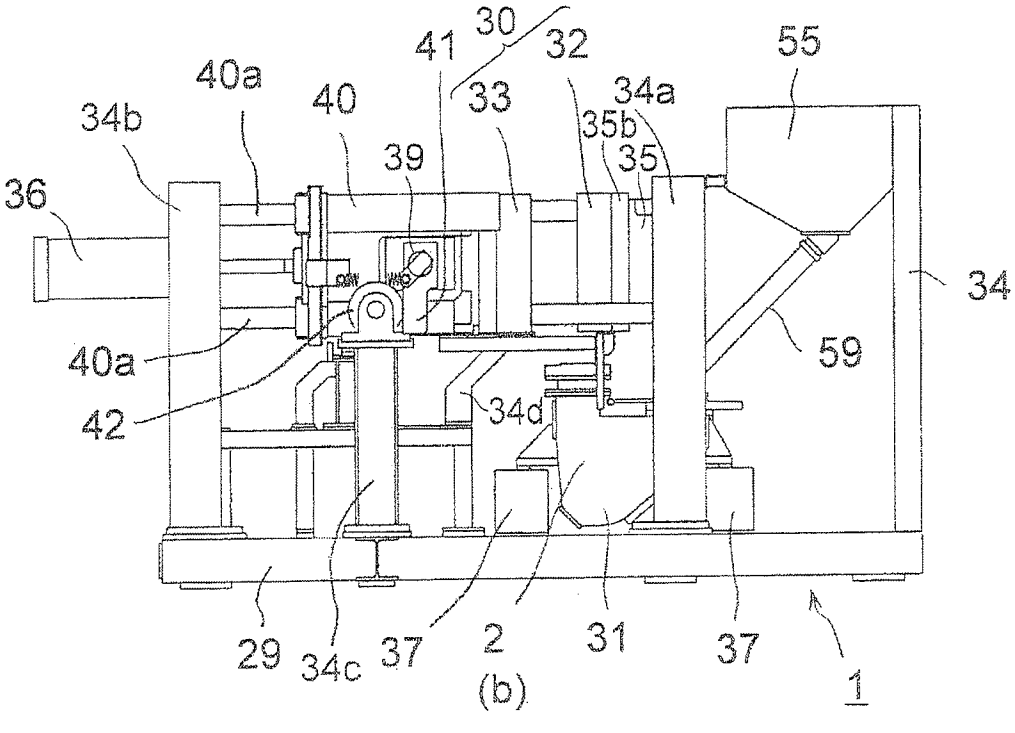
Figure 3:
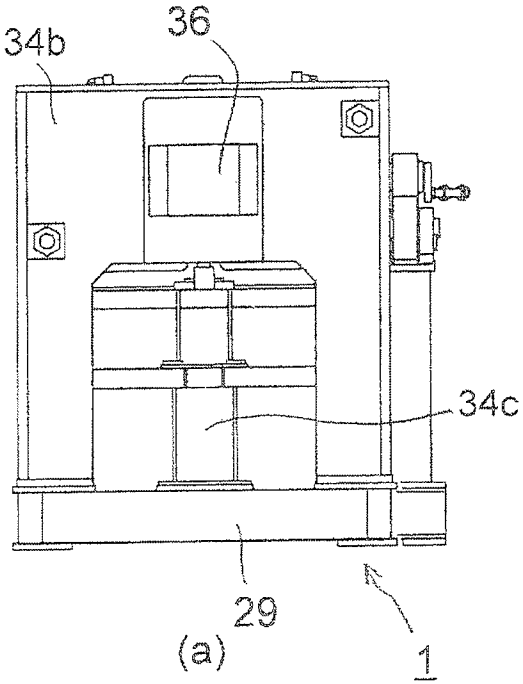
Figure 4:
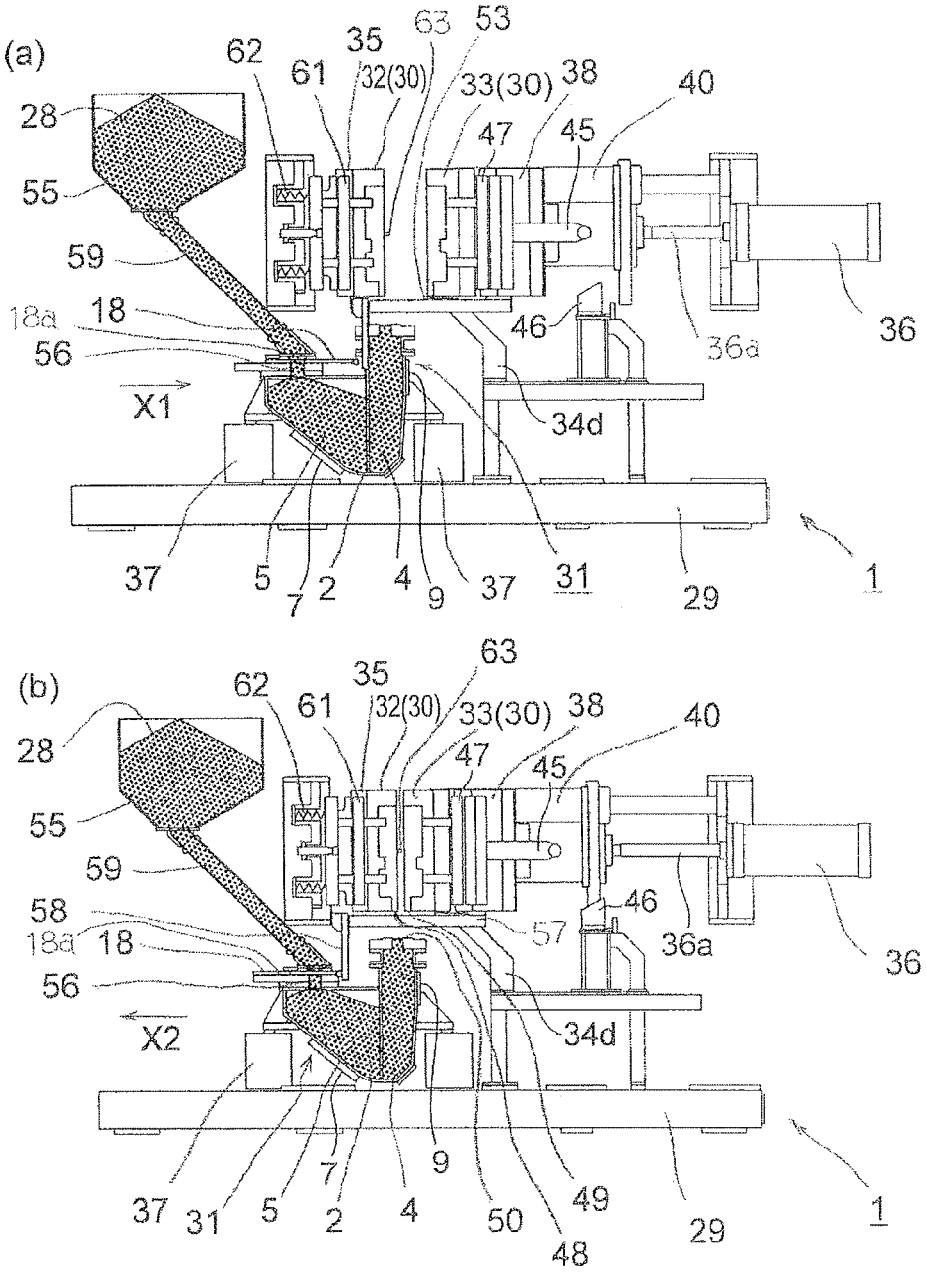
Figure 5:
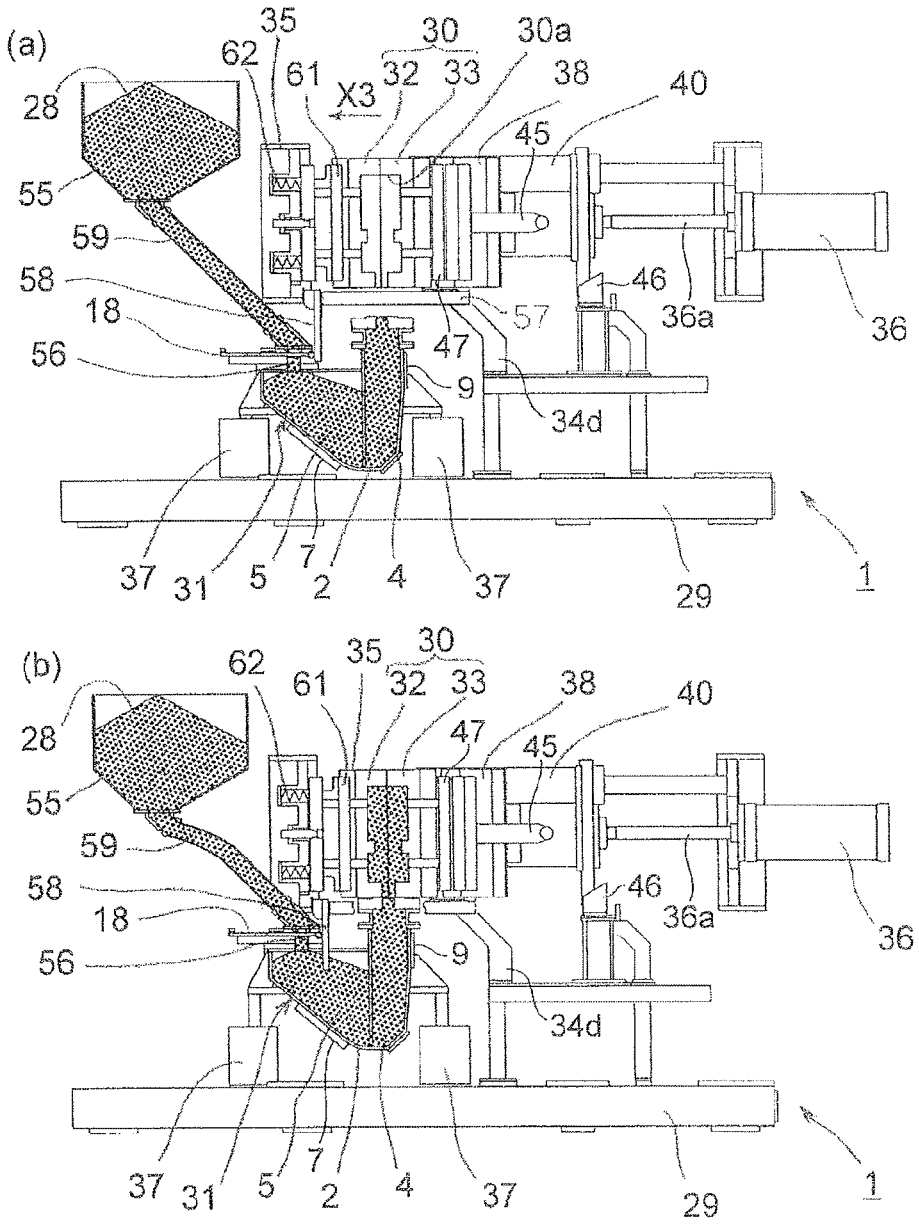
Figure 6:
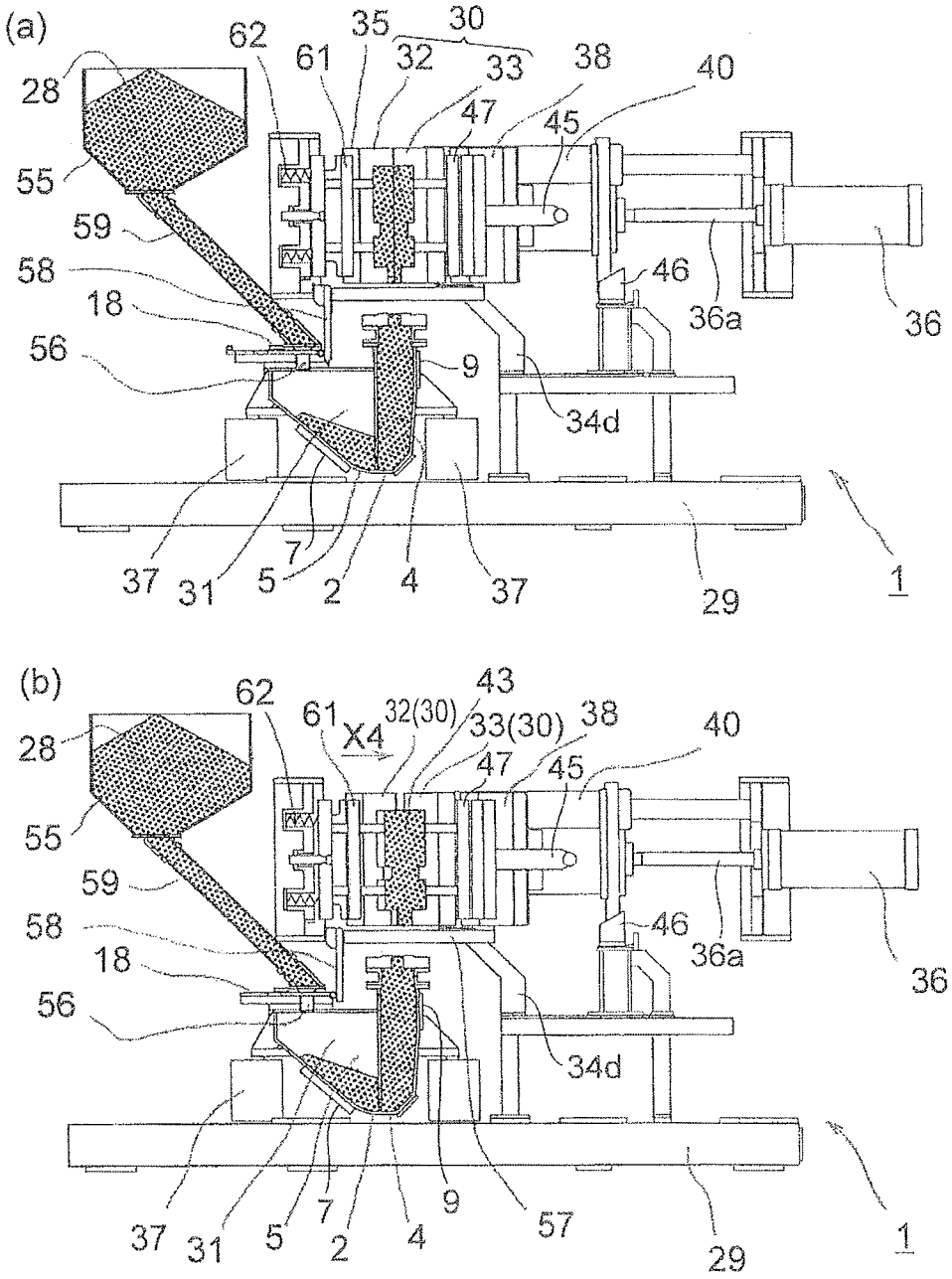
Figure 7:
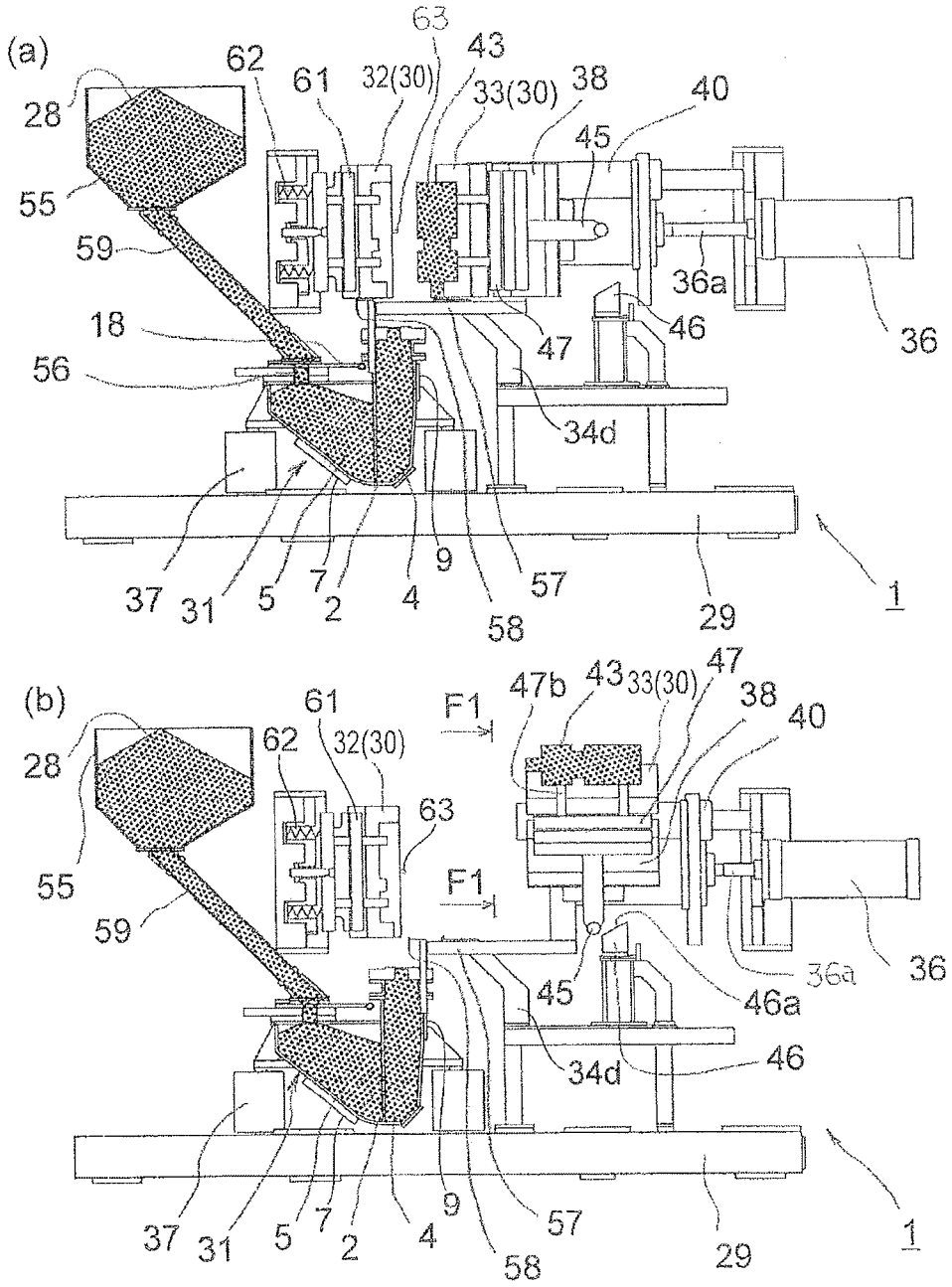
Figure 8:
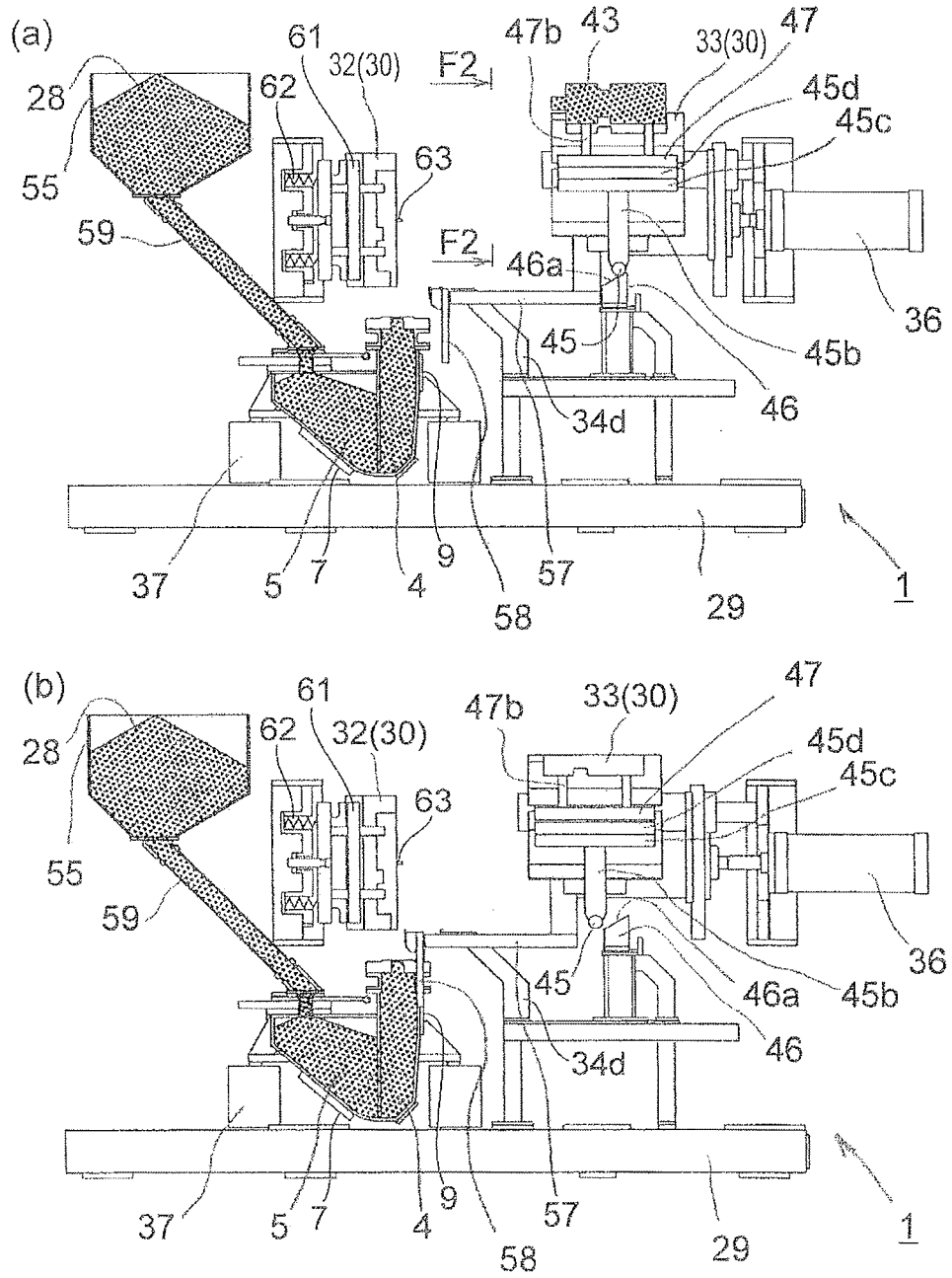
Figure 9:
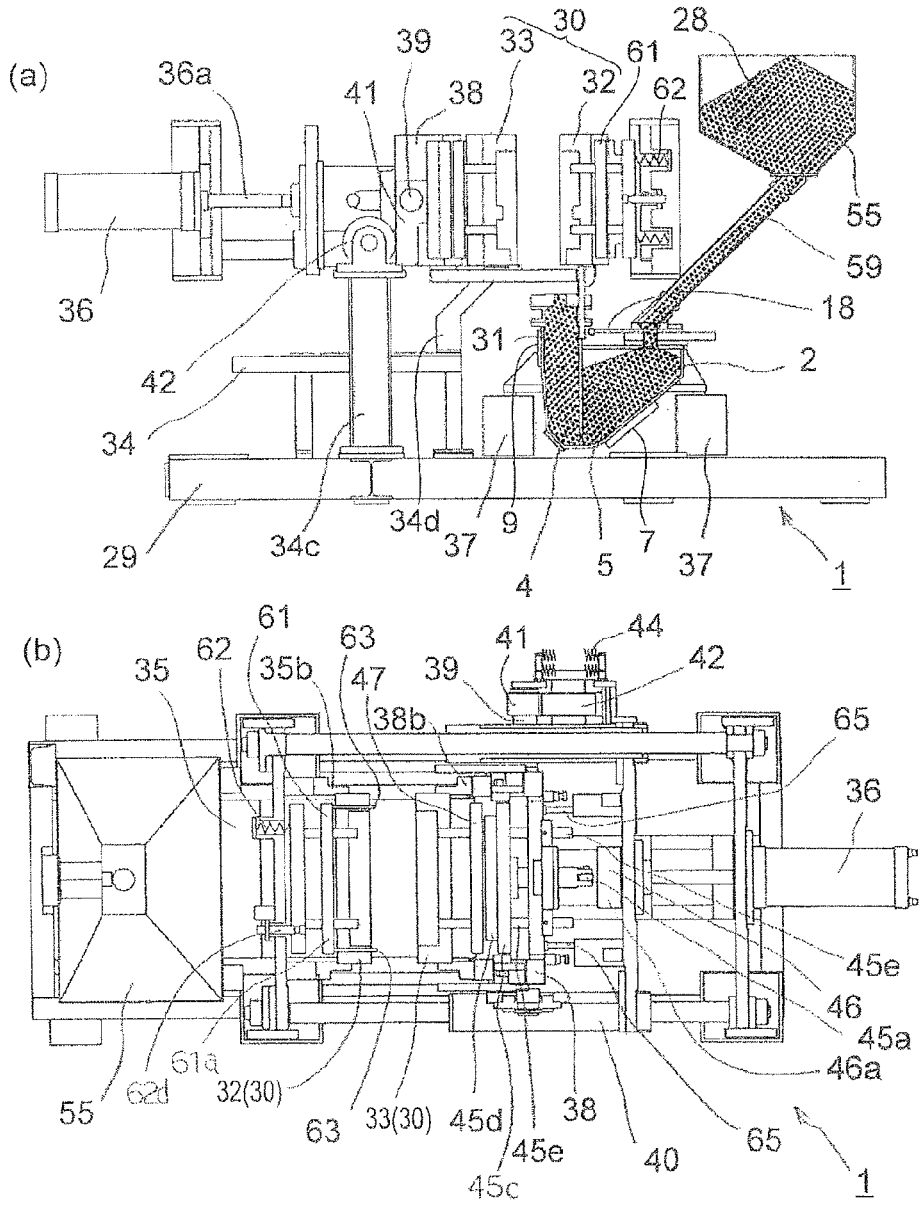
Figure 10:
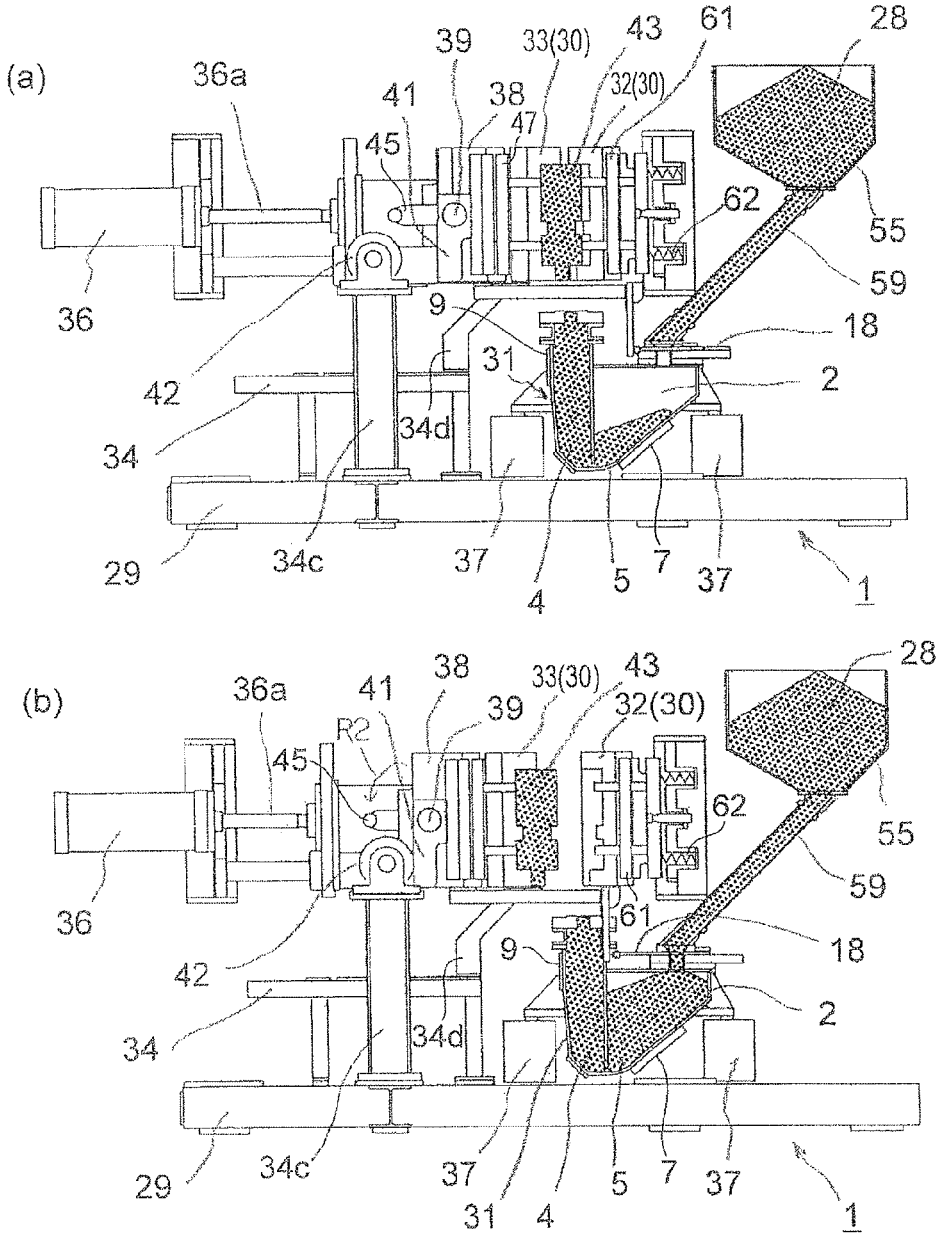
Figure 11:
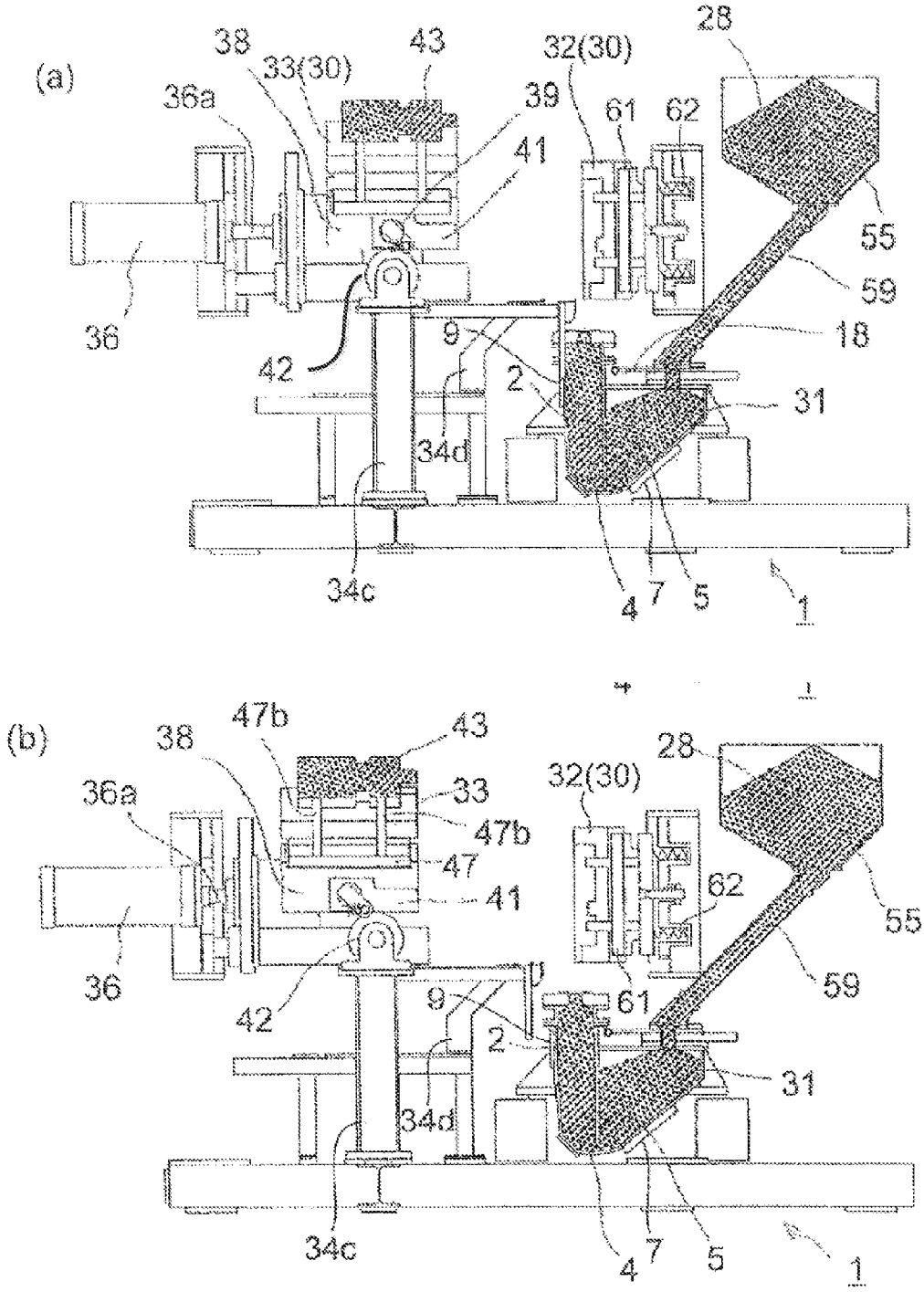
Figure 12:
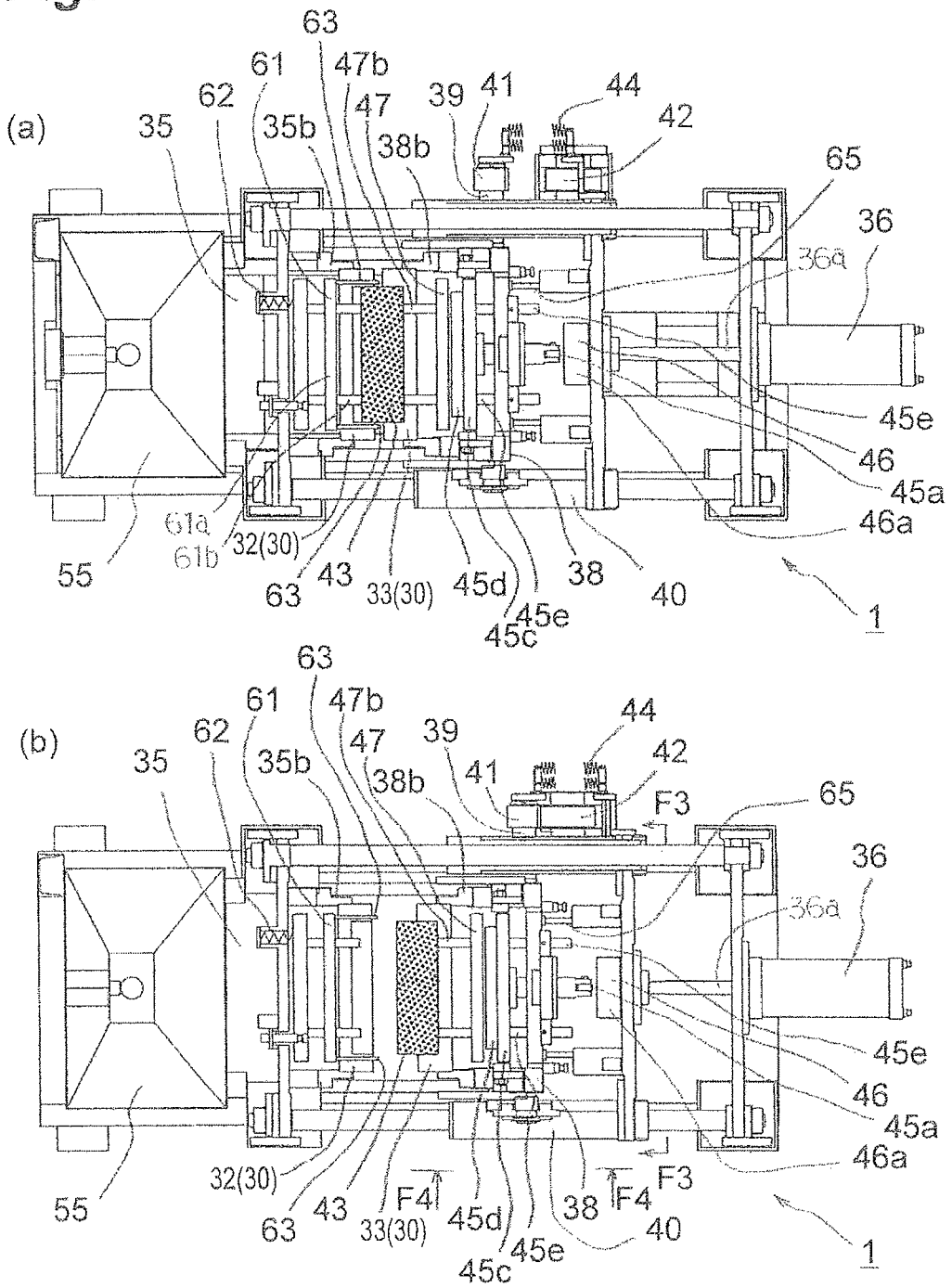
Figure 13:
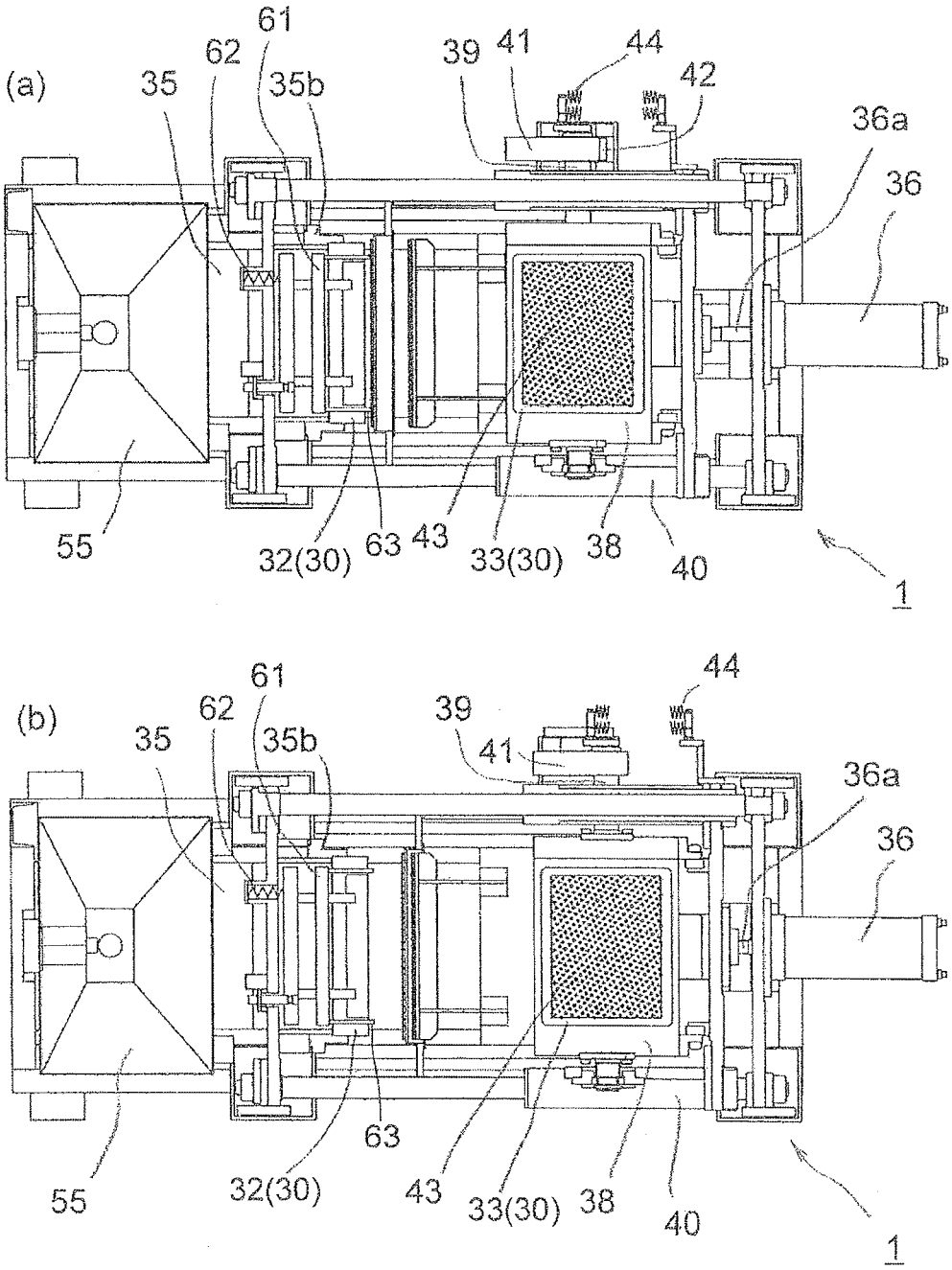
Figure 14:
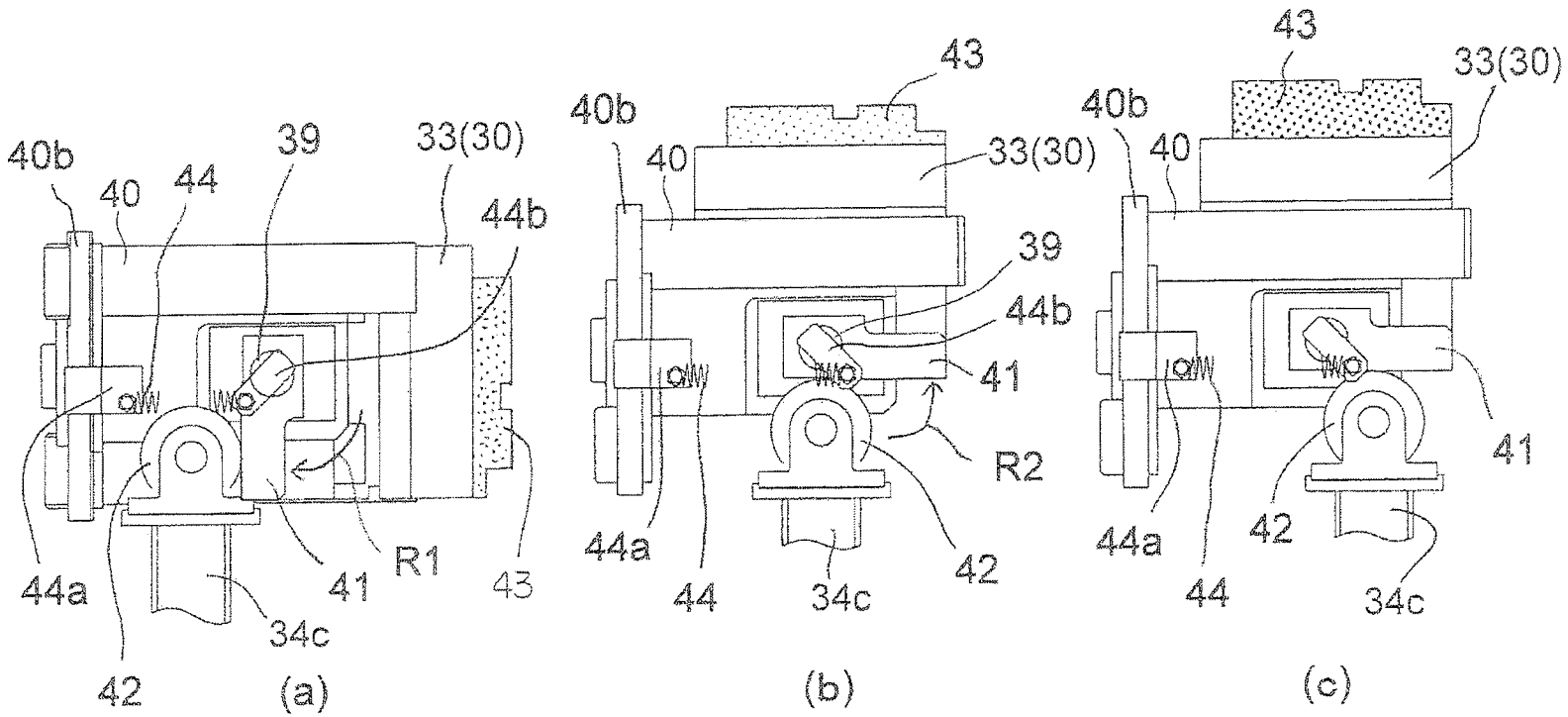
Figure 15:
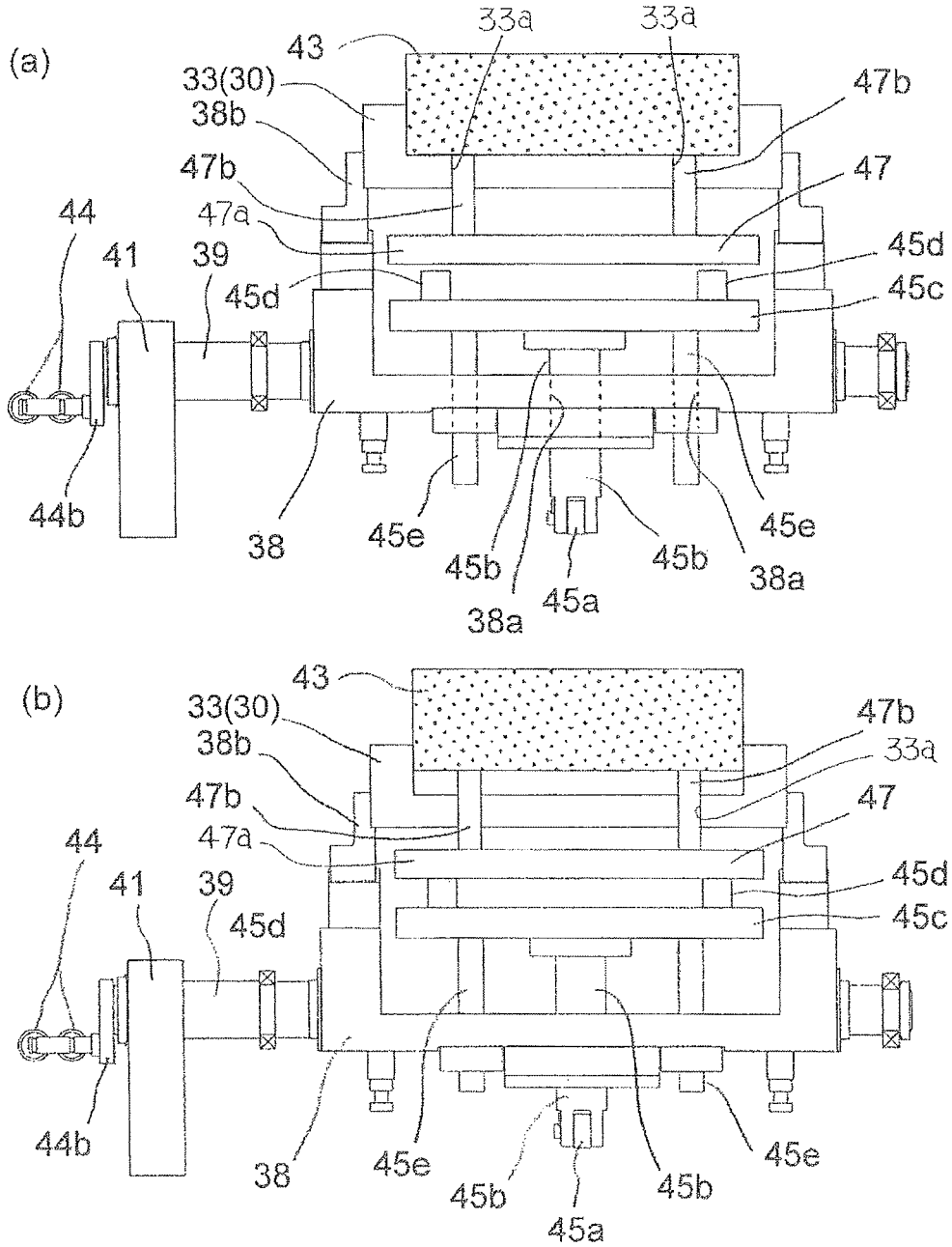
Figure 16:
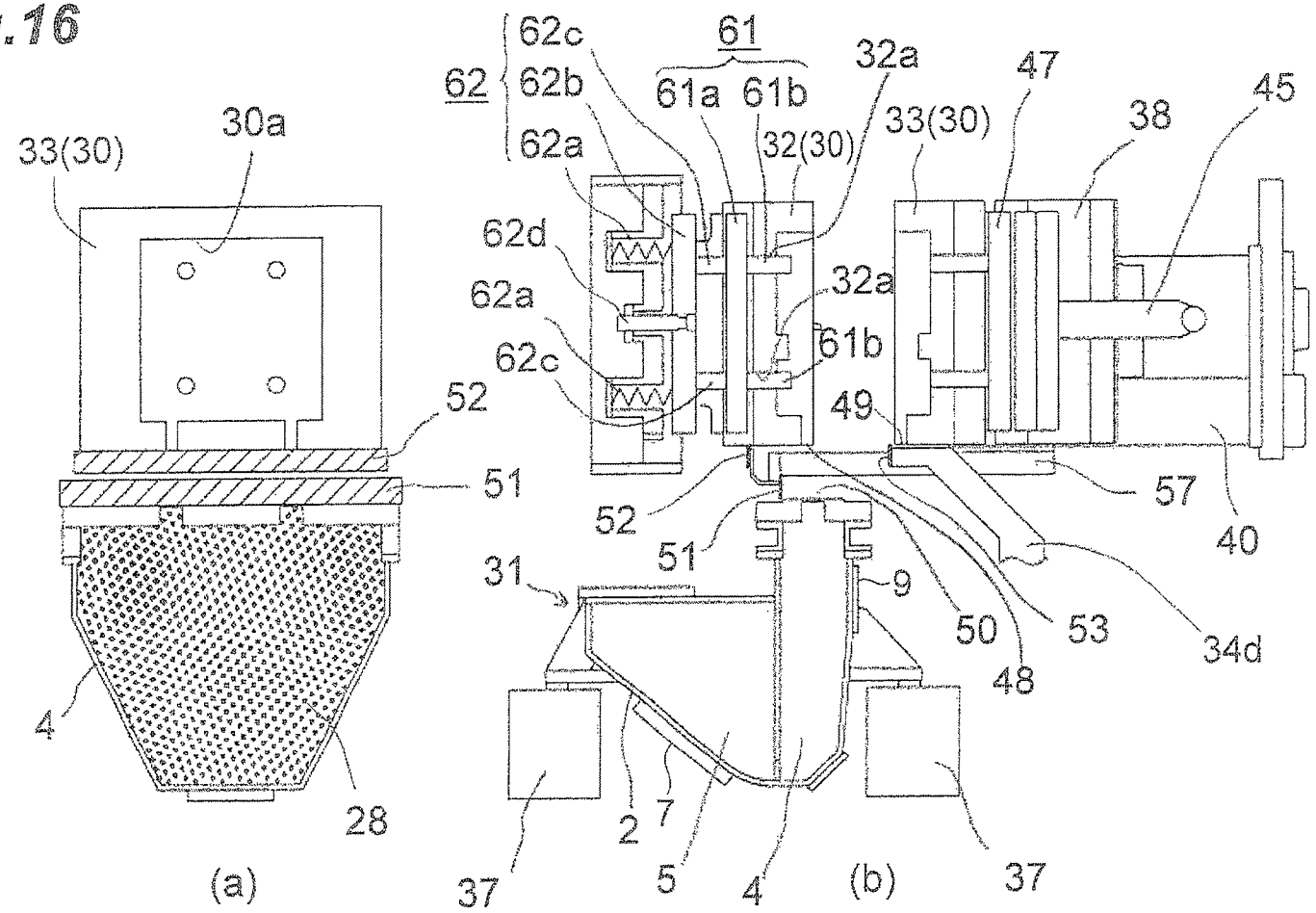
Figure 17:
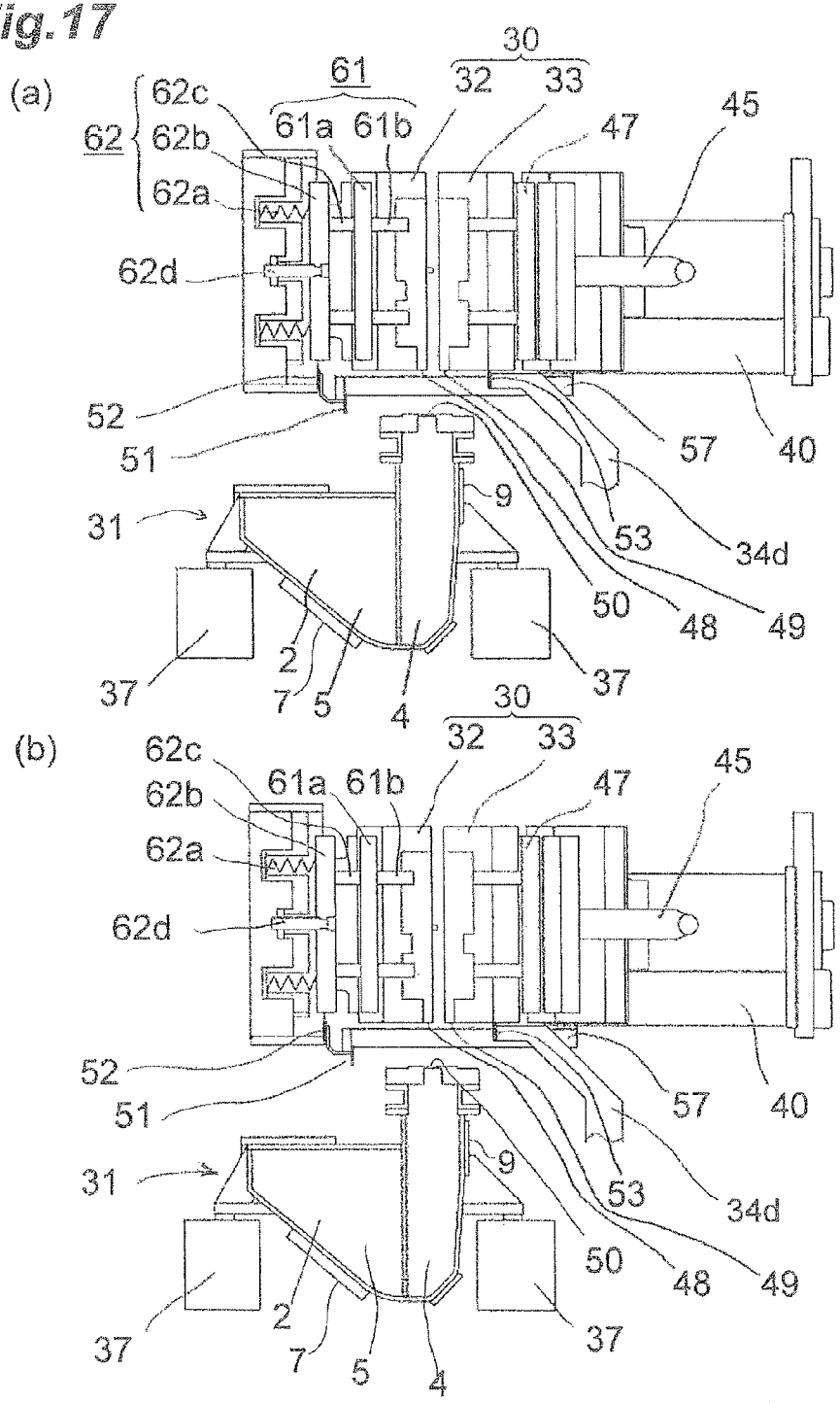
Figure 18:
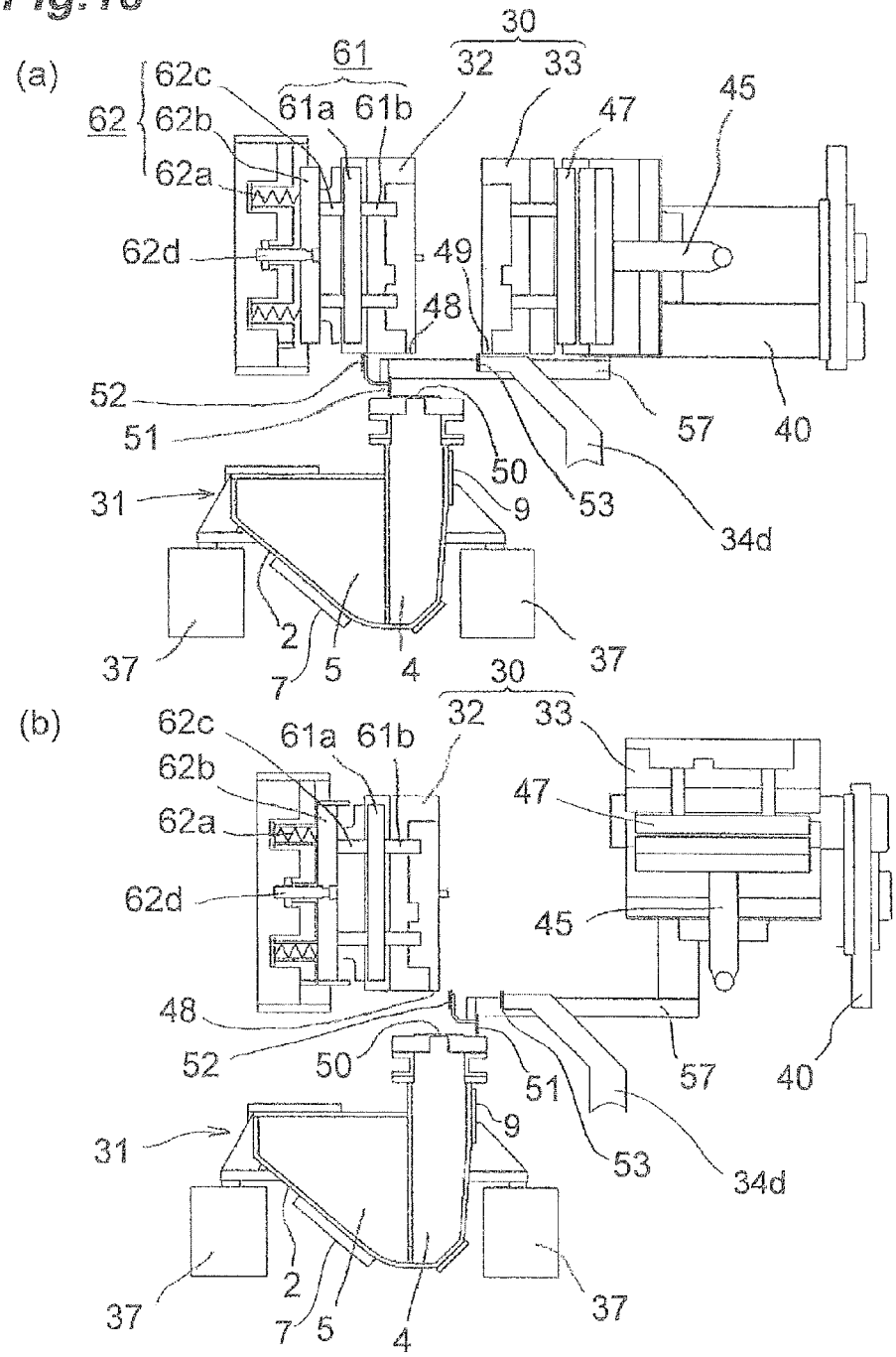
Figure 19:
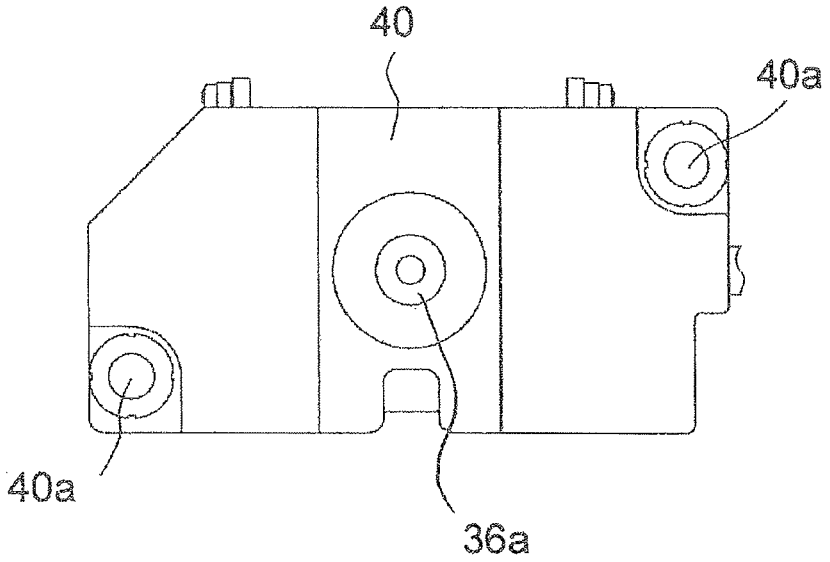
Figure 19:
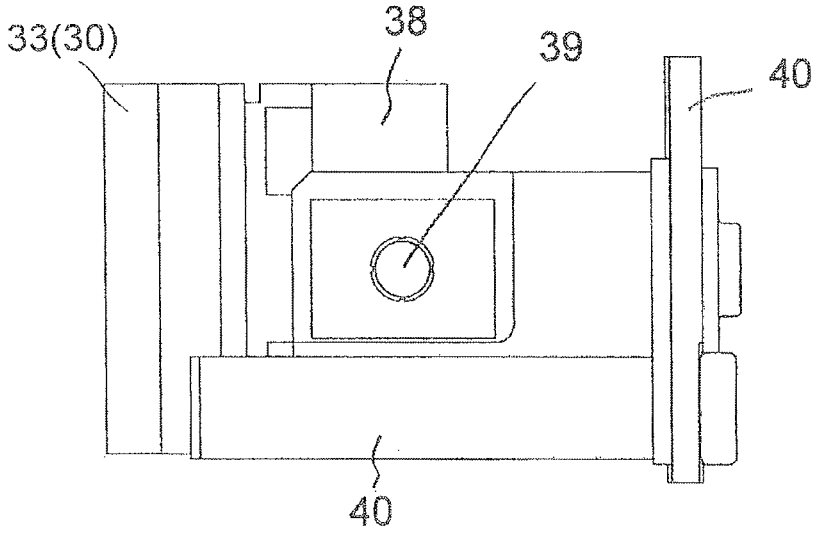
Figure 20:
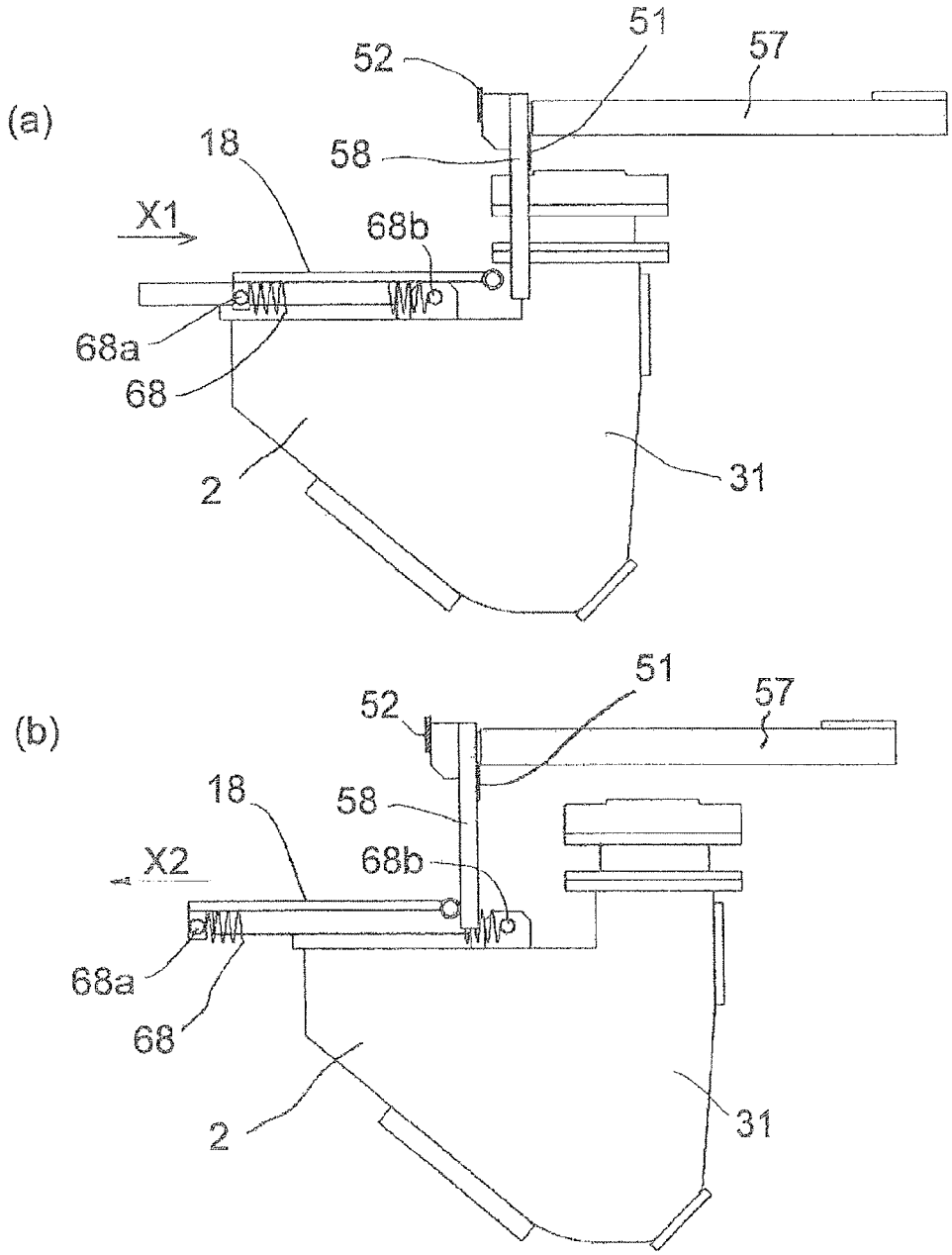
Figure 21:
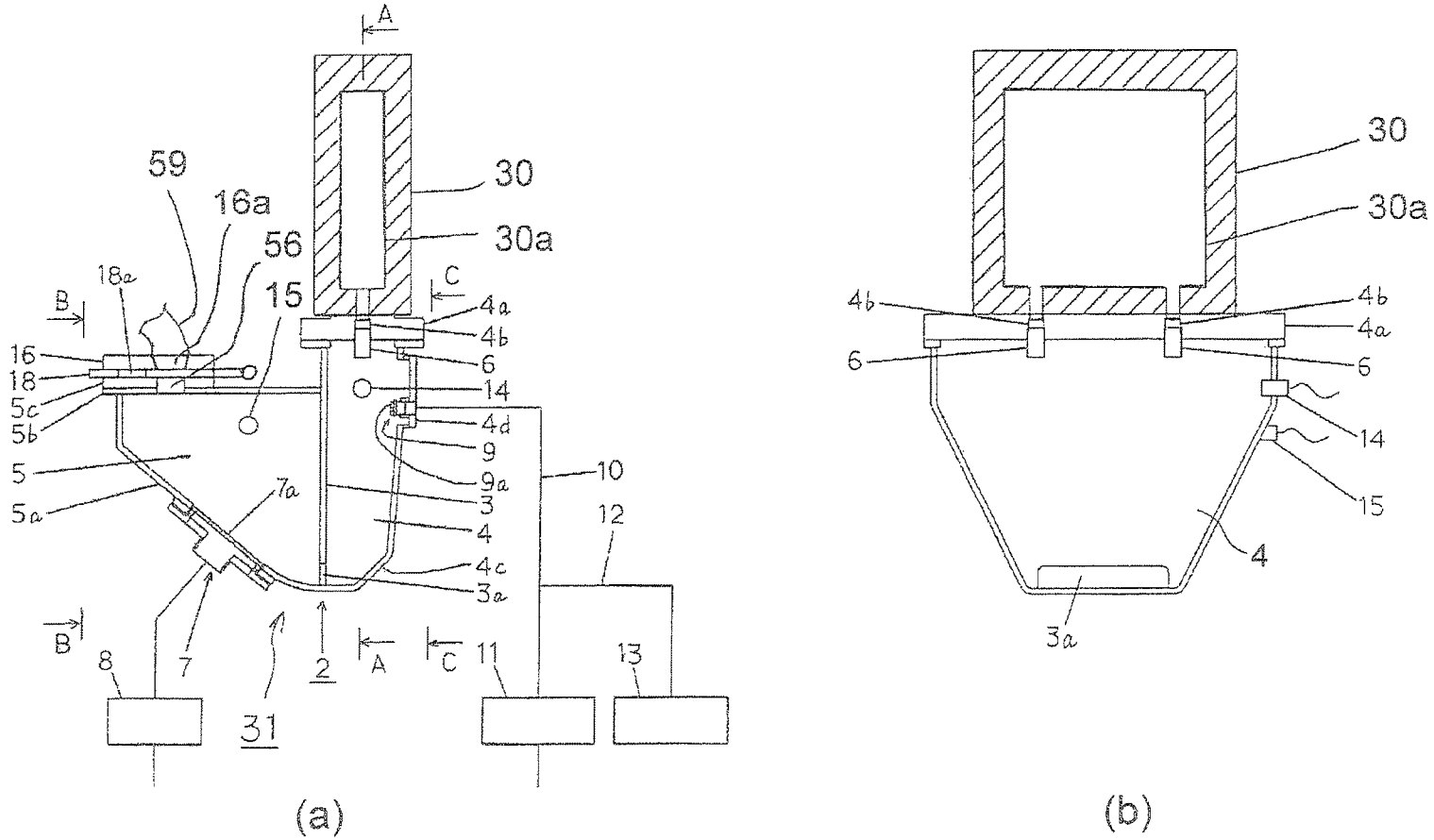
Figure 22:
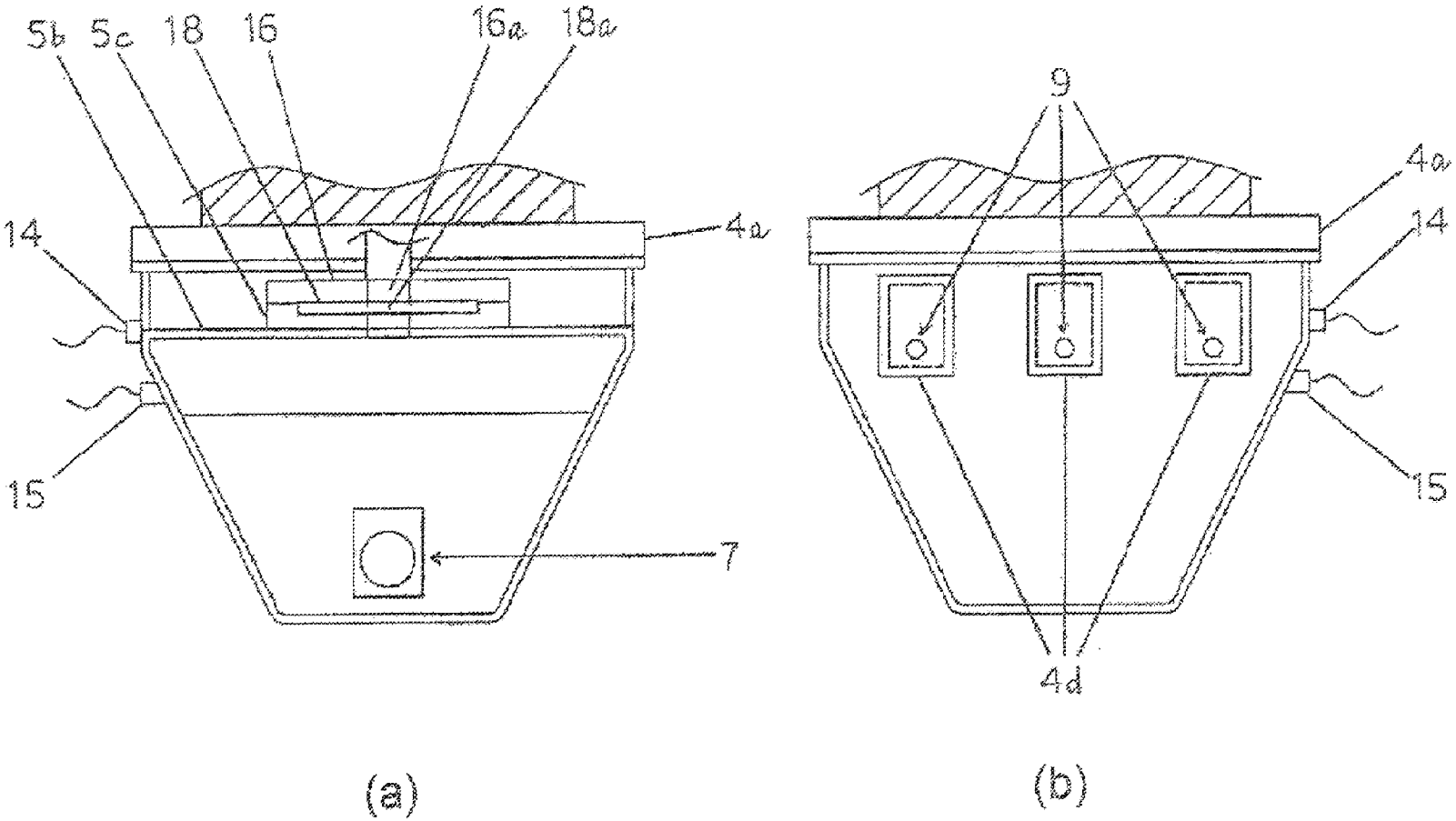
Figure 23:
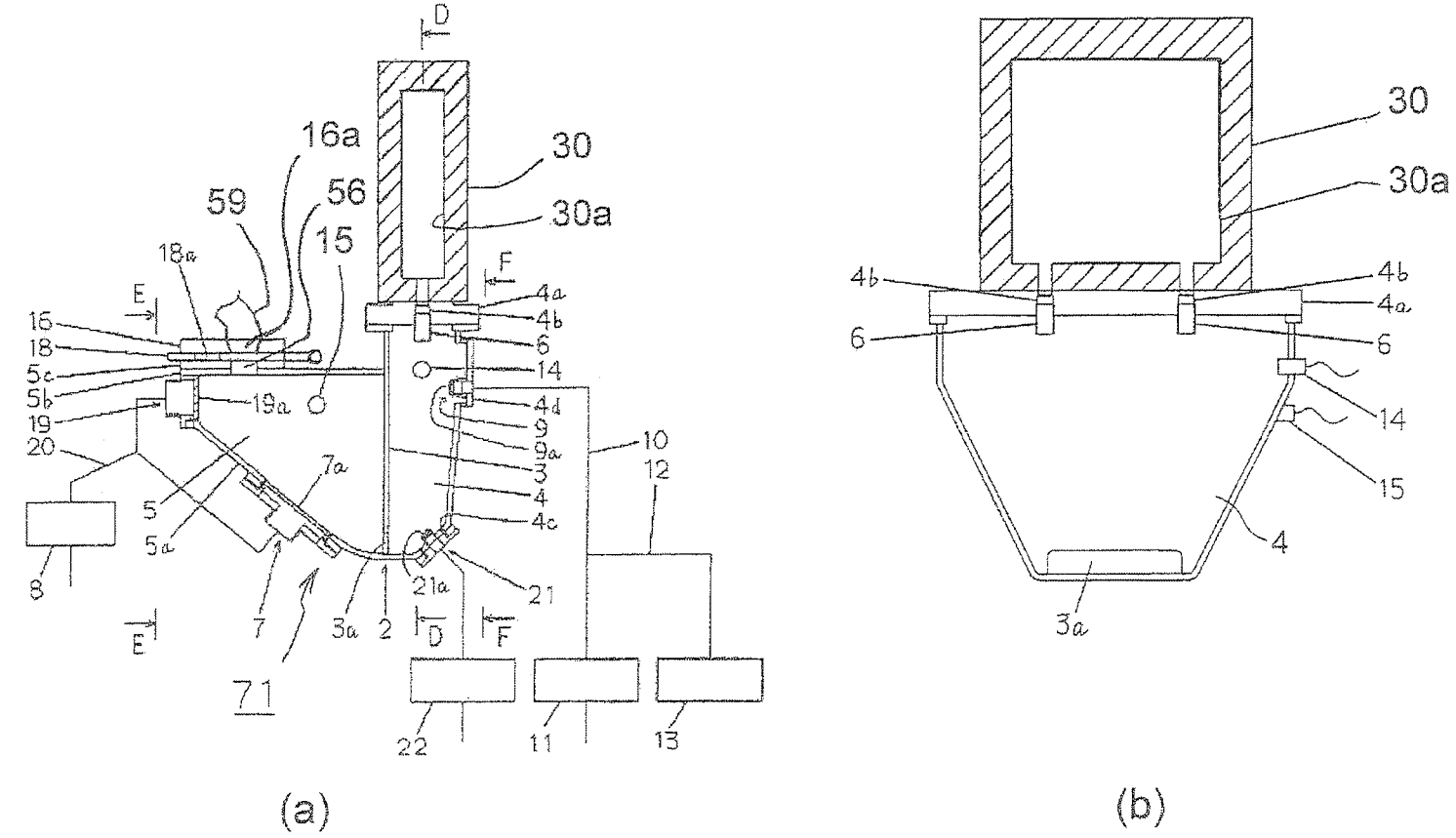
Figure 24:
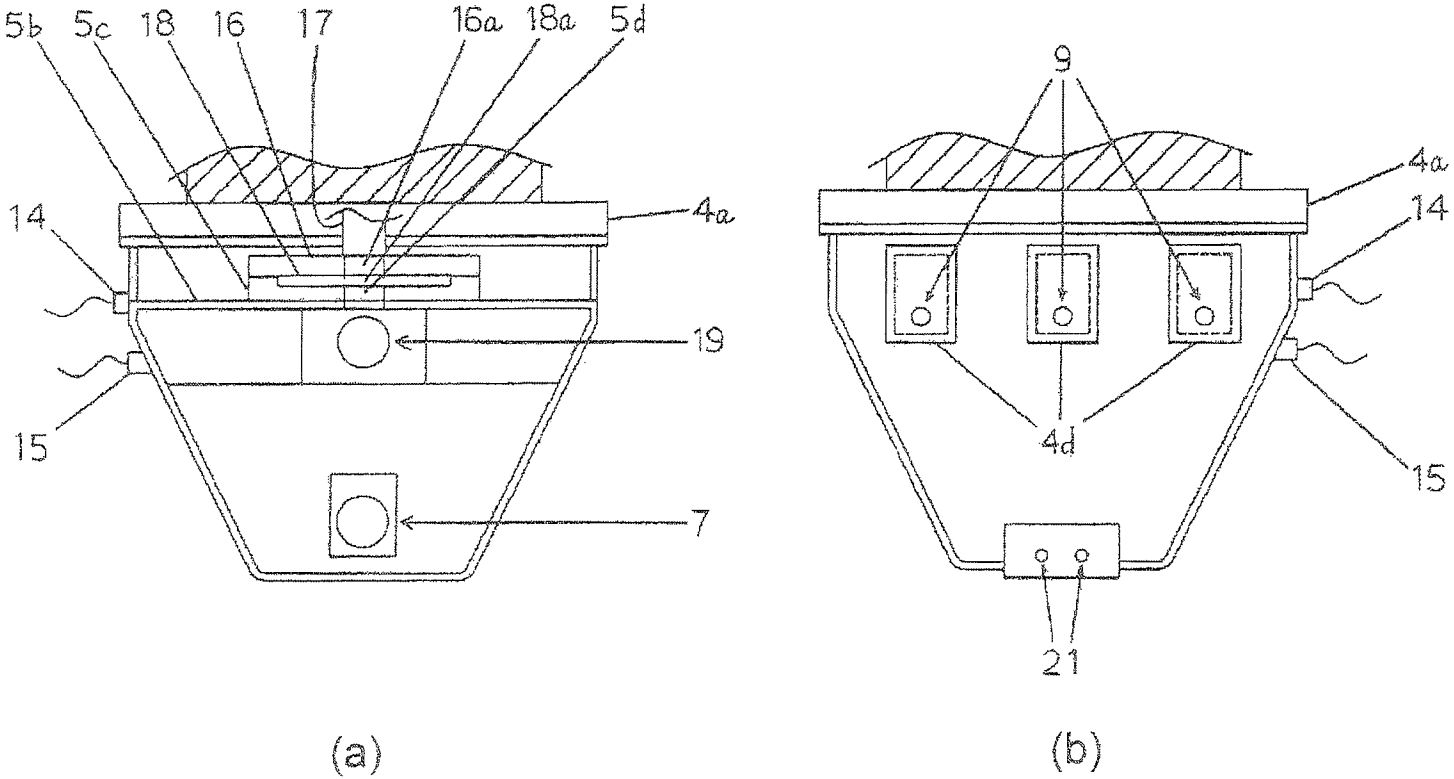
Figure 25:
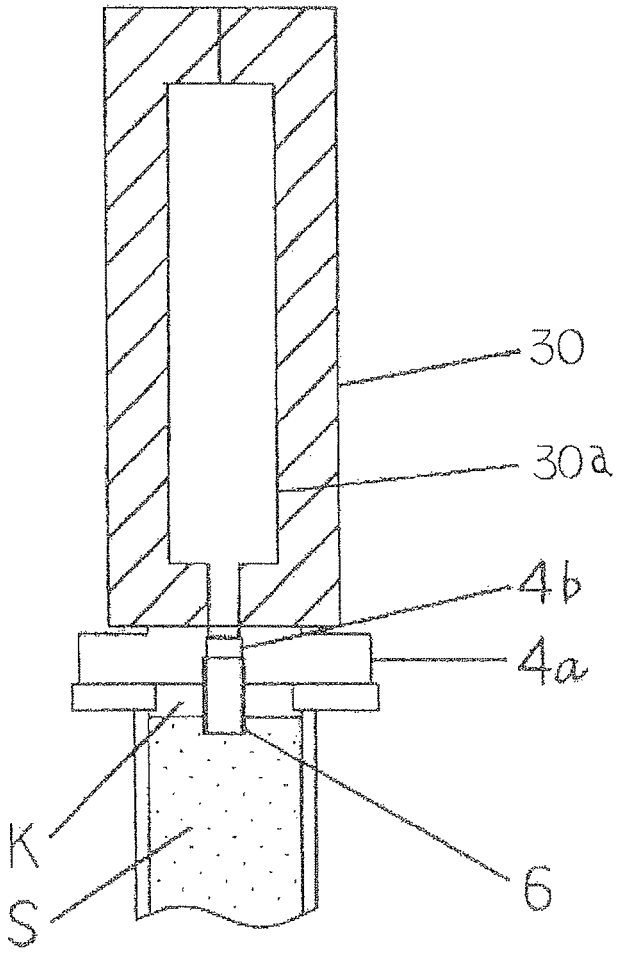
Figure 26:
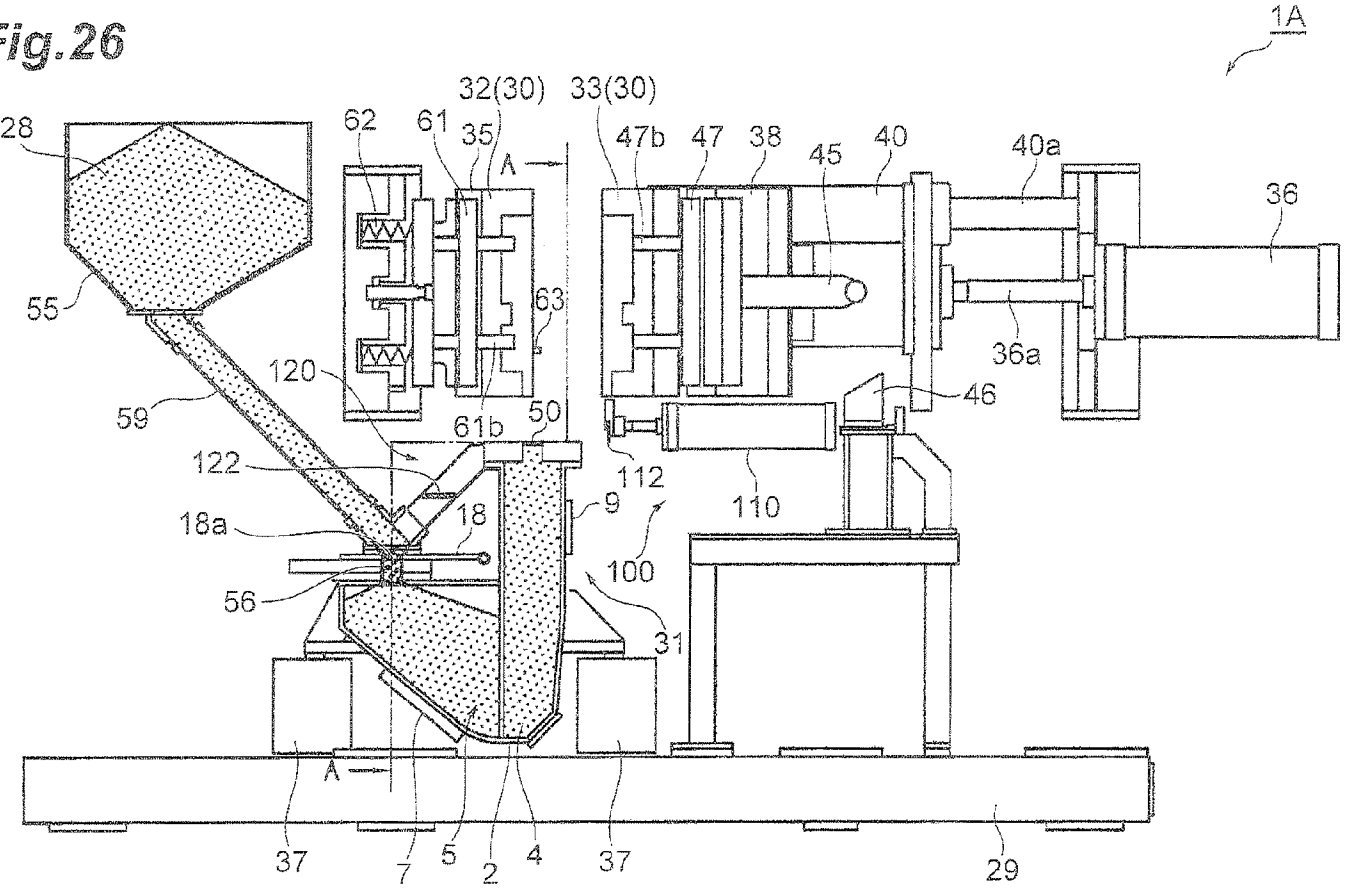
Figure 27:
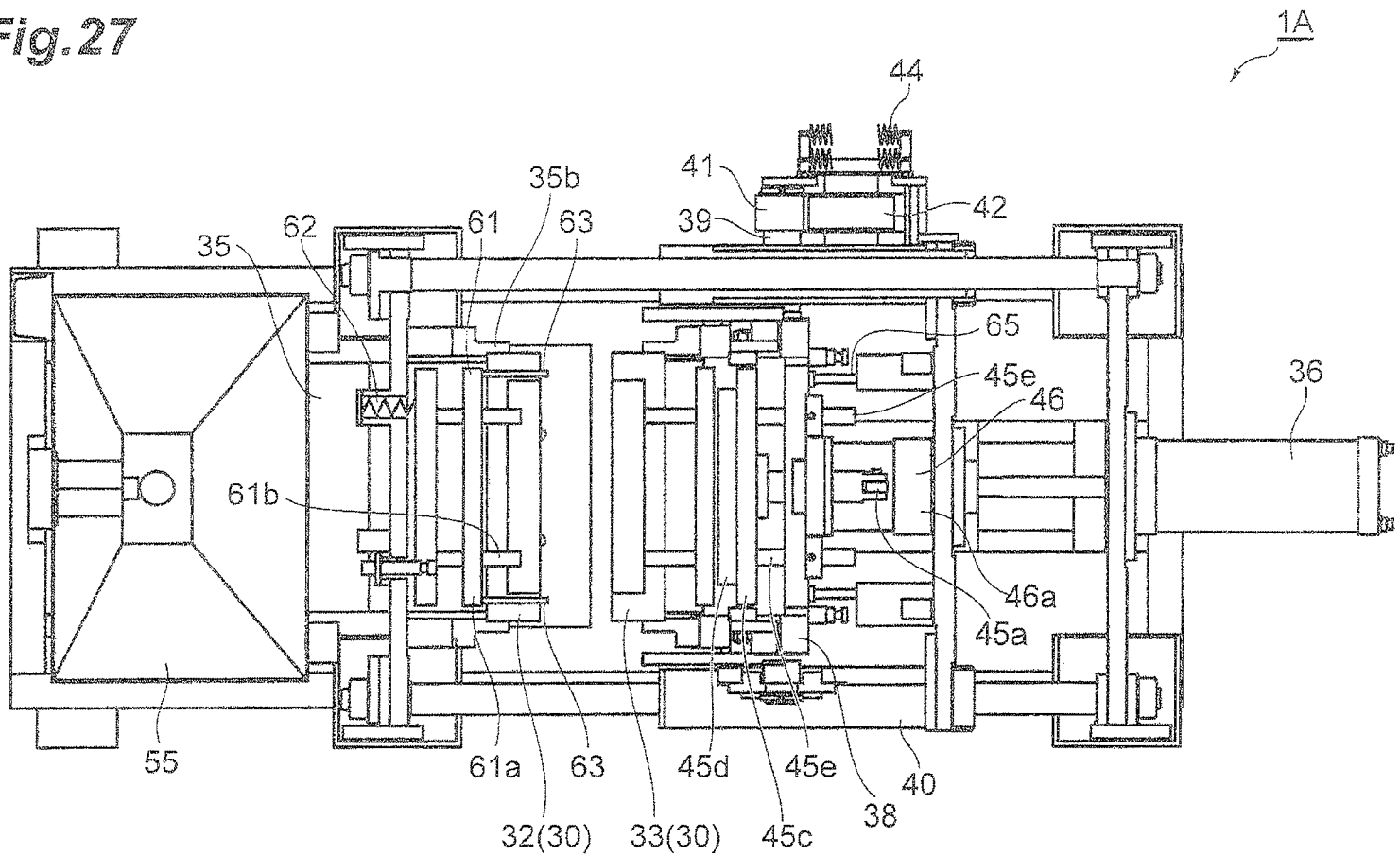
Figure 28:
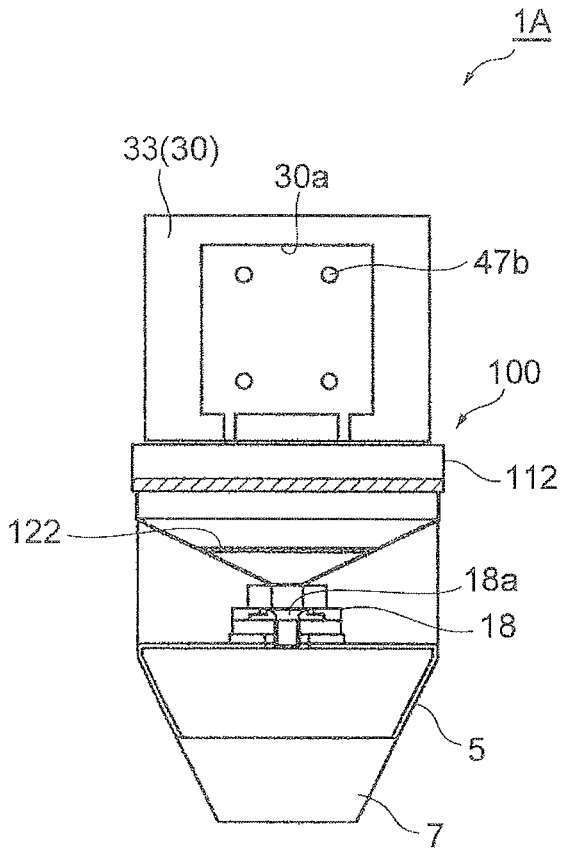
Figure 29:
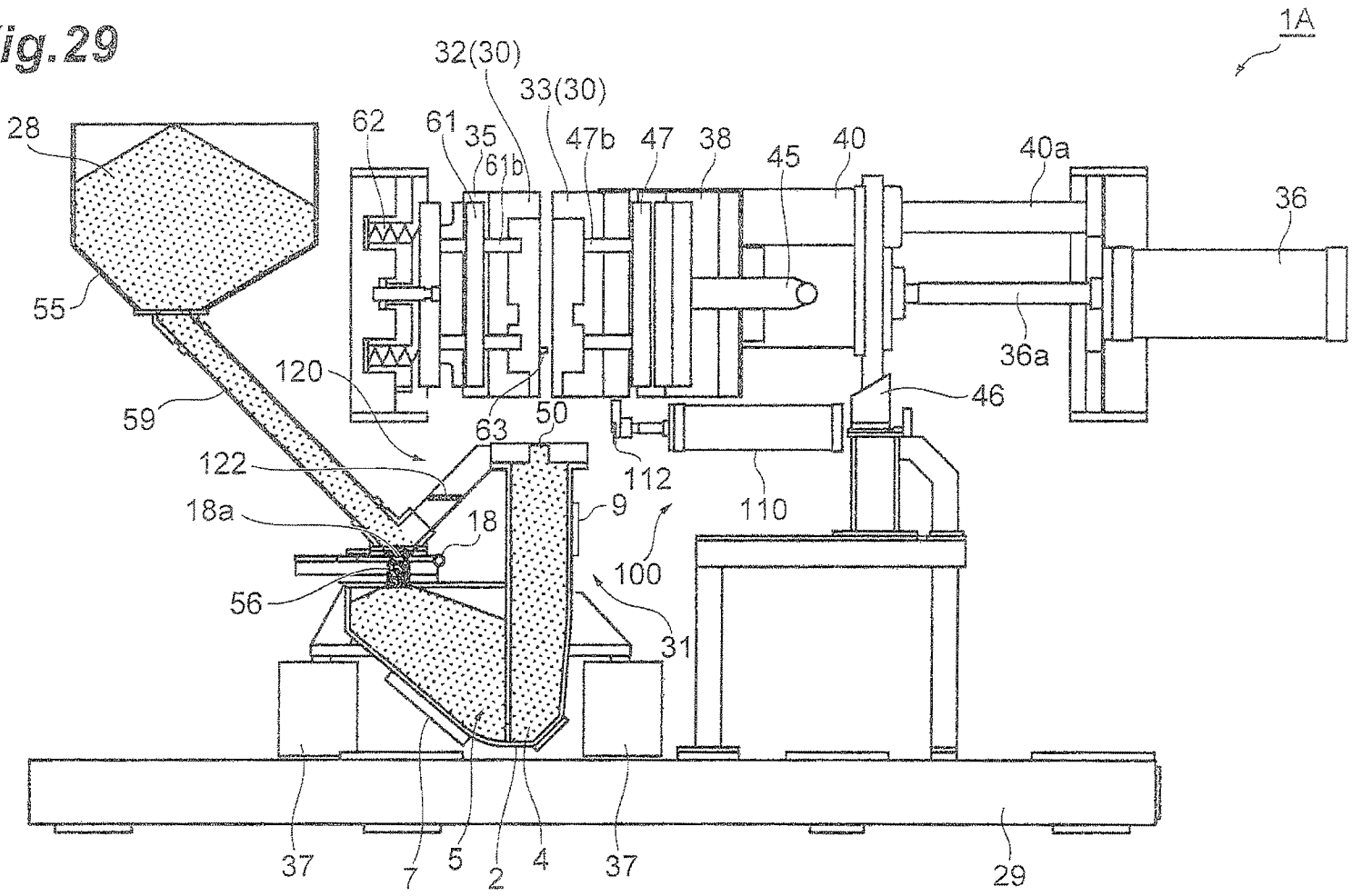
Figure 30:
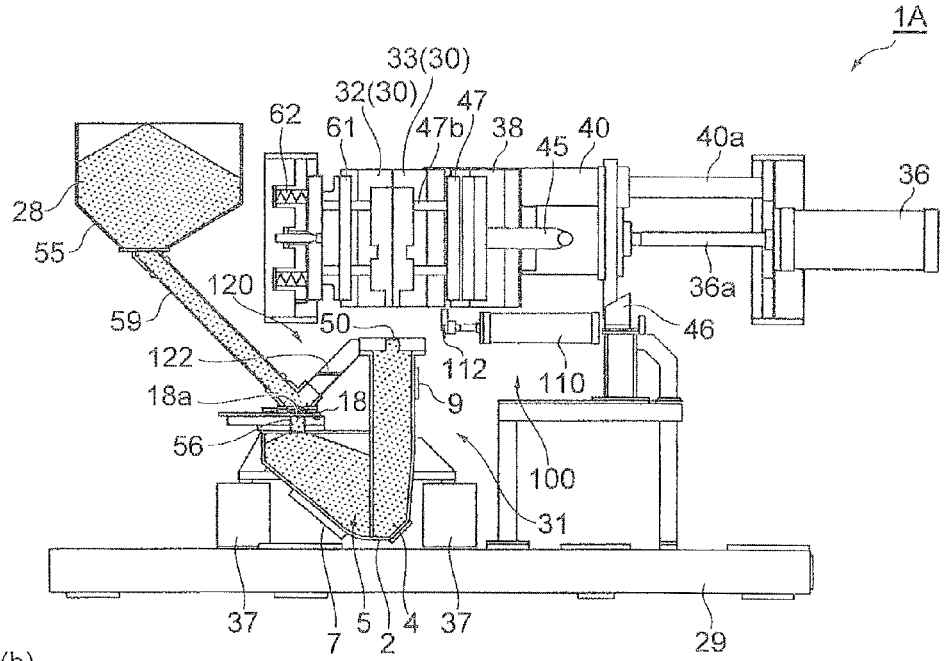
Figure 30:
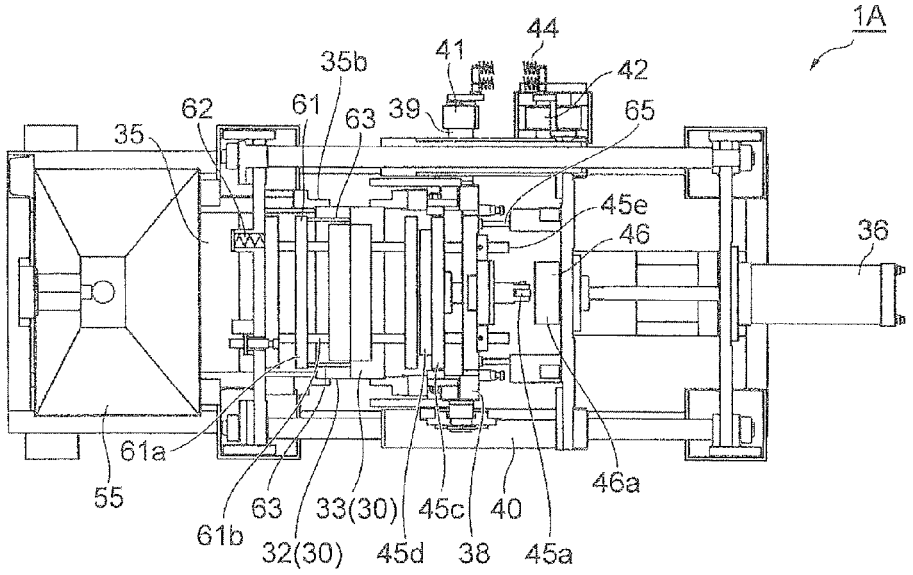
Figure 31:
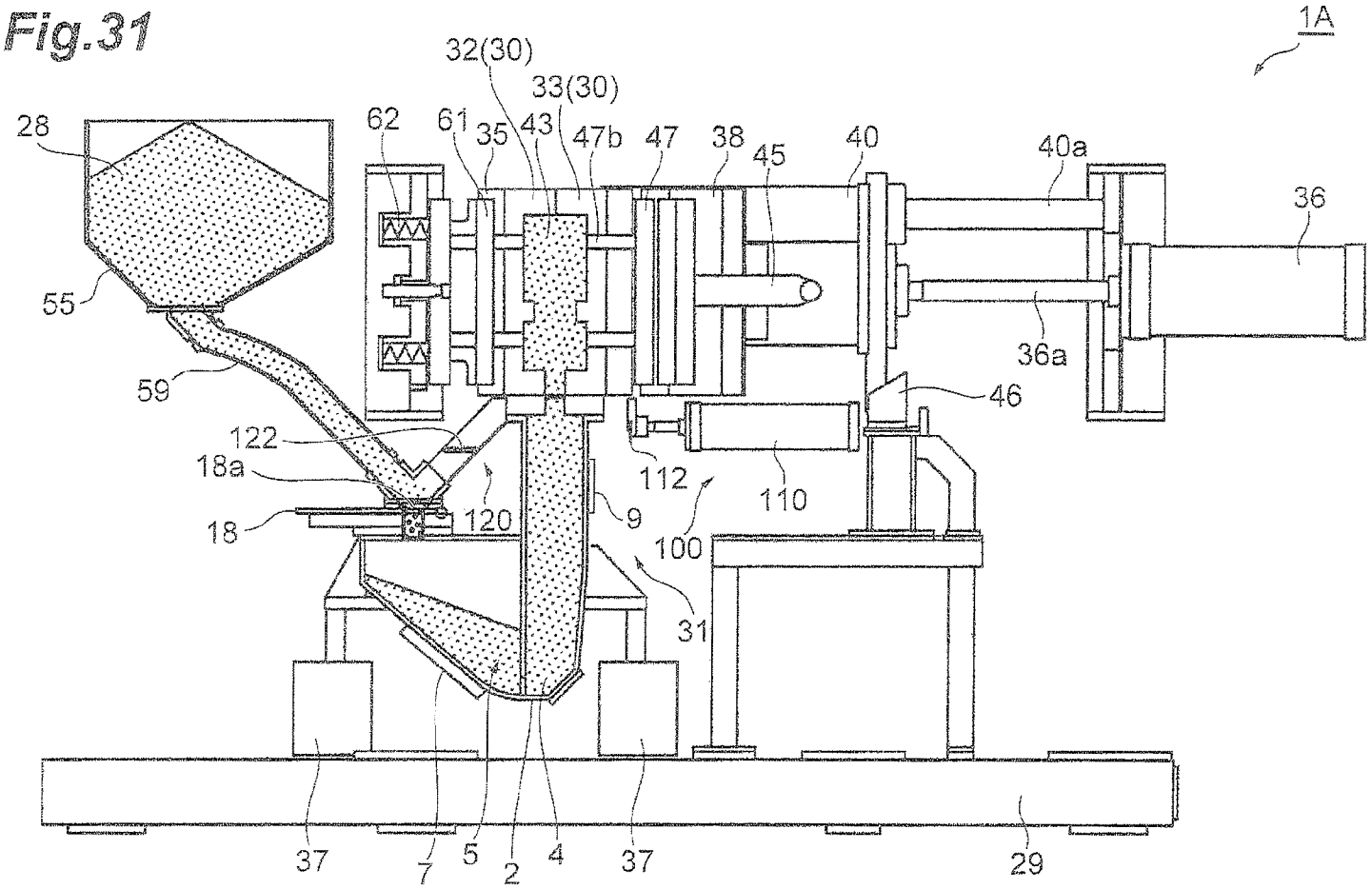
Figure 32:
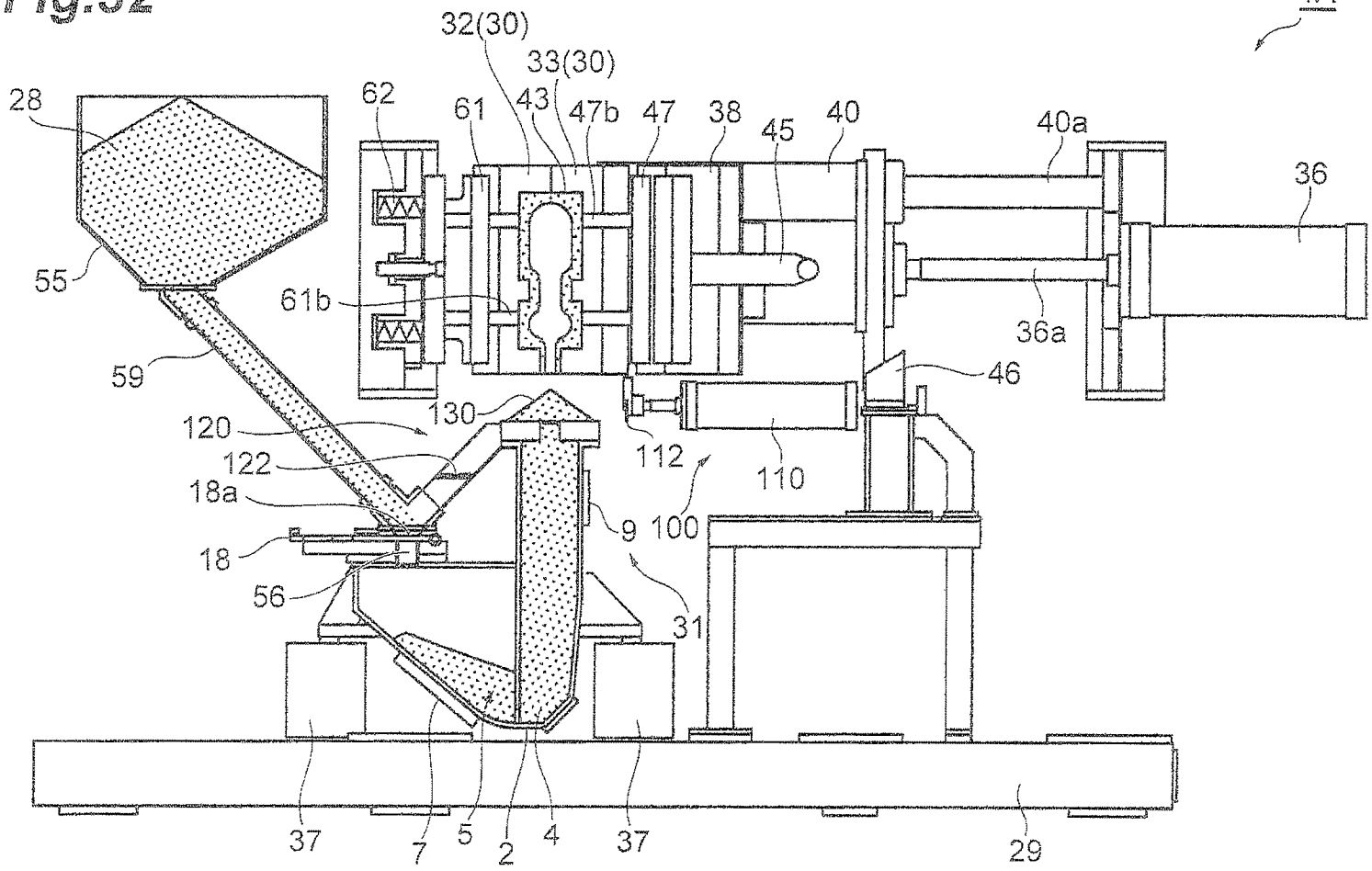
Figure 33:
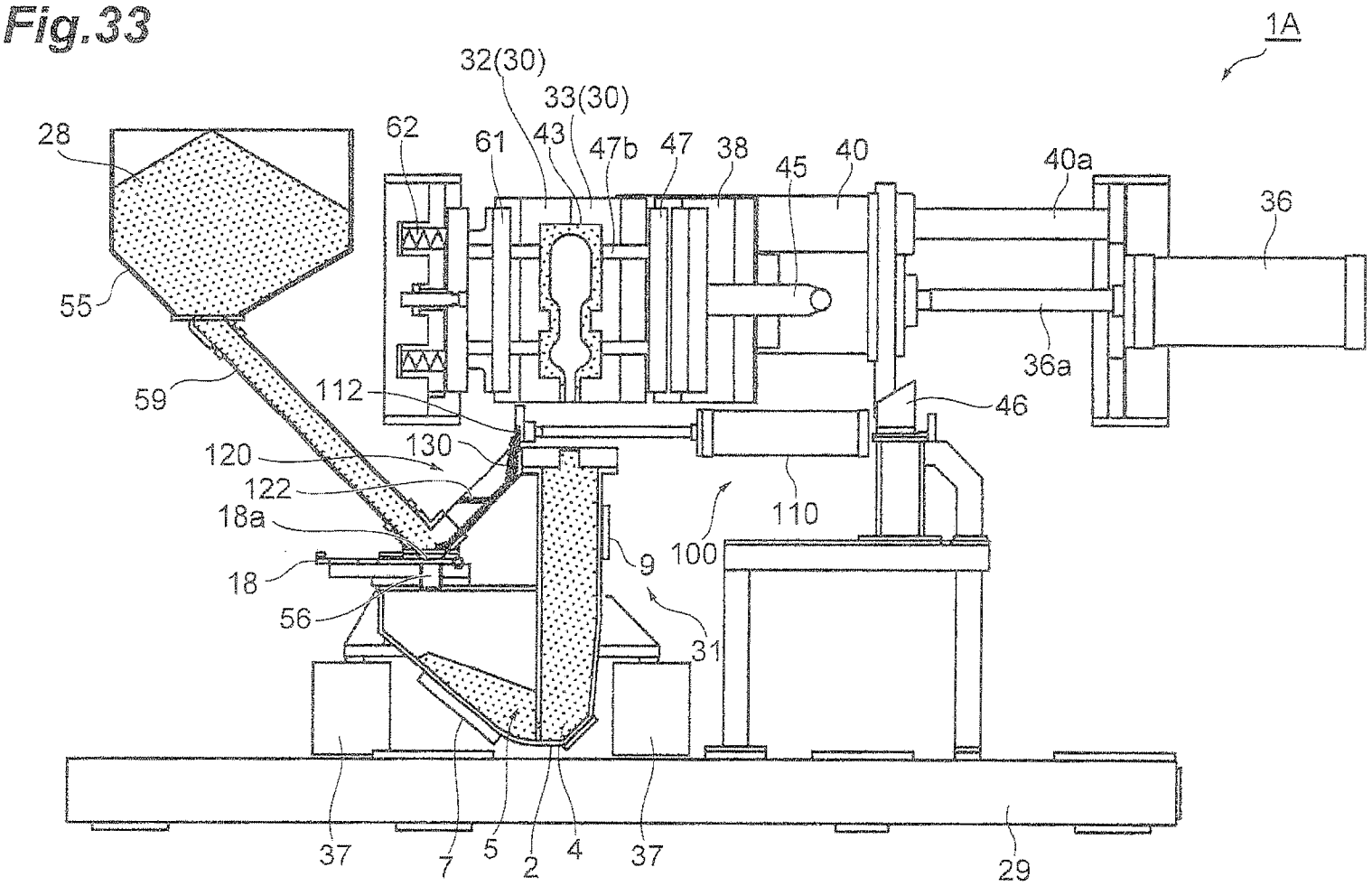
Figure 34:
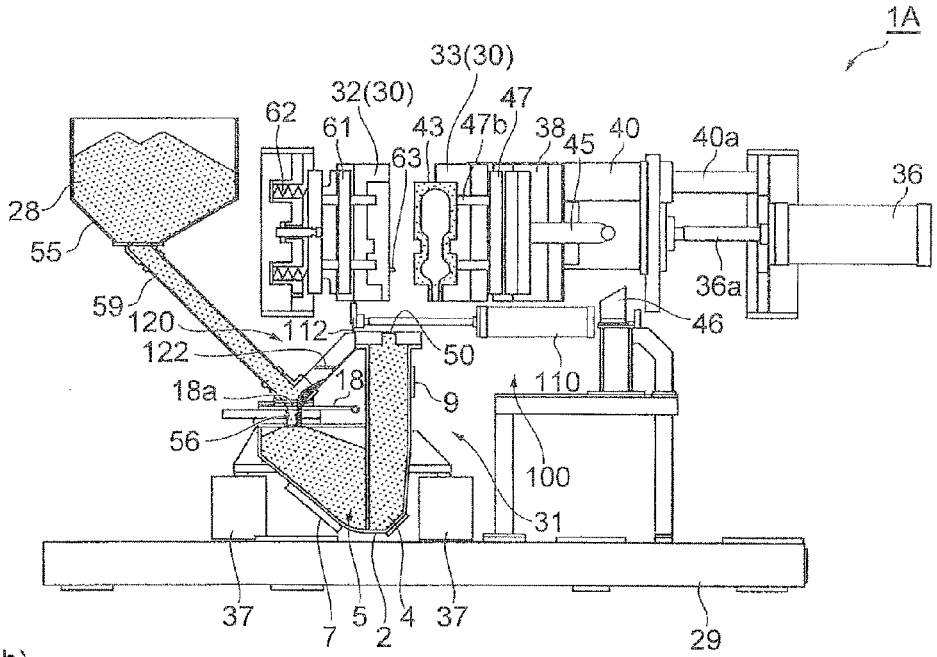
Figure 34:
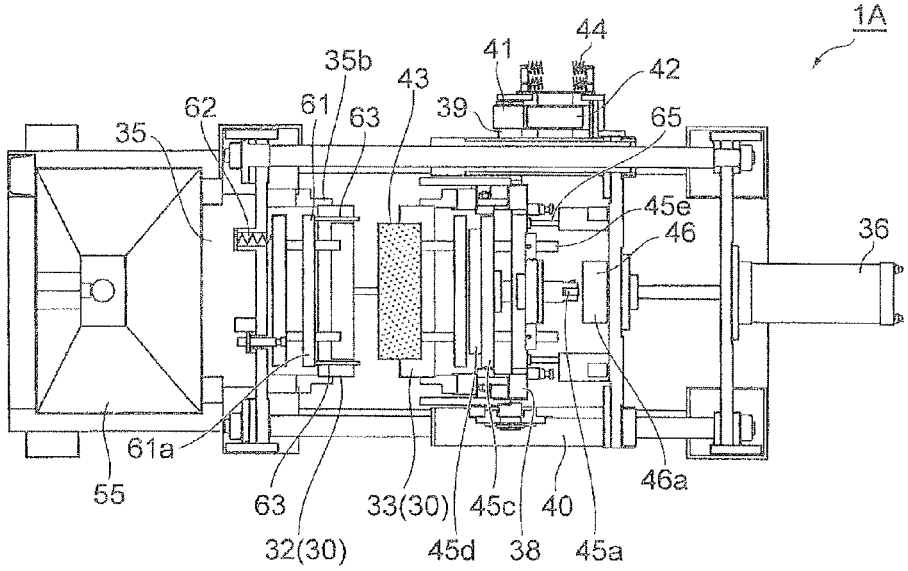
Figure 35:
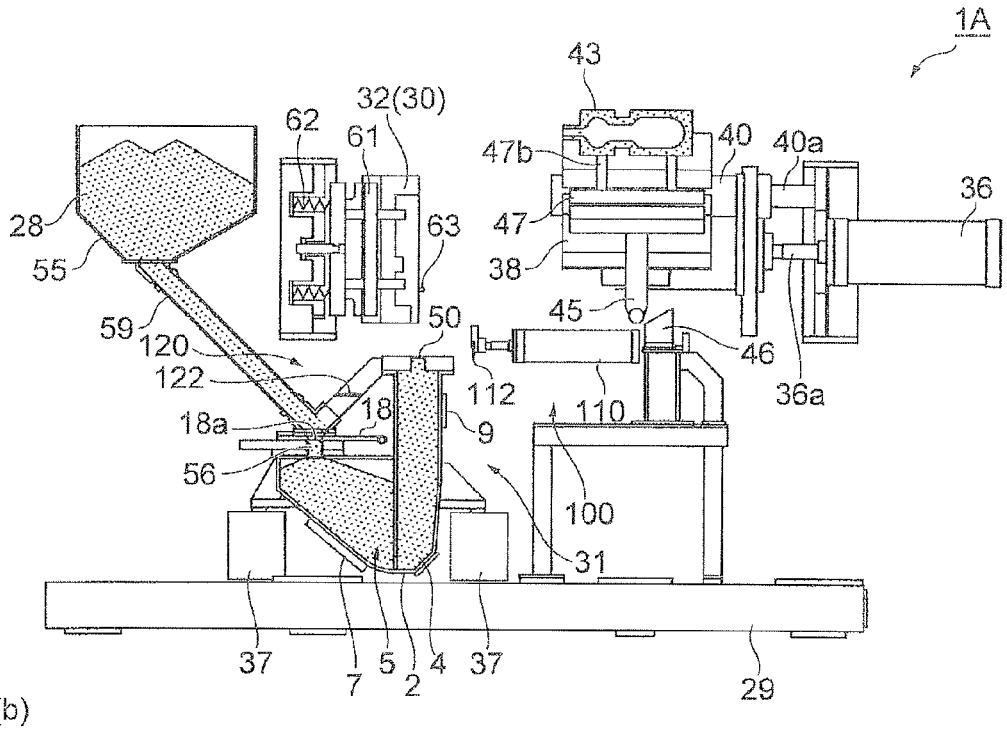
Figure 35:
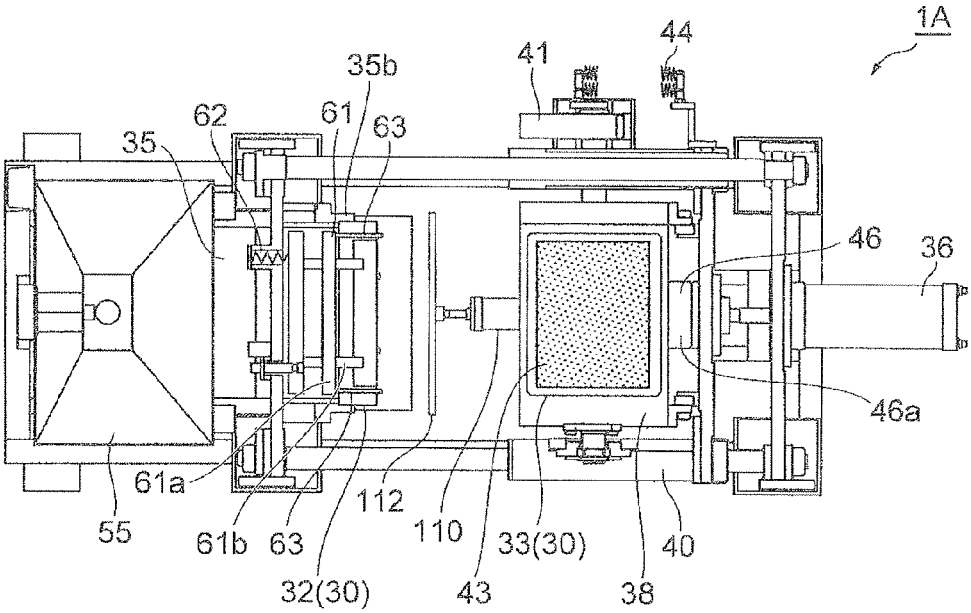
Figure 36:
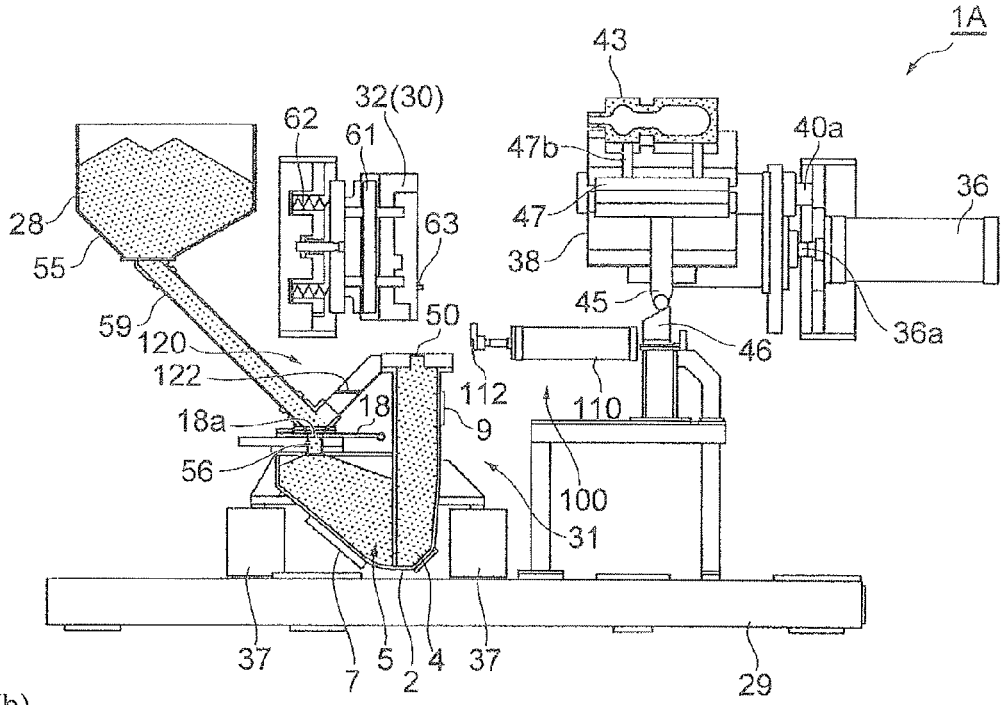
Figure 36:
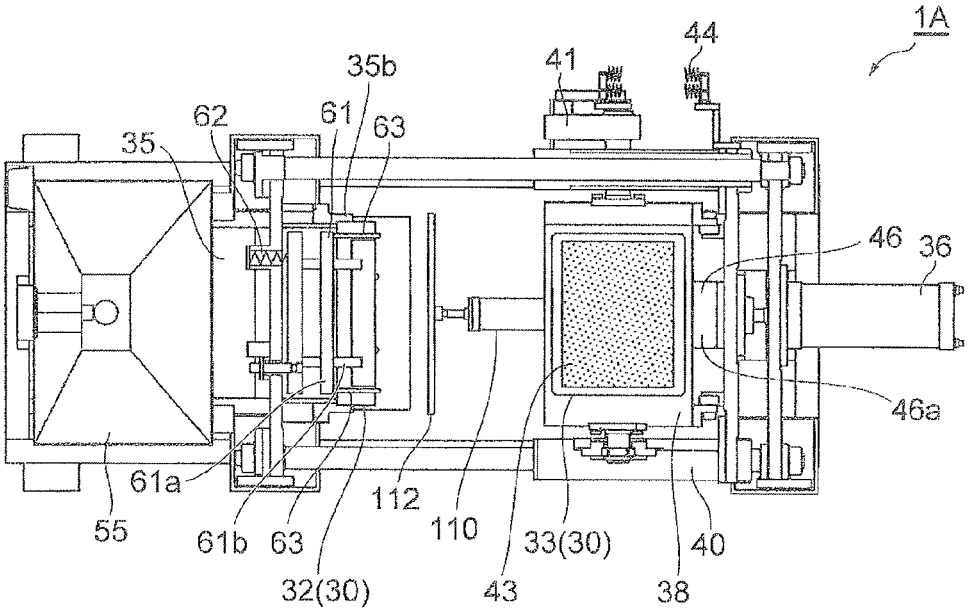

(a) and (b) of FIG. 2 are left side and front views of the core molding machine in accordance with a first embodiment, respectively;

(a) and (b) of FIG. 3 are right side and rear views of the core molding machine in accordance with the first embodiment, respectively;

FIG. 4 is a set of diagrams for explaining operations (states 1-1 to 1-10) of the core molding machine in accordance with the first embodiment, in which (a) and (b) of FIG. 4 are front sectional views of the core molding machine in accordance with the first embodiment in the states 1-1 and 1-2, respectively;

(a) and (b) of FIG. 5 are front sectional views of the core molding machine in accordance with the first embodiment in the states 1-3 and 1-4, respectively;

(a) and (b) of FIG. 6 are front sectional views of the core molding machine in accordance with the first embodiment in the states 1-5 and 1-6, respectively;

(a) and (b) of FIG. 7 are front sectional views of the core molding machine in accordance with the first embodiment in the states 1-7 and 1-8, respectively;

(a) and (b) of FIG. 8 are front sectional views of the core molding machine in accordance with the first embodiment in the 1-9 and 1-10 states, respectively;

FIG. 9 is a set of diagrams for explaining relationships among individual constituents of the core molding machine in the state 1-1 illustrated in (a) of FIG. 4, in which (a) and (b) of FIG. 9 are schematic rear and plan views illustrating relationships among individual constituents of the core molding machine in the state 1-1, respectively;

(a) and (b) of FIG. 10 are schematic rear views illustrating relationships among individual constituents of the core molding machine in the states 1-6 and 1-7 depicted in (b) of FIG. 6 and (a) of FIG. 7, respectively;

(a) and (b) of FIG. 11 are schematic rear views illustrating relationships among individual constituents of the core molding machine in the states 1-8 and 1-9 depicted in (b) of FIG. 7 and (a) of FIG. 8, respectively;

(a) and (b) of FIG. 12 are schematic plan views illustrating relationships among individual constituents of the core molding machine in the states 1-6 and 1-7 depicted in (b) of FIG. 6 and (a) of FIG. 7, respectively;

(a) and (b) of FIG. 13 are schematic plan views illustrating relationships among individual constituents of the core molding machine in the states 1-8 and 1-9 depicted in (b) of FIG. 7 and (a) of FIG. 8, respectively;

FIG. 14 is a set of diagrams illustrating vicinities of a spring member for applying a biasing force to a movable die constituting the core molding machine, in which (a), (b) and (c) of FIG. 14 are schematic views of vicinities of the spring member in the states 1-7, 1-8, and 1-9, respectively;

FIG. 15 is a set of diagrams for explaining a movable die holding member and a slide member which constitute the core molding machine in accordance with the first embodiment, in which (a) and (b) of FIG. 15 are views as seen in directions of arrows F1-F1 and F2-F2 in (b) of FIG. 7 and (a) of FIG. 8, respectively;

FIG. 16 is a set of diagrams for explaining first to third cleaning units constituting the core molding machine in accordance with the first embodiment, in which (a) and (b) of FIG. 16 are schematic left side and front sectional views of main parts of the core molding machine in accordance with the first embodiment in the state 1-1 for illustrating the relationship between the first to third cleaning units and nozzles cleaned thereby and the positional relationship among the first to third cleaning units, respectively;

(a) and (b) of FIG. 17 are schematic front sectional views of main parts illustrating positional relationships among the first to third cleaning units in the states 1-2 and 1-6, respectively;

(a) and (b) of FIG. 18 are schematic front sectional views of main parts illustrating positional relationships among the first to third cleaning units in the states 1-7 and 1-8, respectively;

FIG. 19 is a set of diagrams for explaining a movable frame constituting the core molding machine in accordance with the first embodiment, in which (a) and (b) of FIG. 19 are views of the movable frame as seen in directions of arrows F3-F3 and F4-F4 in (b) of FIG. 12, respectively;

FIG. 20 is a set of diagrams for explaining relationships among an on/off gate constituting the core molding machine in accordance with the first embodiment, a biasing member for biasing the same, and a push member for operating the on/off gate, in which (a) and (b) of FIG. 20 are relation diagrams in the states 1-1 and 1-2, respectively;

(a) of FIG. 21 is a front sectional view of a sand filling device constituting the core molding machine in accordance with the first embodiment, while (b) of FIG. 21 is a view as seen in the direction of arrows A-A in (a) of FIG. 21;

(a) of FIG. 22 is a view as seen in the direction of arrows B-B in (a) of FIG. 21, while (b) of FIG. 22 is a view as seen in the direction of arrows C-C in (a) of FIG. 21;

(a) of FIG. 23 is a front sectional view of another example of the sand filling device, while (b) of FIG. 23 is a view as seen in the direction of arrows D-D in (a) of FIG. 23;

(a) and (b) of FIG. 24 are views as seen in directions of arrows E-E and F-F in (a) of FIG. 23, respectively;

FIG. 25 is a partial front sectional view illustrating a state where an air layer is produced between an upper face of core sand and a lower end of a plate in a sand blow chamber constituting the sand filling devices of FIGS. 21 and 23;

FIG. 26 is a front sectional view of the core molding machine in accordance with a second embodiment in state 2-1;

FIG. 27 is a plan view of the core molding machine in accordance with the second embodiment in the state 2-1;

FIG. 28 is a view as seen in the direction of arrows A-A in FIG. 26;

FIG. 29 is a front sectional view of the core molding machine in accordance with the second embodiment in state 2-2;

(a) and (b) of FIG. 30 are front sectional and plan views of the core molding machine in accordance with the second embodiment in state 2-3, respectively;

FIG. 31 is a front sectional view of the core molding machine in accordance with the second embodiment in state 2-4;

FIG. 32 is a front sectional view of the core molding machine in accordance with the second embodiment in state 2-5;

FIG. 33 is a front sectional view of the core molding machine in accordance with the second embodiment in state 2-6;

(a) and (b) of FIG. 34 are front sectional and plan views of the core molding machine in accordance with the second embodiment in state 2-7, respectively;

(a) and (b) of FIG. 35 are front sectional and plan views of the core molding machine in accordance with the second embodiment in state 2-8, respectively; and (a) and (b) of FIG. 36 are front sectional and plan views of the core molding machine in accordance with the second embodiment in state 2-9, respectively.

DESCRIPTION OF EMBODIMENTS

First Embodiment

In the following, a core molding machine 1 in accordance with a first embodiment will be explained with reference to the drawings. As FIGS. 1 to 13 illustrate, this core molding machine 1 fills a cavity (molding space) formed by a pair of heated dies (core box) with core sand such as resin-coated sand, for example, blown thereinto and heats the core sand, so as to mold a core. Specifically, it molds the core through consecutive steps from state 1-1 to 1-10. FIGS. 4 to 13 are diagrams schematically illustrating relationships among individual constituents (constituent components) as front, rear, and plan views in operating states (states 1-1 to 1-10) of the core molding machine 1.

As FIGS. 4 to 9 illustrate, the core molding machine 1 comprises a core box 30 having a pair of laterally (horizontally) separable dies and a sand filling device 31 for filling the core box 30. The sand filling device 31 has a blow head 2 disposed under the core box 30 and fills the core box 30 with core sand 28, which is supplied from a sand tank 55 to the blow head 2 and then directed upward from the blow head 2.

The pair of dies constituting the core box 30 are a fixed die 32 and a movable die 33. The movable die 33 is driven to move horizontally closer to the fixed die 32, so as to form a cavity (molding space) 30*a* ((a) of FIG. 5). The fixed die 32 and movable die 33 are those made of a metal. Heating means such as electric heaters are provided within the fixed die 32 and movable die 33. While the fixed die 32 and movable die 33 are heated, the cavity is filled with the core sand 28 such as the resin coated sand blown thereinto, so as to mold a core (shell core). The dies are held at a fixed temperature (e.g., 200 to 400° C.) by a temperature sensor and the like. The heating means is not limited to the electric heater; a heating plate which can be heated with a gas may be provided adjacent to the dies.

The blow head 2 has a sand blow chamber 4, which is connected to the core box 30 and guides the core sand 28 to the core box 30, and a sand storage chamber 5 communicating with the sand blow chamber 4. The sand filling device 31 has a compressed air supply unit 7 for supplying a compressed air for blowing the core sand 28 into the core box 30 and an aeration air supply unit 9 for supplying an aeration air for floating and fluidizing the core sand. 28 within the sand blow chamber 4 (see FIGS. 21 to 25).

The core molding machine 1 comprises frame members 34*a*, 34*b*, 34*c*, 34*d* erected on a base plate 29. The frame member 34*a* secures and holds the fixed die 32, which is one of the pair of dies. Specifically, the frame member 34*a* holds the fixed die 32 through a fixed die holding unit 35. The fixed die holding unit 35 holds the fixed die 32 by a gripper 35*b*. An attachment member 55*a* of the sand tank 55 is also secured to the base plate 29.

The core molding machine 1 comprises a first actuator 36 and second actuators 37. The first actuator 36 linearly drives the movable die 33, which is the other of the pair of dies, so as to move it horizontally closer to or away from the fixed die 32. By the direction of moving closer to or away from the fixed die 32 is meant the horizontal direction in this embodiment. The second actuators 37 drive the blow head 2 linearly, so as to move it vertically closer to or away from the core box 30. While a pair of second actuators 37 are provided so as to hold the blow head 2 therebetween as seen from the front face in this embodiment, this is not restrictive.

Each of the first and second actuators 36, 37 is a uniaxial actuator. An example of the first actuator 36 is an air-on-oil (air-hydro) cylinder. By the air-on-oil cylinder is meant a cylinder which uses an air pressure converted into an oil pressure and combines air and oil pressures. The air-on-oil cylinder does not use a dedicated hydraulic unit employing a hydraulic pump, but a compressed air source alone. The air-on-oil cylinder is advantageous over air cylinders in its higher positional accuracy, easier controllability of migration speed, and the like. Though the first actuator 36 is not limited to the air-on-oil cylinder, the latter is suitable when the driving force, accuracy in driving position, and cost are concerned. The second actuators 37 are air cylinders, for example, but are not limited thereto. The second actuators 37 may also be air-on-oil cylinders, for example.

The first actuator 36 rotates the movable die 33 by 90° after separating it from the fixed die 32 (see the states 1-7 to 1-8 in (a) and (b) of FIG. 7, (b) of FIG. 10 and (a) of FIG. 11). Specific configurations for this operation will be explained in the following.

The first actuator 36 moves a rotary axis member 39, which is provided in a movable die holding member 38 for holding the movable die 33, closer to or away from the fixed die 32 (see (b) of FIG. 10, (a) of FIG. 11, (b) of FIG. 12 and (a) of FIG. 13). The rotary axis member 39 is provided with an abutment member 41 which is rotatable together therewith. The movable die holding member 38 holds the movable die 33 by a gripper 38*b*.

The frame member 34*c* is located between the first actuator 36 and fixed die 32. A leading end part of the frame member 34*c* is provided with an orientation change member 42. The orientation change member 42 is located lower than the rotary axis member 39 and has a curved surface adapted to abut against the abutment member 41 and change the orientation of the movable die 33, while the abutment member 41 is a plate-like member, for example. An example of the orientation change member 42 is a roller member which is free to rotate. In this embodiment, the rotary axis member 39, abutment member 41, and orientation change member 42 constitute a rotary drive unit for rotating the movable die 33.

When the rotary axis member 39 is further moved away from the fixed die 32 from the state where the abutment member 41 abuts against the orientation change member 42, the abutment member 41 changes its orientation along the curved surface of the orientation change member 42, whereby the movable die 33 is rotated by 90° (see the state 1-8 in (a) of FIG. 11). Though an example in which the movable die 33 is rotated by 90° so as to face up (such that the core is located on the upper side of the movable die 33) is explained here, this is not restrictive. For example, the movable die 33 may be rotated by 90° so as to face down (such that the core is located on the lower side of the movable die 33).

In this core molding machine 1, the first actuator 36 moves the movable die 33 closer to or away from the fixed die 32 in order to form the cavity 30*a*. When the first actuator 36 moves the movable die 33 away from the fixed die 32, the abutment member 41, while changing its orientation along the surface of the orientation change member 42, rotates the movable die 33 by 90° with the aid of the rotary axis member 39 and movable die holding member 38. This makes it unnecessary to provide a separate actuator for rotating the movable die 33 by 90°, whereby the machine can be made simpler and smaller.

Here, the abutment member 41, rotary axis member 39, and movable die holding member 38 are configured such that the movable die 33 confronts the fixed die 32 (i.e., opposes a vertical plane) in the state where the abutment member 41 is not in contact with the orientation change member 42 or at a timing when the abutment member 41 abuts against the orientation, change member 42 as illustrated in (a) and (b) of FIG. 10.

Specifically, as (a) of FIG. 14 illustrates, the abutment member 41 is provided with a spring member 44 for generating a biasing force in the direction of R1 about the rotary axis member 39. One end of the spring member 44 is attached through an attachment member 44*a* to a fixing member 40*b* extended, to the outside of a movable frame 40. The other end of the sprint member 44 is attached through an attachment member 44*b* to the rotary axis member 39. Here, FIGS. 12, 14, and the like depict the spring member 44 in its both end parts alone while omitting the part therebetween in order to make structures of other constituent components easier to see (as in the other drawings and a biasing member 68 illustrated in FIG. 20 which will be mentioned later).

The movable die 33 is provided with a positioning abutment member 65 for making the movable die 33 confront the fixed die 32 in the state where the biasing force in the R1 direction is generated by the spring member 44 (see (b) of FIG. 12). The spring member 44 and abutment member 65 make the movable die 33 confront the fixed die 32 as illustrated in (a) of FIG. 10. When the movable die 33 is moved from this state to the position in the state 1-8 illustrated in (a) of FIG. 11, the abutment member 41 is rotated in the direction of R2 along the orientation change member 42 against the biasing force in the R1 direction caused by the spring member as mentioned above ((b) of FIG. 14). Consequently, the movable die 33 faces up as illustrated in (a) of FIG. 11.

After the movable die 33 is rotated by 90° as mentioned above, a core 43 held within the movable die 33 is released therefrom (see the state 1-9 illustrated in (a) of FIG. 8 and (b) of FIG. 11). This core molding machine 1 achieves a smaller size by simplifying the whole while being of the under-blow type and thus is effective in that users are easier to handle the core 43 released from the movable die 33 rotated upward by 90°.

The movable die 33 is provided with a slide member 45 which is moved closer to or away from the movable die 33 when the movable die 33 having rotated by 90° is moved closer to or away from the fixed die 32 by the first actuator 36.

Provided on the frame member 34 side is a guide member 46 having a slide surface 46*a*, which abuts against the slide member 45 when the movable die 33 having rotated by 90° is moved away from the fixed die 32, for changing the position in the height direction of the slide member 45 (see (b) of FIG. 7 and (a) of FIG. 8). The slide surface 46*a* tilts with respect to the moving direction (horizontal direction) of the movable die 33 caused by the first actuator 36. In this embodiment, the slide surface 46*a* becomes higher with distance from the fixed die 32. In this embodiment, the slide member 45 and guide member 46 constitute a first release unit for releasing the core from the movable die 33 having rotated such that the core is on the upper side.

The slide member 45, when its position in the height direction is changed by the guide member 46, pushes the core 43 held by the movable die 33 away from the movable die 33 ((a) of FIG. 8). The slide member 45 may push out the core 43 either directly or indirectly. Here, the slide member 45 pushes the core 43 through a push member 47 (indirectly), thereby moving the core 43 away from the movable die 33. By "changing the position in the height direction" herein is meant moving up. In an example in which the movable die 33 is rotated downward by 90°, on the other hand, the core 43 is pushed out when moved down.

Specifically, as FIG. 15 illustrates, the slide member 45 has a slide roller 45*a*, a holding unit 45*b* holding the slide roller 45*a* rotatably, and a plate unit 45*e* integrated with the holding unit 45*b*. Disposed on one surface side (the upper face side in the state of (a) of FIG. 8 and FIG. 15) of the plate unit 45*c* are abutment units 45*d* integrated with the plate unit 45*c*. The abutment units 45*d* abut against the push member 47. While the plate unit 45*c* may directly abut against the push member 47 without the abutment units 45*d*, providing the abutment units 45*d* makes it easier to adjust sizes at the time of assembling.

A pair of guide members 45*e* are provided on the other surface side (the lower face side in the state of FIG. 15) of the plate unit 45*c*. The pair of guide members 45*e* are positioned such as to hold the holding unit 45*b* therebetween. The holding unit 45*b* and guide members 45*e* are inserted through and guided by guide holes 38*a* of the movable die holding member 38. As a consequence, the plate unit 45*c* is moved up and down substantially in parallel with a horizontal plane without losing its orientation.

The push member 47 has a plate unit 47*a* adapted to abut against the abutment units 45*d* of the slide member 45 and push units 47*b* disposed on one surface side (the upper face side in the state of FIG. 15 and (a) of FIG. 8) of the plate unit 47*a*. The push units 47*b* are formed like pins, for example. The plate unit 47*a* of the push member 47 abuts against the abutment units 45*d* of the slide member 45 and is moved up. The movable die 33 is provided with push holes 33*a*. The moved-up push member 47 pushes out the core 43 with the push units 47*b* inserted through the push holes 33*a*, so as to release it from the movable die 33.

In this core molding machine 1, the first actuator 36 moves the movable die 33 closer to or away from the fixed die 32 in order to form a cavity. When the movable die 33 having been rotated is moved away from the fixed die 32 by the first actuator 36, the core held by the movable die 33 is released therefrom by the first release unit. This makes it unnecessary to provide a separate actuator for releasing the core 43 from the movable die 33, whereby the machine can be made simpler and smaller.

As FIGS. 16 to 18 illustrate, when moving the movable die 33, the first actuator 36 drives a first cleaning unit 51 for cleaning a blow head nozzle 50 and a second cleaning unit 52 for cleaning a fixed die nozzle 48. As a consequence, the first and second cleaning units 51, 52 clean the blow head nozzle 50 and fixed die nozzle 48. The first and second cleaning units 51, 52 are attached to a leading end part of a holding member 57. The holding member 57 is driven together with the movable die 33 so as to move closer to or away from the fixed die 32.

A base end part of the holding member 57 is attached to the movable frame 40. The movable frame 40 is moved by the first actuator 36 while holding the movable die holding member 38 rotatably. The movable frame 40 is attached to a rod 36*a* of the first actuator 36 and is moved closer to or away from the fixed die 32. The frame member 34*a* is provided with guide members 40*a* for guiding the movable frame 40. The movable frame 40 is horizontally moved by the guide members 40*a*, while keeping its orientation. The guide members 40*a* are disposed at two locations on the lower left and upper right when seen from the right side face as illustrated in (a) of FIG. 19 but are not restricted thereto. They may be disposed at three or more locations. The movable frame 40 driven by the first actuator 36 moves the holding member 57 and the movable die holding member 38, which rotatably holds the movable die 33, closer to or away from the fixed die 32. The movable frame 40 and movable die holding member 38 function as a movable die holding unit.

The leading end of the frame member 34*d* is provided with a third cleaning unit 53 for cleaning a movable die nozzle 49. When the movable die 33 moved by the first actuator 36 comes closer to the third cleaning unit 53, the latter cleans the movable die nozzle 49 by sliding while abutting thereagainst. The first, second, and third cleaning units 51, 52, 53, examples of which include plate-like rubber members (rubber plates), clean their corresponding nozzles 50, 48, 49 by coming into slidable contact therewith.

Specifically, as (a) and (b) of FIG. 7 and (a) and (b) of FIG. 18 illustrate, the first actuator 36 moves the first and second cleaning units 51, 52 when shifting the movable die 33 from the state 1-7 to 1-8. Consequently, the first cleaning unit 51 cleans the blow head nozzle 50. The second cleaning unit 52 cleans the fixed die nozzle 48. As Figs. (a) of FIG. 4, (b) and FIG. 8 and (b) and FIG. 16 illustrate, the first actuator 36 moves the first and second cleaning units 51, 52 also when shifting the movable die 33 from the state 1-10 to 1-1, thereby cleaning their corresponding nozzles 50, 48. The first and second cleaning units 51, 52 may clean the blow head nozzle 50 and the fixed die nozzle 48 either simultaneously or sequentially one by one.

Further, when the first actuator 36 shifts the movable die 33 from the state 1-6 to 1-7 as illustrated in (b) of FIG. 6, (a) of FIG. 7, (b) of FIG. 17 and (a) of FIG. 18, the movable die nozzle 49 comes into slidable contact with the third cleaning unit 53 and is cleaned thereby. When the first actuator 36 shifts the movable die 33 from the state 1-1 to 1-2 as illustrated in (a) and (b) of FIG. 4, (b) of FIG. 16 and (a) of FIG. 17, the movable die nozzle 49 also comes into slidable contact with the third cleaning unit 53 and is cleaned thereby. When the first actuator 36 shifts the movable die 33 from the state 1-10 to 1-1 as illustrated in (a) of FIG. 4, (b) of FIG. 8 and (b) of FIG. 16, the movable die nozzle 49 also comes into slidable contact with the third cleaning unit 53 and is cleaned thereby.

In this core molding machine 1, the first actuator 36 moves the movable die 33 closer to or away from the fixed die 32 in order to form the cavity 30*a*. When the first actuator 36 moves the movable die 33 away from the fixed die 32, the first to third cleaning units 51 to 53 clean the blow head nozzle 50, fixed die nozzle 48, and movable die nozzle 49. This makes it unnecessary to provide separate actuators for cleaning the nozzles 50, 48, 49, whereby the machine can be made simpler and smaller.

The sand storage chamber 5 is provided with an on/off gate 18 for opening and closing a supply port 56 for supplying the core sand 28 from the sand tank 55 to the sand storage chamber 5 (blow head 2). The on/off gate 18 is driven when the first actuator 36 drives the movable die 33. The on/off gate 18 closes the supply port 56 when the movable die 33 forms the cavity 30*a* together with the fixed die 32 ((a) and (b) of FIG. 5).

Specifically, the on/off gate 18 is provided with a communication hole 18*a* for communicating the supply port 56 to the sand tank 55. When the communication hole 18*a* is positioned on the supply port 56 and communicates therewith as illustrated in (a) of FIG. 4, the sand tank 55 and sand storage chamber 5 communicate with each other. That is, the core sand 28 is ready to be supplied from the sand tank 55 to the sand storage chamber 5 (blow head 2). When the communication hole 18*a* is slid from above the supply port 56 to a shifted position not communicating with the supply port 56 as illustrated in (b) of FIG. 4 or (a) of FIG. 5, on the other hand, the sand tank 55 and sand storage chamber 5 do not communicate with each other through the on/off gate 18. At this time, the supply port 56 of the storage chamber 5 is in a closed state. The blow head 2 has a sealed state therewithin.

The on/off gate 18 is provided with the biasing member 68 as illustrated, in FIG. 20, so as to be biased in the direction of X1 illustrated in (a) of FIG. 4. The on/off gate 18 is also provided with an undepicted positioning member for positioning the communication hole 18*a* at a position communicating with the supply port 56 in the state biased in the X1 direction as illustrated in (a) of FIG. 4. The biasing member 68, which is a spring member, has one end 68*a* attached to the on/off gate 18 and the other end 68*b* attached to the blow head 2.

The holding member 57 holding the first and second cleaning units 51, 52 is provided with a push member 58 formed so as to extend to the lower part. The holding member 57 and push member 58 are moved together with the movable die 33 by the first actuator 36.

When the first actuator 36 shifts the movable die 33 from the state 1-1 to 1-2, the push member 58 slides the on/off gate 18 in the direction of X2 as illustrated in (a) and (b) of FIG. 4. Therefore, the supply port 56 of the sand storage chamber 5 is closed by the on/off gate 18 in the state 1-2 illustrated in (b) of FIG. 4.

The supply port is kept closed by the on/off gate 18 from the state 1-2 to 1-6 as illustrated in (b) of FIG. 4 to (b) of FIG. 6. As (a) of FIG. 7 illustrates, when shifting the movable die 33 from the state 1-6 to 1-7, the push member 58 is moved in the X1 direction, whereby the pushing force for the on/off gate 18 in the X2 direction is canceled. This allows the above-mentioned undepicted biasing means to bias the on/off gate 18 in the X1 direction, whereby the undepicted positioning member moves the on/off gate 18 to a position where the communication hole 18*a* communicates with the supply port 56 as in the state of (a) of FIG. 4. Then, in the state of 1-7, the core sand 28 is supplied by its own weight from the sand tank 55 to the sand storage chamber 5.

In this core molding machine 1, the first actuator 36 functions not only to move the movable die 33 closer to or away from the fixed die 32, but also to slide the on/off gate 18 so as to open the support port 56 of the sand storage chamber 5, thereby communicating it to the sand tank 55, and close the supply port 56 with the on/off gate 18. This makes it unnecessary to provide a separate actuator for sliding the on/off gate 18, whereby the machine can be made simpler and smaller.

A flexible hose 59 is disposed between the sand tank 55 and the supply port 56 of the sand storage chamber 5. The flexible hose 59 makes it possible to secure the sand tank 55 also when the blow head 2 is raised by the second actuators 37 as illustrated in (b) of FIG. 5. This achieves a smaller size. The flexible hose 59 is made of a resin, for example.

After the core is molded in the core-forming cavity 30*a* formed by moving the movable die 33 toward the fixed die 32, the first actuator 36 moves the movable die 33 away from the fixed die 32, so as to release the core 43 from the fixed die 32 and let the movable die 33 hold the core 43 (see (a) and (b) of FIG. 6).

The fixed die 32 is provided with a push member 61 for pushing the core 43 molded in the cavity 30*a* away from the fixed die 32 when the movable die 33 is moved away from the fixed die 32. The fixed die 32 is also provided with a biasing member 62 for biasing the push member 61 for biasing the push member 61 in such a direction as to push out the core 43 ((a) of FIG. 4 and (b) of FIG. 9). The fixed die 32 is also provided with an operating member 63 for moving the push member 61 in a direction opposite to the direction of pushing the core 43 against the biasing force of the biasing member 62 when forming the cavity 30*a* by assembling the fixed die 32 and movable die 33 with each other. In this embodiment, the push member 61, biasing member 62, and operating member 63 constitute a second release unit for releasing the core from the fixed die 32 such that the core is held by the movable die 33 when the movable die 33 is separated from the fixed die 32.

When the fixed die 32 and movable die 33 are assembled with each other, so as to form the cavity 30*a*, the member 63 is pushed by the movable die 33 moved by the first actuator 36, so as to move the push member 61 (see (b) of FIG. 4 and (a) of FIG. 5). That is, at the time of assembling, the push unit 61*b* of the push member 61 is pulled into the fixed die 32 so as to reside at a retracted position.

Filling and molding with sand as illustrated in (b) of FIG. 5 is performed against the biasing force of the biasing member 62. Then, the movable die 33 is moved away from the fixed die 32 as illustrated in (b) of FIG. 6, whereby the operating member 63 is stopped from pushing the push member 61 in the direction of X3. This allows the biasing force of the biasing member 62 to bias the push member 61 in the direction of X4. The push member 61 biased in the X4 direction moves to a projected position which protrudes from the fixed die 32 toward the movable die 33 within the fixed die 32. As a consequence, the push member 61 causes the fixed die 32 and movable die 33 to release and hold the core 43, respectively (see (b) of FIG. 6).

The push member 61 has a plate unit 61*a* and push units 61*b* disposed on one surface side of the plate unit 61*a* (see FIG. 16). The push units 61*b* are formed like pins, for example. The fixed die 32 is provided with push holes 32*a*. The push member 61 pushes out the core 43 with the push units 61*b* inserted through the push holes 32*a*, so as to release it from the fixed die 32.

The biasing member 62 has spring members 62*a* each having one end attached to the fixed die holding unit 35, a plate member 62*b*, attached to the other end of the spring member 62*a*, for transmitting the biasing force, and abutment units 62*c* formed on one surface (the right surface in (b) of FIG. 9) of the plate member 62*b* (see FIG. 16). The biasing force caused by the spring members 62*a* is transmitted to the push members 61 through the plate member 62*b* and abutment units 62*c*. Here, the plate member 62*b* and abutment units 62*c* may be omitted, so that the biasing force of the spring members 62*a* directly biases the push member 61. The plate member 62*b* is also provided with a guide member 62*d* for pushing the push units 61*b* evenly.

In this core molding machine 1, the first actuator 36 moves the movable die 33 closer to or away from the fixed die 32 in order to form the cavity 30*a*. When the first actuator 36 moves the movable die 33 away from the fixed die 32, the second release unit releases the core 43 from the fixed die 32. This makes it unnecessary to provide a separate actuator for releasing the core 43 from the fixed die 32, whereby the machine can be made simpler and smaller.

A specific structural example of the sand filling device 31 constituting the core molding machine 1 will now be explained with reference to FIGS. 21 to 25.

As (a) of FIG. 21 illustrates, the blow head 2, which is adapted to move up and down, is disposed under the assembled core box 30. As mentioned above, the blow head 2 is driven by the second actuators 37. Here, it is sufficient for the blow head 2 to be able to move up and down relative to the core box 30.

The blow head 2 has the sand blow chamber 4 and sand storage chamber 5, adjacent to each other, separated by a partition 3. The upper end of the sand blow chamber 4 is provided with a plate 4*a* coming into close contact with the core box 30. The plate 4*a* is formed with sand blow holes 4*b* for blowing the core sand from within the sand blow chamber 4 into the cavity 30*a* of the core box 30. The core box 30 may be provided with vent holes for discharging the blown-in air for filling with sand. When no vent holes are provided, the air may be discharged through a minute gap between the pair of dies.

As (a) of FIG. 21 illustrates, sand blow nozzles 6 communicating with the sand blow holes 4*b* on the lower side thereof may project from the lower end of the plate 4*a*. The plate 4*a* may be constructed so as to be removable from the sand blow chamber 4. In this case, fastening means, clamp means, and the like are provided, for example. Though the example of FIGS. 21 to 25 assumes that the sand blow nozzles 6 for yielding effects which will be explained later project from the lower end of the plate 4*a*, this is not restrictive. The above-mentioned "blow head nozzle 50" means the one on the outer surface side, while the "sand blow nozzles 6" means those on the inner surface side.

An opening 3*a* (see (b) of FIG. 21) is provided at the center in a lower part of the partition 3. The sand blow chamber 4 and sand storage chamber 5 communicate with each other through the opening 3*a*. The sand storage chamber 5 has a slope 5*a* in at least a part of its bottom face (see (a) of FIG. 21). The upper face of a ceiling board 5*b* of the sand storage chamber 5 is positioned lower than the upper face of the plate 4*a* in the sand blow chamber 4.

A compressed air supply unit 7 for supplying a compressed air into the sand storage chamber 5 is provided in a lower part of the slope 5*a* in the sand storage chamber 5 (see (a) of FIG. 22). The compressed air supply unit 7 is connected to (communicates with) the sand storage chamber 5. A sintered body 7*a* of bronze is disposed at a leading end of the compressed air supply port 7. The compressed air supply port 7 is connected through an on/off valve 8 to a compressed air supply source which is not depicted.

Disposed in an upper part of a side wall of the sand blow chamber 4 are aeration air supply units 9 for supplying into the sand blow chamber 4 an aeration air for floating and fluidizing the core sand therewithin. A sintered body 9*a* of bronze is disposed at the leading end of each aeration air supply unit 9. The aeration air supply unit 9 is connected to (communicates with) the sand blow chamber 4 through the sintered body 9*a*.

Here, the aeration air supply unit 9 is attached to a plate-like member 4*d*. The plate-like member 4*d* is detachably attached to the sand blow chamber 4 through undepicted fastening means. The plate-like member 4*d* may be attached upside down so as to change the position of the aeration air supply unit 9. Though three aeration air supply units 9 are provided here as illustrated in (b) of FIG. 22, this is not restrictive; one will suffice.

An air pipe 10 communicates with the aeration air supply units 9. The air pipe 10 is provided with an on/off valve 11. The on/off valve 11 communicates with a compressed air source which is not depicted.

A branch air pipe 12 is disposed in the middle of the air pipe 10. The branch air pipe 12 is provided with an exhaust valve 13 for evacuating the compressed air remaining within the sand blow chamber 4. The exhaust valve 13 is connected to the sand blow chamber 4 through the pipes 10, 12.

A pressure sensor 14 for measuring the pressure within the sand blow chamber 4 is disposed in an upper part of a side wall orthogonal to the side wall provided with the aeration air supply unit 9. A pressure sensor 15 for measuring the pressure within the sand storage chamber 5 is mounted to an upper part of a side wall in the sand storage chamber 5.

A plank 5*c* is attached to the upper end of the sand storage chamber 5. A hole to become the supply port 56 penetrates through the ceiling board 5*b* and plank 5*c* of the sand storage chamber 5. A flange 16 provided with a hole 16*a* for supplying sand is disposed above the plank 5*c*. The flexible hose 59 serving as a sand supply pipe communicating with the hole 16*a* is attached to the upper end of the flange 16. The flexible hose 59 communicates with the sand tank 55.

The on/off gate 18 provided with the communication hole 18*a* is disposed between the plank 5*c* and flange 16. As mentioned above, the on/off gate 18 slides as the movable die 33 is driven by the first actuator 36, so as to open and close the supply port 56. When the blow head 2 is moved down by the second actuators 37, the plank 5*c*, on/off gate 18, and flange 16 also move down.

Operations of thus constructed sand filling device 31 will now be explained. The following will provide a general explanation including a case where the device is provided in the core molding machine 1. The assembled core box 30 is arranged at a predetermined position. Subsequently, the on/off gate 18 closes the supply port 56. Then, the blow head 2 is moved up, so as to be placed in the state of FIG. 21. The core box 30 and plate 4*a* are in close contact with each other in the state of FIG. 21. The supply port 56 is closed by the on/off gate 18, so as to form a sealed space within the blow head 2. The sand blow chamber 4 and sand storage chamber 5 contain therein respectively necessary amounts of core sand (omitted in FIG. 21).

Next, the on/off valve 11 is opened, and the aeration air supply unit 9 is operated. The sintered body 9*a* of the aeration air supply unit 9 spouts an air (aeration air), thereby floating and fluidizing the core sand within the sand blow chamber 4. After a lapse of a predetermined time, the on/off valve 8 is opened, and the compressed air supply unit 7 is operated. The sintered body 7*a* of the compressed air supply unit 7 spouts the compressed air, thereby feeding the core sand from within the sand storage chamber 5 to the sand blow chamber 4. The core sand is blown from within the sand blow chamber 4 into the cavity 30*a* of the core box 30 through the sand blow nozzles 6 and sand blow holes 4*b*. At this time, the compressed air blown into the cavity 30*a* together with the core sand is discharged through the vent holes or minute gap as mentioned above. A step of filling the cavity 30*a* with the floated and fluidized core sand from within the sand blow chamber 4 by the compressed air supply unit 7 may be performed after or in a manner at least partly overlapping with the step of floating and fluidizing the core sand within the sand blow chamber 4 by the aeration air supply unit 9.

After a lapse of a predetermined time from starting operating the compressed air supply unit 7, the on/off valves 11, 8 are closed, and the aeration air supply unit 9 and compressed air supply unit 7 are stopped from operating. At this time, as mentioned above, the exhaust through the vent holes or minute gap generates a pressure difference between the sand blow chamber 4 and sand storage chamber 5. The pressure within the sand blow chamber 4 is lower than that within the sand storage chamber 5. This pressure difference acts to move the core sand from within the sand blow chamber 4 and sand storage chamber 5 into the cavity 30*a* of the core box 30. The core sand filling the cavity 30*a* does not fall down.

Next, the exhaust valve 13 is opened, so as to evacuate the compressed air remaining within the sand blow chamber 4. That is, the compressed air remaining within the sand blow chamber 4 enters the aeration air supply unit 9 through the sintered body 9*a* and travels through the air pipe 10 and branch air pipe 12, so as to exit from the exhaust valve 13. At this time, such an airflow occurs that the compressed air remaining within the blow chamber 4 and sand storage chamber 5 is guided to the aeration air supply port 9 through the sintered body 9*a*, along which the core sand migrates from within the sand storage chamber 5 into the sand blow chamber 4. The sand blow chamber 4 is filled with the core sand.

When the pressure sensors 14, 15 detect that the gauge pressure within the blow head 2 is zero (the pressure within the blow head 2 is substantially the same as the atmospheric pressure), the blow head 2 is moved down, so as to be separated from the core box 30. Subsequently, the exhaust valve 13 is closed.

The core box 30 is disassembled, and the core is taken out therefrom. Then, the on/off gate 18 is opened. The core sand is supplied from within the sand tank 55 into the sand storage chamber 5 through the flexible hose 59, hole 16*a*, communication hole 18*a*, and supply port 56.

Though the compressed air supply unit 7 communicates with the sand storage chamber 5 in the above-mentioned sand filling device 31, this is not restrictive. It may communicate with the sand blow chamber 4, for example. In this case, a sand feed air supply unit for supplying a sand feed air for supplying the core sand from within the sand storage chamber 5 into the sand blow chamber 4 may be provided. Each of the compressed air supply unit and aeration air supply unit may be provided in addition.

A sand filling device 71 illustrated in FIGS. 23 and 24 will now be explained as another example of a sand filling device constituting the core molding machine 1. First, differences between the sand filling device 71 and sand filling device 31 mentioned above will be explained. In the sand filling device 71, as illustrated in (a) of FIG. 23, a side wall vertically extending from the upper end of the slope 5*a* in the sand storage chamber 5 is provided with a second compressed air supply unit 19 for supplying a compressed air into the sand storage chamber 5. The second compressed air supply unit 19 communicates with the sand storage chamber 5. The leading end of the second compressed air supply unit 19 is provided with a sintered body 19*a* of bronze. As with the compressed air supply unit 7, the second compressed air supply unit 19 communicates with the on/off valve 8 through an air pipe 20.

A slope 4*c* forming a part of the bottom face of the sand blow chamber 4 in the sand filling device 71 is provided with second aeration air supply units 21 for supplying the sand blow chamber 4 with art aeration air for floating and fluidizing the core sand therewithin. The second aeration air supply units 21 communicate with the sand blow chamber 4. The leading end of each second aeration air supply unit 21 is provided with a sintered body 21*a* of bronze. Though the slope 4*c* forming a part of the bottom face of the sand blow chamber 4 is provided with two second aeration air supply units 21 here as illustrated in (b) of FIG. 24, this is not restrictive; at least one will suffice. The second aeration air supply units 21 communicate with an undepicted compressed air source through an on/off valve 22.

The sand filling device 71 has the same structure as with the above-mentioned sand filling device 31 except for the differences explained here. The constituents identical to those of the sand filling device 31 will be referred to with the same signs while omitting their detailed explanations.

Operations of thus constructed sand filling device 71 will now be explained. The following will provide a general explanation including a case where the device is provided in the core molding machine 1. The assembled core box 30 is arranged at a predetermined position. Subsequently, the on/off gate 18 closes the supply port 56. Then, the blow head 2 is moved up, so as to be placed in the state of FIG. 23. The core box 30 and plate 4*a* are in close contact with each other in the state of FIG. 23. The supply port 56 is closed by the on/off gate 18, so as to form a sealed space within the blow head 2. The sand blow chamber 4 and sand storage chamber 5 contain therein respectively necessary amounts of core sand (omitted in (a) of FIG. 23).

Next, the on/off valves 11, 22 are opened, and the aeration air supply unit 9 and second aeration air supply unit 21 are operated. The sintered body 9*a* of the aeration air supply unit 9 and the sintered body 21*a* of the second aeration air supply unit 21 spout an air (aeration air), thereby floating and fluidizing the core sand within the sand blow chamber 4. After a lapse of a predetermined time, the on/off valve 8 is opened, and the compressed air supply unit 7 and second compressed air supply unit 19 are operated. The sintered body 7*a* of the compressed air supply unit 7 and the sintered body 19*a* of the second compressed air supply unit 19 spout the compressed air, thereby feeding the core sand from within the sand storage chamber 5 to the sand blow chamber 4. The core sand is blown from within the sand blow chamber 4 into the cavity 30*a* of the core box 30 through the sand blow nozzles 6 and sand blow holes 4*b*. At this time, the compressed air blown into the cavity 30*a* together with the core sand is discharged through the vent holes or minute gap as mentioned above.

After a lapse of a predetermined time from starting operating the compressed air supply unit 7 and second compressed air supply unit 19, the on/off valves 11, 22, 8 are closed, and the aeration air supply unit 9, second aeration air supply unit 21, compressed air supply unit 7, and second compressed air supply unit 19 are stopped from operating. At this time, as mentioned above, the exhaust through the vent holes or minute gap generates a pressure difference between the sand blow chamber 4 and sand storage chamber 5. The pressure within the sand blow chamber 4 is lower than that within, the sand storage chamber 5. This pressure difference acts to move the core sand from within the sand blow chamber 4 and sand storage chamber 5 into the cavity 30*a* of the core box 30. The core sand filling the cavity 30*a* does not fall down.

Next, the exhaust valve 13 is opened, so as to evacuate the compressed air remaining within the sand blow chamber 4. That is, the compressed air remaining within the sand blow chamber 4 enters the aeration air supply unit 9 through the sintered body 9*a* and travels through the air pipe 10 and branch air pipe 12, so as to exit from the exhaust valve 13. At this time, such an airflow occurs that the compressed air remaining within the blow chamber 4 and sand storage chamber 5 is guided to the aeration air supply port 9 through the sintered body 9*a*, along which the core sand migrates from within the sand storage chamber 5 into the sand blow chamber 4. The sand blow chamber 4 is filled with the core sand.

When the pressure sensors 14, 15 detect that the gauge pressure within the blow head 2 is zero (the pressure within the blow head 2 is substantially the same as the atmospheric pressure), the blow head 2 is moved down, so as to be separated from the core box 30. Subsequently, the exhaust valve 13 is closed.

The core box 30 is disassembled, and the core is taken out therefrom. Then, the on/off gate 18 is opened. The core sand is supplied from within the sand tank 55 into the core storage chamber 5 through the flexible hose 59, hole 16*a*, communication hole 18*a*, and supply port 56.

The aeration air supply unit 9 and compressed air supply unit 7 may have the same operation pressure in the sand filling devices 31, 71. Having the same pressure is advantageous in that the amount of air consumption can be reduced. The operating pressure of the compressed air supply unit 7 may be higher than that of the aeration air supply unit 9. This is advantageous in that the pressure within the sand storage chamber 5 becomes higher than that within the sand blow chamber 4, thus generating a greater pressure difference, whereby the core sand migrates easily from the sand storage chamber 5 to the sand blow chamber 4.

In the sand filling devices 31, 71, the blow head 2 partitioned into the sand blow chamber 4 and sand storage chamber 5 communicating with each other is arranged under the core box 30. This can reduce the size of the machine in its height direction as compared with the top-blow type core molding machine, thereby making the machine smaller.

Each of the sand filling devices 31, 71 comprises two air supply means, i.e., the compressed air supply unit 7 and aeration air supply unit 9, and causes them to spout airs, for blowing the core sand for filling, whereby the filling property of core sand can further be improved.

A part of the bottom face of the sand storage chamber 5 is formed into the slope 5*a*, and the compressed air supply unit 7 is mounted thereto. Its operation and effect will now be explained. The core sand supplied into the sand storage chamber 5 typically attains a conical form therein because of an angle of repose of sand. In this case, the sand layer is lower in a part where the partition 3 and core sand are in contact with each other, so that, when the core sand is moved from the sand storage chamber 5 to the sand blow chamber 4, the core sand and air may not mix well with each other, whereby only the air may pass through the opening 3*a*, thus yielding so-called air blow-by. In the sand filling devices 31, 71, by contrast, the slope 5*a* forming a part of the bottom face of the sand storage chamber 5 is provided with the compressed air supply unit 7, so as to supply the compressed air as mentioned above, whereby a conical pile of core sand is collapsed, and the core sand is stirred. This makes the core sand flat within the sand storage chamber 5, thereby raising the height of the sand layer in the part where the partition 3 and core sand are in contact with each other. This can prevent the above-mentioned air blow-by from occurring and increase the amount of core sand migrating from the sand storage chamber 5 to the sand blow chamber 4, i.e., the amount of sand effectively used.

In the sand filling devices 31, 71, the exhaust valve 13 communicates with the sand blow chamber 4 through the air pipe connected to the aeration air supply unit 9. Since the evacuated air enters the aeration air supply unit 9 through the sintered body 9*a*, the aeration air supply unit 9 also functions as exhaust means. Even when clogged with sand at the time of exhaust, the sintered body 9*a* subsequently spouts the compressed air and thus can be relieved from being clogged with sand.

Since the sand filling device 71 comprises the second compressed air supply unit 19 in addition to the compressed air supply unit 7, the conical pile of core sand is collapsed within the sand storage chamber 5, whereby the action of stirring the core sand is further promoted. This is advantageous in that the core sand migrates from the sand storage chamber 5 to the sand blow chamber 4 more smoothly.

The sand filling device 71 comprises the second aeration air supply unit 21 in addition to the aeration air supply unit 9 and thus is advantageous in that the action of floating and fluidizing the core sand within the sand blow chamber 4 is further promoted.

Each of the sand filling devices 31, 71 is equipped with the pressure sensors 14, 15 for measuring the pressures within the sand blow chamber 4 and sand storage chamber 5 and thus can easily measure the pressure difference between the sand blow chamber 4 and sand storage chamber 5.

The operation and effect of projecting the sand blow nozzles 6 from the lower end of the plate 4*a* will now be explained in the sand filling devices 31, 71. After the core sand is blown from within the sand blow chamber 4 into the cavity 30*a*, the aeration air supply unit 9 and compressed air supply unit 7 are stopped from operating. The core sand drops from within the sand blow chamber 4 under gravity, thereby forming an air layer (gap) K between the upper face of core sand within the sand blow chamber 4 and the lower face of the plate 4*a* (see FIG. 25 in which sign S is core sand).

In the state illustrated in FIG. 25, the core sand is blown into the next cavity 30*a*. At this time, the leading end of each sand blow nozzle 6 is buried in the core sand, which is advantageous in that the air in the air layer K is not convoluted into the core sand, whereby the cavity 30*a* is fully filled with the core sand. Even when the air layer K occurs, the leading end of the sand blow nozzle 6 is always buried in the core sand, whereby no unsolidified part of the core sand drops out from within the cavity 30*a* to the air layer K. This can prevent the cavity 30*a* from being poorly filled with the core sand.

In the sand filling devices 31, 71, the inner face of the sand blow hole 4*b* and the outer face of the sand blow nozzle 6 are formed with female and male threads, respectively, which are brought into threadable engagement with each other, so as to project the sand blow nozzle 6 from the lower end of the plate 4*a*. This is not restrictive; they may be firmly secured to each other by welding or the like. Though cylindrical pipes are used as the sand blow nozzles 6, they are not limited thereto but may be elliptical, for example.

Though each of the sand filling devices 31, 71 operates the compressed air supply unit 7 after a lapse of a predetermined time from starting the aeration air supply unit 9, this is not restrictive. The compressed air supply unit 7 may be operated when the pressure sensor 14 detects a predetermined pressure value within the sand blow chamber 4 after starting the aeration air supply unit 9. The predetermined pressure value within the sand blow chamber 4 in this case is required to be lower than the operating pressure of the compressed air supply unit 7 and more preferably falls within the range of 0.01 to 0.2 MPa.

Timings for starting and stopping the aeration air supply unit 9 and second aeration air supply unit 21 may be either simultaneous or not in the sand filling device 71. Timings for starting and stopping the compressed air supply unit 7 and second compressed air supply unit 19 may also be either simultaneous or not. For shifting the respective timings for starting or stopping the compressed air supply unit 7 and second compressed air supply unit 19, dedicated on/off valves may be provided so as to communicate with the compressed air supply unit 7 and second compressed air supply unit 19, respectively.

Though the blow head 2 moves up and down with respect to the core box 30 arranged at a predetermined position in the sand filling devices 31, 71, this is not restrictive; the core box 30 may be moved up and down with respect to the blow head 2 arranged at a predetermined position.

While the sand filling devices 31, 71 illustrate an example using a shell core molding machine in which heated dies are filled with resin-coated sand blown thereinto so as to mold a shell core, this is not restrictive; the present invention is also applicable to a cold box method which is a normal-temperature gas-hardening method.

Though each of the sand filling devices 31, 71 stops the aeration air supply unit 9 and compressed air supply unit 7 from operating at the same time, this is not restrictive; the aeration air supply unit 9 may be stopped before the compressed air supply unit 7.

The operating pressures of the aeration air supply unit 9, second aeration air supply unit 21, compressed air supply unit 7, and second compressed air supply unit 19 in the sand filling devices 31, 71 are not limited to specific pressure values. Preferably, each of the aeration air supply unit 9, second aeration air supply unit 21, compressed air supply unit 7, and second compressed air supply unit 19 has an operating pressure of 0.1 to 0.5 MPa.

A core molding method using thus constructed core molding machine 1 will now be explained. This method molds a core by performing steps corresponding to the states 1-1 to 1-10 in sequence. Though the following explanation assumes that there is the sand filling device 31, the same holds in the case using the sand filling device 71 except for the points mentioned above.

To begin with, the state 1-1 illustrated in (a) of FIG. 4 is the original position. The state 1-2 illustrated in (b) of FIG. 4 indicates a step of sealing the inside of the blow head 2 by moving the on/off gate 18. When moving the movable die 33 closer to the fixed die 32, the first actuator 36 causes the on/off gate 18 to close the supply port 56 (gate closing step). The gate close state effected by this step is required to be kept at least until a sand filling step. The close state is kept until the state 1-6 in this embodiment.

The state 1-3 illustrated in (a) of FIG. 5 indicates a step of forming the cavity 30*a* (cavity formation step). That is, the movable die 33 is moved closer to the fixed die 32 so as to abut thereagainst (the abutment encompassing a case forming such a cavity as to produce a minute gap for discharging air), thereby forming the cavity 30*a*.

The state 1-4 illustrated in (b) of FIG. 5 indicates a step of filling the cavity 30*a* with sand through a step of communicating the sand filling device 31 and cavity 30*a* to each other (communication and filling steps). The cavity 30*a* is filled with sand by the sand filling devices 31, 71 as mentioned above.

The state 1-5 illustrated in (a) of FIG. 6 indicates a step of separating the sand filling device 31 from the cavity (communication termination step). During this period, the core sand 28 within the cavity is solidified by the heat of the core box 30, so as to mold the core. Hence, this step can also be regarded as a molding step.

The state 1-6 illustrated in (b) of FIG. 6 indicates a step of opening the dies and causing the movable die to hold the molded core (die open step). This step moves the movable die 33 away from the fixed die 32 by the drive force of the first actuator 36, so that the core 43 is released from the fixed die 32 and held by the movable die 33.

The state 1-7 illustrated in (a) of FIG. 7 and (b) of FIG. 10 indicates a step of causing the abutment member 41 to abut against the orientation change member 42 after a step of moving the movable die 33 holding the core 43 away from the fixed die 32. In this separation step, the third cleaning unit 53 cleans the movable die nozzle 49 ((b) of FIG. 17 and (a) of FIG. 18). In the state 1-7, as mentioned above, the first actuator 36 stops the push member 58 from applying the pushing force to the on/off gate 18, whereby the biasing member 68 urges the on/off gate 18 to communicate the supply port 56 to the sand tank 55 (gate open step).

The state 1-8 illustrated in (b) of FIG. 7 and (a) of FIG. 11 indicates a step of rotating by 90° the movable die 33 holding the core 43. Here, the movable die 33 is rotated such that the core 43 is held on the upper side thereof (die rotation step). In this step, the driving force of the first actuator 36 rotates the movable die 33 by 90° as mentioned above. When shifting the movable die 33 from the state 1-7 to 1-8, the first and second cleaning units 51, 52 clean the blow head nozzle 50 and fixed die nozzle 48.

The state 1-9 illustrated in (a) of FIG. 8 and (b) of FIG. 11 indicates a step of releasing the core 43 from the movable die 33 (release step). In this step, the driving force of the first actuator 36 releases the core 43 from the movable die 33 as mentioned above.

The state 1-10 illustrated in (b) of FIG. 8 indicates a step of retracting into the movable die the push units 47*b* functioning to release the core from the movable die 33. From the state 1-5 to 1-9, the first actuator 36 is driven so as to contract its rod 36*a*, thereby moving the movable frame 40, the movable die 33, and the like away from the fixed die 32. From the state 1-9 to 1-10, from the state 1-10 to 1-1, and from the state 1-1 to 1-3, the first actuator 36 is driven to extend the rod 36*a*, thereby moving the movable frame 40, movable die 33, and the like closer to the fixed die 32.

In the core molding method using the core molding machine 1, as mentioned above, the first to third cleaning units 51, 52, 53 clean the nozzles 50, 48, 49 during when the state shifts from 1-1 to 1-10 and then returns to 1-1 again.

In the core molding machine 1 and the core molding method using the same, as mentioned above, the blow head 2 has the sand blow chamber 4 and sand storage chamber 5, the compressed air supply unit 7 supplies the compressed air, and the aeration air supply unit 9 supplies the aeration air to fill the cavity 30*a* of the core box 30 with the sand, whereby the core sand filling property in the under-blow type is improved. In this machine 1 and method, the blow head 2 is arranged under the core box 30, whereby the machine is made smaller. Hence, the core sand filling property can be improved while making the machine smaller.

In the machine 1 and method, as mentioned above, a common actuator (first actuator 36) can drive the movable die 33 (so as to open it, close it, and so forth), rotate the movable die 33, release the core from the movable die 33, clean the nozzles 50, 48, 49, drive the on/off gate 18, and release the core from the fixed die 32 at the time of opening the dies. This simplifies the machine. It also makes the machine smaller. In this core molding machine 1, constituent components can be driven by the first and second actuators 36, 37 alone.

Second Embodiment

A core molding machine 1A in accordance with the second embodiment will now be explained with reference to FIGS. 26 to 36. The core molding machine 1A in accordance with the second embodiment differs from the core molding machine 1 in accordance with the first embodiment mainly in that it further comprises a sand collection device 100 while lacking the first to third cleaning units 51 to 53. In the following, the differences from the core molding machine 1 in accordance with the first embodiment will mainly be explained, while omitting overlapping descriptions. For example, the core molding machine 1A in accordance with the second embodiment is a machine for filling a heated die with resin-coated sand blown thereinto, so as to mold a shell core.

The sand collection device 100 has a third actuator 110 secured to a base plate 29 through an undepicted frame member and a conduit member 120 bridging the blow head 2 and on/off gate 18. The third actuator 110 is a uniaxial actuator. An example of the third actuator 110 is an air-on-oil (air-hydro) cylinder. A fourth cleaning unit 112 is disposed at the leading end of the third actuator 110.

The third actuator 110 horizontally drives the fourth cleaning unit 112. This moves the cleaning unit 112 closer to or away from the blow head 2 (blow head nozzle 50). The fourth cleaning unit 112, an example of which is a plate-like rubber member (rubber plate), cleans the nozzle 50 by coming into slidable contact therewith.

The conduit member 120 is a ramp (chute) sloping down from the upper end of the blow head nozzle 50 (the upper end of the sand blow chamber 4) to the on/off gate 18. Therefore, the sand discharged from the upper end of the blow head nozzle 50 to the conduit member 120 reaches the on/off gate 18 through the conduit member 120. When the on/off gate 18 is open, the sand having reached the on/off gate 18 is supplied to the sand storage chamber 5 through the communication hole 18*a* and supply port 56.

Disposed in a middle part of the conduit member 120 is a filter member 122 adapted to pass therethrough sand having a predetermined particle size or smaller. The filter member 122 may be constituted by a mesh sieve, for example. The mesh size of the filter member 122 may be set such as to prevent a sand mass in which sand is assembled and solidified and impurities and the like having a size not smaller than that of the sand mass from passing through the filter member 122 while allowing the sand itself to pass therethrough.

A method of manufacturing the core 43 by using the core molding machine 1A will now be explained. To begin with, the state 2-1 illustrated in FIGS. 26 to 28 is the original position. In the state 2-1, the movable die 33 is separated from the fixed die 32 while confronting it. The fourth cleaning unit 112 is separated from the blow head nozzle 50. The blow head 2 is separated from the core box 30. The communication hole 18*a* and supply port 56 are not closed by the on/off gate 18, whereby the flexible hose 59 and communication hole 56 communicate with each other.

Subsequently, as illustrated in FIG. 29 as the state 2-2, the first actuator 36 is driven so as to move the movable die 33 closer to the fixed die 32. Here, as the movable die 33 moves closer to the fixed die 32, the push member 58 pushes the on/off gate 18, thereby closing the communication hole 18*a* and supply port 56. The state in which the communication hole 18*a* and supply port 56 are closed by the on/off gate 18 is required to be kept at least until a sand filling step. The close state is kept until the state 2-7 in this embodiment.

Then, as illustrated in FIG. 30 as the state 2-3, the first actuator 36 is further driven, so that the movable die 33 abuts against the fixed die 32. This integrates the movable die 33 and fixed die 32 together, so as to construct the core box 30 and form the cavity 30*a* within the core box 30. At this time, the movable die 33 pushes the operating member 63 toward the fixed die 32, whereby the push unit 61*b* of the movable die 61 is drawn into the fixed die 32 so as to move to a retracted position. A minute gap for discharging air may be formed in the state where the movable die 33 and fixed die 32 are integrated together by abutting against each other.

Next, as illustrated in FIG. 31 as the state 2-4, the second actuators 37 are driven so as to move up the blow head 2 until the blow head nozzle 50 abuts against the core box 30. This allows the sand filling device 31 and cavity 30*a* to communicate with each other. In this case, each of the compressed air supply unit 7 and aeration air supply unit 9 is controlled, so that the sand filling device 31 fills the cavity 30*a* with sand. At the time of sand filling, the heat of the core box 30 solidifies the core sand within the cavity 30*a*, thereby molding the core 43. The sand filling device 71 may be used in place of the sand filling device 31 in the second embodiment as in the first embodiment.

Subsequently, as illustrated in FIG. 32 as the state 2-5, the second actuators 37 are driven so as to move down the blow head 2. This separates the sand filling device 31 and cavity 30*a* from each other. At this time, an unsolidified inner part of sand 130 drops from within the core 43 to the upper face of the blow head 2. Therefore, while the core 43 in accordance with the first embodiment is a solid core, the core 43 in accordance with the second embodiment is a hollow core. The hollow core is advantageous over the solid core when a severe quality is required for a mold manufactured by using the core. As compared with the solid core, the hollow core can reduce the amount of sand used, thereby cutting cost down. The hollow core is lighter than the solid core and thus can cut transportation cost down. For obtaining a desirable hollow core, a temperature of the core box 30 at which the desirable hollow core is obtained and a time required for heating the core sand 28 by the core box 30 are acquired by an experiment beforehand, and then the core is molded while controlling at least one of them according to the temperature and time.

In the core molding machine 1A in accordance with the second embodiment, which is of the under-blow type as with the core molding machine 1 in accordance with the first embodiment, the sand blow chamber 4 is always filled with the core sand 28 when filling the cavity 30*a* with the core sand 28. That is, the sand blow chamber 4 is filled with the core sand 28 up to the leading end of the blow head nozzle 50 also when moving the blow head 2 away from the core box 30 in the state 2-5. Therefore, the sand 130 dropping to the upper face of the blow head 2 does not enter the sand blow chamber 4 through the blow head nozzle 50. Since the sand 130 is discharged to the conduit member 120 by the fourth cleaning unit 112 in the subsequent step, sand masses, impurities, and the like contained in the sand 130, if any, can be prevented from adversely affecting the molding of the next core. That is, extremely excellent effects can be exhibited in molding the hollow core when utilizing the core molding machine 1A in accordance with the second embodiment, in which the blow head 2 has the sand blow chamber 4 and sand storage chamber 5, employing the under-blow type.

Then, as illustrated in FIG. 33 as the state 2-6, the fourth actuator 110 is driven so as to move the fourth cleaning unit 112 toward the blow head 2. At this time, the fourth cleaning unit 112 discharges the sand 130 from the upper face of the blow head nozzle 50 to the conduit member 120 while coming into slidable contact with the upper face of the blow head nozzle 50. The sand 130 discharged to the conduit member 120 passes through the filter member 122, so as to drop to the on/off gate 18. The filter member 122 traps sand masses, impurities having sizes greater than those of the sand masses, and the like contained in the sand 130, while the reusable sand 130 passes through the filter member 122.

Next, as illustrated in FIG. 34 as the state 2-7, the first actuator 36 is driven so as to move the movable die 33 away from the fixed die 32. This opens the dies. At this time, the movable die 33 is separated from the operating member 63, whereby the biasing force of the biasing member 62 moves the push member 61 to a projected position protruding from the fixed die 32 toward the movable die 33 within the fixed die 32. Therefore, the core 43 is released from the fixed die 32 and held by the movable die 33. At the time of opening the dies, the push member 58 is separated from the on/off gate 18, whereby the biasing force of the biasing means moves the on/off gate 18 to a position where the communication hole 18*a* communicates with the supply port 56. Hence, the sand tank 55 supplies sand to the sand storage chamber 5, while the sand 130 collected from the upper face of the blow head nozzle 50 by the fourth cleaning unit 112 is fed to the sand storage chamber 5.

Subsequently, as illustrated in FIG. 35 as the state 2-8, the first actuator 36 is driven so as to move the movable die 33 further away from the fixed die 32. This causes the abutment member 41 to abut against the orientation change member 42, thereby rotating the movable die 33 by 90° so that the movable die 33 and core 43 face up, thus changing the orientation of the movable die 33. At this time, the fourth actuator 110 is also driven, so as to move the fourth cleaning unit 112 away from the blow head nozzle 50.

Subsequently, as illustrated in FIG. 36 as the state 2-9, the first actuator 36 is driven so as to move the movable die 33 further away from the fixed die 32. This allows the slide member 45 to move up along the slide surface 46*a* of the guide member 46. As a consequence, the push unit 47*b* pushes the core 43 up with the aid of the slide member 45 and push member 47. Hence, the core 43 is released from the movable die 33. After the core 43 is taken out of the movable die 33, the core molding machine 1A returns to the state 2-1 again.

The foregoing second embodiment is equipped with the sand collection device 100 for collecting the sand 130 having dropped from the core box 30 to the upper face of the blow head 2. Therefore, the sand 130 having dropped on the upper face of the blow head 2 is collected by the sand collection device 100 without directly returning into the blow head 2. Hence, sand masses in which sand is assembled and solidified and the like contained in the sand 130 having dropped on the upper face of the blow head 2, if any, are collected by the sand collection device 100. This can prevent the sand masses from affecting the molding of the next core.

In the foregoing second embodiment, the sand collection device 100 has the conduit member 120 for guiding the sand from the upper face of the blow head 2 to the sand storage chamber 5 and the fourth cleaning unit 112 for removing the sand 130 having dropped on the upper face of the blow head 5 away therefrom to the conduit member 120. Therefore, the sand 130 having dropped on the upper face of the blow head 5 and then discharged to the conduit member 120 by the fourth cleaning unit 112, if any, is returned to the sand storage chamber 5. Hence, the sand 130 can be reused.

In the foregoing second embodiment, the conduit member 120 slopes down from the upper face of the blow head 2 to the sand storage chamber 5. This allows the sand 130 to slide down through the conduit member 120 under gravity when returning from the upper face of the blow head 2 to the sand storage chamber 5, thereby making it unnecessary to provide a separate transport device such as a conveyor. Therefore, the core molding machine 1A can be made simpler.

In the foregoing second embodiment, the conduit member 120 is provided with the filter member 122 adapted to pass therethrough sand having a predetermined particle size or smaller. Therefore, sand masses and the like contained in the sand 130 returned from the blow head 2 to the sand storage chamber 5, if any, can be removed by the filter member 122.

REFERENCE SIGNS LIST

1 . . . core molding machine; 2 . . . blow head; 4 . . . sand blow chamber; 5 . . . sand storage chamber; 7 . . . compressed air supply unit; 9 . . . aeration air supply unit; 30 . . . core box; 31 . . . sand filling device; 32 . . . fixed die; 33 . . . movable die; 55 . . . sand tank

The invention claimed is:

1. A core molding machine comprising:

a core box having a pair of laterally separable dies;

a sand filling device, having a blow head disposed under the core box, for filling the core box with core sand directed upward from the blow head;

a frame member for holding a fixed die as one of the pair of dies;

a first actuator for driving a movable die as the other of the pair of dies to move closer to or away from the fixed die;

a second actuator for vertically driving the blow head to move closer to or away from the core box; and a rotary drive unit for rotating the movable die moved away from the fixed die by the first actuator;

wherein the blow head has a sand blow chamber for guiding the core sand to the core box while being connected to the core box and a sand storage chamber communicating with the sand blow chamber; and wherein the sand filling device has a compressed air supply unit for supplying the sand storage chamber with a compressed air for blowing the core sand into the core box and an aeration air supply unit for supplying an aeration air for floating and fluidizing the core sand within the sand blow chamber.

2. A core molding machine according to claim 1, wherein the rotary drive unit comprises:

a rotary axis member provided in a movable die holding member for holding the movable die;

an abutment member provided in the rotary axis member so as to be rotatable with the rotary axis member; and an orientation change member for changing an orientation of the movable die through the rotary axis member when abutting against the abutment member;

wherein the orientation change member is located at a position, different from a height position of the rotary axis member, on a movement locus of the abutment member accompanying a movement of the movable die caused by the first actuator; and wherein, when the movable die having the abutment member in contact with the orientation change member is moved away from the fixed die by the first actuator, the abutment member, while changing an orientation thereof along a surface of the orientation change member, rotates the movable die with the aid of the rotary axis member and the movable die holding member.

3. A core molding machine according to claim 2, further comprising a first release unit for releasing a core from the movable die after the movable die holding the core is rotated by the rotary drive unit such that the core is on the upper side.

4. A core molding machine according to claim 3, wherein the first release unit comprises:

a slide member provided in the movable die; and a guide member, provided on the frame member side, having a slide surface for changing a height position of the slide member when abutting against the slide member;

wherein the slide surface is located on a movement locus of the slide member accompanying a movement of the movable die caused by the first actuator after the movable die is rotated by the rotary drive unit; and wherein, when the movable die having been rotated by the rotary drive unit is moved away from the fixed die by the first actuator, the slide member slides along the slide surface so as to push the core held by the movable die away from the movable die.

5. A core molding machine according to claim 4, further comprising:

a first cleaning unit adapted to abut against a blow head nozzle in the blow head when coming closer to the blow head; and a second cleaning unit adapted to abut against a fixed die nozzle in the fixed die when coming closer to the fixed die;

wherein the first and second cleaning units are moved closer to or away from the fixed die together with the movable die by the first actuator;

wherein, when moved closer to the blow head together with the movable die by the first actuator, the first cleaning unit slides while abutting against the blow head nozzle, so as to clean the blow head nozzle; and wherein, when moved closer to the fixed die together with the movable die by the first actuator, the second cleaning unit slides while abutting against the fixed nozzle, so as to clean the fixed die nozzle.

6. A core molding machine according to claim 5, further comprising a third cleaning unit provided in the frame member and adapted to abut against a movable die nozzle in the movable die when coming closer to the movable die;

wherein, when the movable die moved by the first actuator comes closer, the third cleaning unit slides while abutting against the movable die nozzle, so as to clean the movable die nozzle.

7. A core molding machine according to claim 1, further comprising:

a sand tank for supplying the sand storage chamber with the core sand through a supply port of the sand storage chamber; and an on/off gate, disposed between the sand tank and the supply port, for opening and closing the supply port;

wherein the on/off gate is driven by the first actuator, so as to close the supply port when the movable die forms a cavity for forming the core together with the fixed die.

8. A core molding machine according to claim 7, further comprising a flexible hose disposed between the sand tank and the supply port of the sand storage chamber.

9. A core molding machine according to claim 1, further comprising a second release unit for releasing a core from the fixed die such that the core is held by the movable die when the core is molded within a cavity, formed by the movable die and the fixed die, for forming the core and the movable die is moved away from the fixed die by the first actuator, wherein the second release unit comprises:

a push member, provided in the fixed die and movable between a projected position protruding from the fixed die toward the movable die and a retracted position receding more from the movable die than is the projected position, for separating the core from the fixed die;

an operating member connected to the push member and located outside of the cavity; and a biasing member for biasing the push member and the operating member toward the movable die;

wherein, when the movable die moved by the first actuator is assembled with the fixed die, so as to form the cavity, the operating member is pushed by the movable die against a biasing force from the biasing member, so as to move the push member from the projected position to the retracted position.

10. A core molding machine according to claim 1, further comprising a sand collection device for collecting the sand having dropped from the core box to an upper face of the blow head, wherein the sand collection device comprises:

a conduit member for guiding the sand from the upper face of the blow head to the sand storage chamber; and a cleaning unit for removing and discharging the sand having dropped on the upper face of the blow head away from the upper face of the blow head to the conduit member, wherein the conduit member slopes down from the upper face of the blow head to the sand storage chamber, wherein the conduit member is provided with a filter member adapted to pass therethrough sand having a predetermined particle size or smaller.

11. A core molding method comprising:

a cavity formation step of assembling a pair of laterally separable dies with each other, so as to yield a core box having a cavity therewithin;

a communication step of connecting a blow head to the core box, so as to communicate the cavity and the blow head to each other;

a fluidization step of blowing an aeration air into a sand blow chamber in the blow head by an aeration air supply unit, so as to float and fluidize core sand within the sand blow chamber;

a filling step of blowing a compressed air into a sand storage chamber, communicating with the sand blow chamber, in the blow head by a compressed air supply unit, so as to blow the floated and fluidized core sand within the sand blow chamber upward from the blow head, thereby filling the cavity communicating with the blow head with the core sand;

a separation step of driving a movable die as one of the pair of dies by a first actuator after the filling step, so as to separate the movable die from a fixed die as the other of the pair of dies;

a die rotation step of rotating the movable die after the separation step; and a release step of releasing a core from the movable die after the movable die holding the core is rotated such that the core is on the upper side after the die rotation step;

wherein the die rotation step includes:

moving the movable die held by a movable die holding member away from the fixed die by the first actuator, so as to bring an abutment member attached to the movable die holding member through a rotary axis member into contact with an orientation change member located on an advancing path of the abutment member; and rotating the movable die with the aid of the rotary axis member and the movable die holding member by changing an orientation of the abutment member along a surface of the orientation change member while further moving the movable die away from the fixed die by the first actuator in a state where the abutment member is in contact with the orientation change member.

12. A core molding method according to claim 11, further comprising:

a first cleaning step of driving a first cleaning unit together with the movable die by the first actuator such that the first cleaning unit slides while abutting against a blow head nozzle in the blow head, so as to clean the blow head nozzle; and a second cleaning step of driving a second cleaning unit together with the movable die by the first actuator such that the second cleaning unit slides while abutting against a fixed die nozzle in the fixed die, so as to clean the fixed die nozzle.

13. A core molding method according to claim 12, further comprising a third cleaning step of driving the movable die by the first actuator such that a third cleaning unit slides while abutting against a movable die nozzle in the movable die, so as to clean the movable die nozzle.

14. A core molding method according to claim 13, further comprising an opening and closing step of driving by the first actuator an on/off gate located between a supply port of the sand storage chamber and a sand tank for supplying the sand storage chamber with the core sand, so as to open and close the supply port;

wherein the opening and closing step closes the supply port when the movable die forms the cavity for forming the core together with the fixed die.

15. A core molding method according to claim 14, further comprising a die open step of releasing the core from the fixed die such that the core is held by the movable die when the core is molded within the cavity, formed by the movable die and the fixed die, for forming the core and the movable die is moved away from the fixed die by the first actuator between the filling and die rotation steps.

16. A core molding method according to claim 11, further comprising:

a hollow part formation step of moving the core box and the blow head away from each other before all of the core sand filling the core box is solidified after the filling step, so as to discharge an unsolidified part of the core sand from the core box to an upper face of the blow head, thereby molding a hollow core having a hollow part formed in the core; and a sand collection step of removing from the upper face of the blow head the sand discharged thereto and collecting the removed sand by a sand collection device, wherein the sand collection step supplies the collected sand to the sand storage chamber.

* * * * *